US011487231B2

(12) United States Patent
Inoue et al.

(10) Patent No.: US 11,487,231 B2
(45) Date of Patent: Nov. 1, 2022

(54) HEATER, HEATING DEVICE, AND IMAGE FORMING APPARATUS

(71) Applicants: Daisuke Inoue, Tokyo (JP); Yuusuke Furuichi, Kanagawa (JP)

(72) Inventors: Daisuke Inoue, Tokyo (JP); Yuusuke Furuichi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 37 days.

(21) Appl. No.: 17/086,764

(22) Filed: Nov. 2, 2020

(65) Prior Publication Data

US 2021/0157259 A1 May 27, 2021

(30) Foreign Application Priority Data

Nov. 26, 2019 (JP) ..... JP2019-213199
Sep. 17, 2020 (JP) ..... JP2020-156344

(51) Int. Cl.
*G03G 15/20* (2006.01)
*H05B 3/03* (2006.01)
*H05B 3/02* (2006.01)

(52) U.S. Cl.
CPC ..... *G03G 15/2053* (2013.01); *H05B 3/02* (2013.01); *H05B 3/03* (2013.01)

(58) Field of Classification Search
CPC ..... G03G 15/2017; G03G 15/2053; G03G 2215/2003; H05B 3/02; H05B 3/03; H05B 3/10
See application file for complete search history.

(56) References Cited

U.S. PATENT DOCUMENTS

2020/0033766 A1 1/2020 Hase et al.
2020/0033767 A1 1/2020 Adachi et al.
2020/0033775 A1 1/2020 Inoue et al.
2020/0241452 A1 7/2020 Saitoh et al.
2020/0241453 A1 7/2020 Okamoto et al.
2020/0249601 A1 8/2020 Inoue et al.
2020/0249602 A1 8/2020 Inoue et al.
2020/0292972 A1 9/2020 Inoue et al.
2020/0292973 A1 9/2020 Furuichi et al.

FOREIGN PATENT DOCUMENTS

JP 2016-062024 4/2016

*Primary Examiner* — Thomas S Giampaolo, II
(74) *Attorney, Agent, or Firm* — Harness, Dickey & Pierce, P.L.C.

(57) ABSTRACT

A heater includes a first heat generator and a second heat generator each of which has a hypothetical center line that divides each of the first heat generator and the second heat generator into a first section and a second section. A first conductor connects a first electrode to the first heat generator and the second heat generator. A second conductor connects a second electrode to the first heat generator and the second heat generator. A first primary connector connects the first conductor to the first section of the first heat generator. A second primary connector connects the first conductor to the second section of the second heat generator. A first secondary connector connects the second conductor to the first heat generator. A second secondary connector connects the second conductor to the second heat generator.

20 Claims, 33 Drawing Sheets

| | FIRST BLOCK | SECOND BLOCK | THIRD BLOCK | FOURTH BLOCK | FIFTH BLOCK | SIXTH BLOCK | SEV-ENTH BLOCK |
|---|---|---|---|---|---|---|---|
| HEAT GENERATION AMOUNT OF FIRST FEEDER 620A | 10000 | 6400 | 3600 | 1600 | 400 | — | — |
| HEAT GENERATION AMOUNT OF SECOND FEEDER 620B | — | 400 | 1600 | 3600 | 6400 | 10000 | 14400 |
| HEAT GENERATION AMOUNT OF THIRD FEEDER 620C | 400 | 400 | 400 | 400 | 400 | 400 | — |
| TOTAL HEAT GENERATION AMOUNT | 10400 | 7200 | 5600 | 5600 | 7200 | 10400 | 14400 |

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| HEAT GENERATION AMOUNT OF FIRST FEEDER 620A | | 6400 | 3600 | 1600 | 400 | — | |
| HEAT GENERATION AMOUNT OF SECOND FEEDER 620B | | 25 | 225 | 1225 | 3025 | 5625 | |
| HEAT GENERATION AMOUNT OF THIRD FEEDER 620C | | 25 | 25 | 25 | 25 | 25 | |
| TOTAL HEAT GENERATION AMOUNT | | 6450 | 3850 | 2850 | 3450 | 5650 | |

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| HEAT GENERATION AMOUNT OF FIRST FEEDER 62A | 10000 | 6400 | 3600 | 3600 | 1600 | — | — |
| HEAT GENERATION AMOUNT OF SECOND FEEDER 62B | — | 400 | 1600 | 6400 | 10000 | 10000 | 14400 |
| HEAT GENERATION AMOUNT OF THIRD FEEDER 62C | 400 | 400 | 400 | 400 | 400 | 400 | — |
| TOTAL HEAT GENERATION AMOUNT | 10400 | 7200 | 5600 | 10400 | 12000 | 10400 | 14400 |

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| HEAT GENERATION AMOUNT OF FIRST FEEDER 62A | | 6400 | 3600 | 3600 | 1600 | — | |
| HEAT GENERATION AMOUNT OF SECOND FEEDER 62B | | 25 | 225 | 3025 | 5625 | 5625 | |
| HEAT GENERATION AMOUNT OF THIRD FEEDER 62C | | 25 | 25 | 25 | 25 | 25 | |
| TOTAL HEAT GENERATION AMOUNT | | 6450 | 3850 | 6650 | 7250 | 5650 | |

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| HEAT GENERATION AMOUNT OF FIRST FEEDER 62A | 10000 | 6400 | 6400 | 3600 | 1600 | 400 | — |
| HEAT GENERATION AMOUNT OF SECOND FEEDER 62B | — | 1600 | 3600 | 6400 | 10000 | 10000 | 14400 |
| HEAT GENERATION AMOUNT OF THIRD FEEDER 62C | 400<br>400 | 400 | 400 | 400 | 400 | 400 | — |
| TOTAL HEAT GENERATION AMOUNT | 10800 | 8400 | 10400 | 10400 | 12000 | 10800 | 14400 |

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| HEAT GENERATION AMOUNT OF FIRST FEEDER 62A | | 6400 | 6400 | 3600 | 1600 | 400 | |
| HEAT GENERATION AMOUNT OF SECOND FEEDER 62B | | 225 | 1225 | 3025 | 5625 | 5625 | |
| HEAT GENERATION AMOUNT OF THIRD FEEDER 62C | | 25 | 25 | 25 | 25 | 25 | |
| TOTAL HEAT GENERATION AMOUNT | | 6650 | 7650 | 6650 | 7250 | 6050 | |

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| HEAT GENERATION AMOUNT OF FIRST FEEDER 62A | 10000 | 6400 | 6400 | 3600 | 1600 | — | — |
| HEAT GENERATION AMOUNT OF SECOND FEEDER 62B | — | 400 | 3600 | 6400 | 10000 | 10000 | 14400 |
| HEAT GENERATION AMOUNT OF THIRD FEEDER 62C | 400 | 400 | 400 | 400 | 400 | 400 | — |
| HEAT GENERATION AMOUNT OF SLOPE 620 | — | 400<br>400 | 400<br>400 | — | — | — | — |
| TOTAL HEAT GENERATION AMOUNT | 10400 | 8000 | 11200 | 10400 | 12000 | 10400 | 14400 |

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| HEAT GENERATION AMOUNT OF FIRST FEEDER 62A | | 6400 | 6400 | 3600 | 1600 | — | |
| HEAT GENERATION AMOUNT OF SECOND FEEDER 62B | | 25 | 1225 | 3025 | 5625 | 5625 | |
| HEAT GENERATION AMOUNT OF THIRD FEEDER 62C | | 25 | 25 | 25 | 25 | 25 | |
| HEAT GENERATION AMOUNT OF SLOPE 620 | | 400<br>400 | 400<br>400 | — | — | — | |
| TOTAL HEAT GENERATION AMOUNT | | 7250 | 8450 | 6650 | 7250 | 5650 | |

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| HEAT GENERATION AMOUNT OF FIRST FEEDER 62A | 10000 | 6400 | 6400 | 3600 | 1600 | 400 | — |
| HEAT GENERATION AMOUNT OF SECOND FEEDER 62B | — | 1600 | 3600 | 6400 | 10000 | 10000 | 14400 |
| HEAT GENERATION AMOUNT OF THIRD FEEDER 62C | 400<br>400 | 400 | 400 | 400 | 400 | 400 | — |
| HEAT GENERATION AMOUNT OF SLOPE 620 | — | 400<br>400 | 400<br>400 | 400<br>400 | — | 400<br>400 | — |
| TOTAL HEAT GENERATION AMOUNT | 10800 | 9200 | 11200 | 11200 | 12000 | 11600 | 14400 |

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| HEAT GENERATION AMOUNT OF FIRST FEEDER 62A | | 6400 | 6400 | 3600 | 1600 | 400 | |
| HEAT GENERATION AMOUNT OF SECOND FEEDER 62B | | 225 | 1225 | 3025 | 5625 | 5625 | |
| HEAT GENERATION AMOUNT OF THIRD FEEDER 62C | | 25 | 25 | 25 | 25 | 25 | |
| HEAT GENERATION AMOUNT OF SLOPE 620 | | 400<br>400 | 400<br>400 | 400<br>400 | — | 400<br>400 | |
| TOTAL HEAT GENERATION AMOUNT | | 7450 | 8450 | 7450 | 7250 | 6850 | |

| | FIRST BLOCK | SECOND BLOCK | THIRD BLOCK | FOURTH BLOCK | FIFTH BLOCK |
|---|---|---|---|---|---|
| HEAT GENERATION AMOUNT OF FIRST FEEDER 620A | 10000 | 6400 | 3600 | 1600 | 400 |
| HEAT GENERATION AMOUNT OF SECOND FEEDER 620B | 400 | 1600 | 3600 | 6400 | 10000 |
| TOTAL HEAT GENERATION AMOUNT | 10400 | 8000 | 7200 | 8000 | 10400 |

| | FIRST BLOCK | SECOND BLOCK | THIRD BLOCK | FOURTH BLOCK | FIFTH BLOCK |
|---|---|---|---|---|---|
| HEAT GENERATION AMOUNT OF FIRST FEEDER 62A | 6400 | 6400 | 3600 | 1600 | — |
| HEAT GENERATION AMOUNT OF SECOND FEEDER 62B | — | 1600 | 3600 | 6400 | 6400 |
| TOTAL HEAT GENERATION AMOUNT | 6400 | 8000 | 7200 | 8000 | 6400 |

HEATER, HEATING DEVICE, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos 2019-213199, filed on Nov. 26, 2019, and 2020-156344, filed on Sep. 17, 2020, in the Japan Patent Office, the entire disclosure of each of which is hereby incorporated by reference herein.

BACKGROUND

Technical Field

Exemplary aspects of the present disclosure relate to a heater, a heating device, and an image forming apparatus, and more particularly, to a heater, a heating device including the heater, and an image forming apparatus incorporating the heater.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device that fixes a toner image on a sheet serving as a recording medium under heat or a dryer that dries ink on a sheet. The fixing device and the dryer employ a heater incorporating a laminated, resistive heat generator.

SUMMARY

This specification describes below an improved heater. In one embodiment, the heater includes a base that is platy and extended in a longitudinal direction of the base, a first electrode mounted on the base, a second electrode mounted on the base, a first heat generator mounted on the base, and a second heat generator arranged with the first heat generator in the longitudinal direction of the base. Each of the first heat generator and the second heat generator has a hypothetical center line in the longitudinal direction of the base. The hypothetical center line divides each of the first heat generator and the second heat generator into a first section and a second section. A first conductor is mounted on the base and connects the first electrode to the first heat generator and the second heat generator. A second conductor is mounted on the base and connects the second electrode to the first heat generator and the second heart generator. A first primary connector connects the first conductor to the first section of the first heat generator. A second primary connector connects the first conductor to the second section of the second heat generator. A first secondary connector connects the second conductor to the first heat generator. A second secondary connector connects the second conductor to the second heat generator.

This specification further describes an improved heating device. In one embodiment, the heating device includes a holder and the heater described above that is held by the holder.

This specification further describes an improved image forming apparatus. In one embodiment, the image forming apparatus includes an image forming device that forms an image on a recording medium and the heater described above that heats the image on the recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
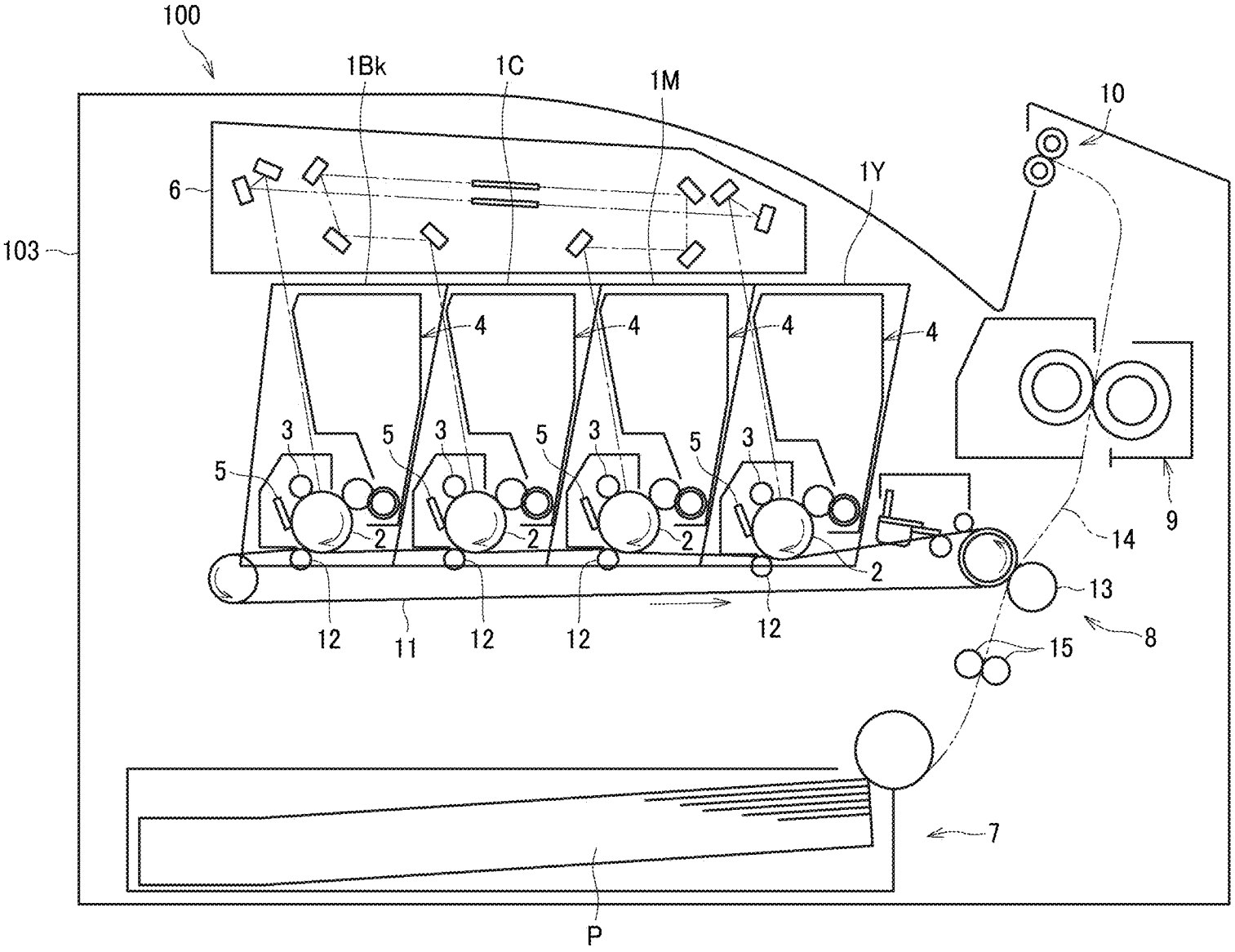
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to the attached drawings, the following describes a construction of an image forming apparatus 100 according to embodiments of the present disclosure.

In the drawings for explaining the embodiments of the present disclosure, identical reference numerals are assigned to elements such as members and parts that have an identical function or an identical shape as long as differentiation is possible. Hence, a description of those elements is omitted once the description is provided.

FIG. 1 is a schematic cross-sectional view of the image forming apparatus 100 according to an embodiment of the present disclosure.

As illustrated in FIG. 1, the image forming apparatus 100 includes four image forming units 1Y, 1M, 1C, and 1Bk serving as image forming devices, respectively. The image forming units 1Y, 1M, 1C, and 1Bk are removably installed in an apparatus body 103 of the image forming apparatus 100. The image forming units 1Y, 1M, 1C, and 1Bk have an identical construction except that the image forming units 1Y, 1M, 1C, and 1Bk contain developers in different colors, that is, yellow, magenta, cyan, and black, respectively, which correspond to color separation components for a color image. For example, each of the image forming units 1Y, 1M, 1C, and 1Bk includes a photoconductor 2, a charger 3, a developing device 4, and a cleaner 5. The photoconductor 2 is drum-shaped and serves as an image bearer. The charger 3 charges a surface of the photoconductor 2. The developing device 4 supplies toner as a developer to the surface of the photoconductor 2 to form a toner image thereon. The cleaner 5 cleans the surface of the photoconductor 2.

The image forming apparatus 100 further includes an exposure device 6, a sheet feeding device 7, a transfer device 8, a fixing device 9, and a sheet ejection device 10. The exposure device 6 exposes the surface of each of the photoconductors 2 and forms an electrostatic latent image thereon. The sheet feeding device 7 supplies a sheet P serving as a recording medium to the transfer device 8. The transfer device 8 transfers the toner image formed on each of the photoconductors 2 onto the sheet P. The fixing device 9 fixes the toner image transferred onto the sheet P thereon. The sheet ejection device 10 ejects the sheet P onto an outside of the image forming apparatus 100.

The transfer device 8 includes an intermediate transfer belt 11, four primary transfer rollers 12, and a secondary transfer roller 13. The intermediate transfer belt 11 is an endless belt serving as an intermediate transferor stretched taut across a plurality of rollers. The four primary transfer rollers 12 serve as primary transferors that transfer yellow, magenta, cyan, and black toner images formed on the photoconductors 2 onto the intermediate transfer belt 11, respectively, thus forming a full color toner image on the intermediate transfer belt 11.

The plurality of primary transfer rollers 12 is pressed against the photoconductors 2, respectively, via the intermediate transfer belt 11. Thus, the intermediate transfer belt 11 contacts each of the photoconductors 2, forming a primary transfer nip therebetween. The secondary transfer roller 13 serves as a secondary transferor that transfers the full color toner image formed on the intermediate transfer belt 11 onto the sheet P. The secondary transfer roller 13 is pressed against one of the rollers across which the intermediate transfer belt 11 is stretched taut via the intermediate transfer belt 11. Thus, a secondary transfer nip is formed between the secondary transfer roller 13 and the intermediate transfer belt 11.

The image forming apparatus 100 accommodates a sheet conveyance path 14 through which the sheet P fed from the sheet feeding device 7 is conveyed. A timing roller pair 15 is disposed in the sheet conveyance path 14 at a position between the sheet feeding device 7 and the secondary transfer nip defined by the secondary transfer roller 13.

Referring to FIG. 1, a description is provided of printing processes performed by the image forming apparatus 100 having the construction described above.

When the image forming apparatus 100 starts printing, a driver drives and rotates the photoconductor 2 clockwise in FIG. 1 in each of the image forming units 1Y, 1M, 1C, and 1Bk. The charger 3 charges the surface of the photoconductor 2 uniformly at a high electric potential. Subsequently, the exposure device 6 exposes the surface of each of the photoconductors 2 based on image data created by an original scanner that reads an image on an original or print data sent from a terminal, thus decreasing the electric potential of an exposed portion on the photoconductor 2 and forming an electrostatic latent image on the photoconductor 2. The developing device 4 supplies toner to the electrostatic latent image formed on the photoconductor 2, forming a toner image thereon.

When the toner images formed on the photoconductors 2 reach the primary transfer nips defined by the primary transfer rollers 12 in accordance with rotation of the photoconductors 2, the toner images formed on the photoconductors 2 are transferred onto the intermediate transfer belt 11 driven and rotated counterclockwise in FIG. 1 successively such that the toner images are superimposed on the intermediate transfer belt 11, forming a full color toner image thereon. Thereafter, the full color toner image formed on the intermediate transfer belt 11 is conveyed to the secondary transfer nip defined by the secondary transfer roller 13 in accordance with rotation of the intermediate transfer belt 11 and is transferred onto a sheet P conveyed to the secondary transfer nip. The sheet P is supplied from the sheet feeding device 7. The timing roller pair 15 temporarily halts the sheet P supplied from the sheet feeding device 7. Thereafter, the timing roller pair 15 conveys the sheet P to the secondary transfer nip at a time when the full color toner image formed on the intermediate transfer belt 11 reaches the secondary transfer nip. Accordingly, the full color toner image is transferred onto and borne on the sheet P. After the toner image is transferred onto the sheet P through the intermediate transfer belt 11, the cleaner 5 removes residual toner remained on the photoconductor 2 therefrom.

The sheet P transferred with the full color toner image is conveyed to the fixing device 9 that fixes the full color toner image on the sheet P. Thereafter, the sheet ejection device 10 ejects the sheet P onto the outside of the image forming apparatus 100, thus finishing a series of printing processes.

A detailed description is provided of a construction of the fixing device 9.

Figure 2:
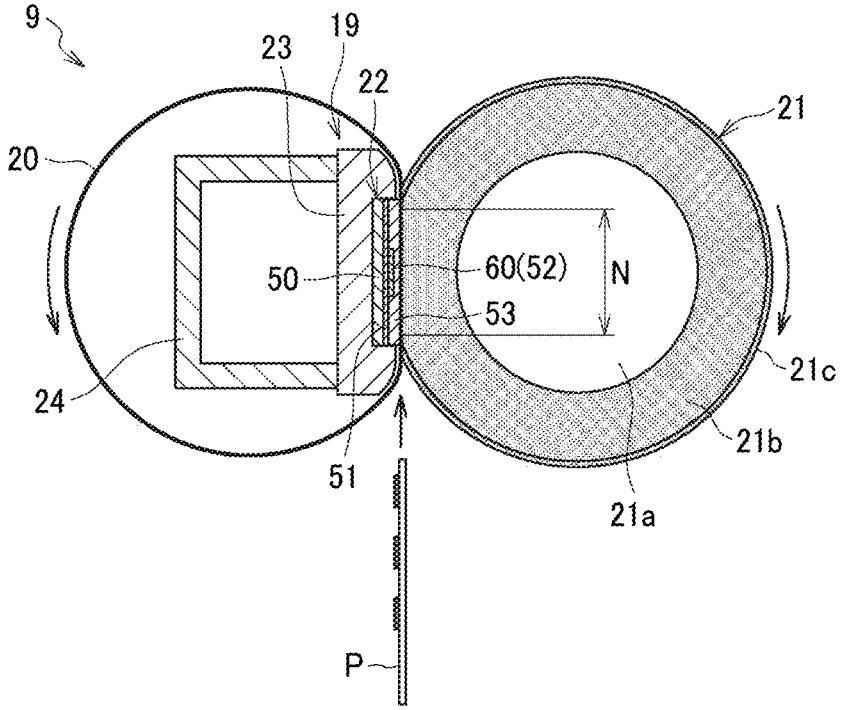
FIG. 2 is a schematic cross-sectional view of a fixing device incorporated in the image forming apparatus depicted in FIG. 1.

As illustrated in FIG. 2, the fixing device 9 according to the embodiments includes a fixing belt 20, a pressure roller 21, and a heating device 19. The heating device 19 heats the fixing belt 20. The heating device 19 includes a heater 22, a heater holder 23, and a stay 24.

A detailed description is now given of a construction of the fixing belt 20.

The fixing belt 20 is an endless belt serving as a fixing rotator or a fixing member that is rotatable in a rotation direction indicated with an arrow in FIG. 2. For example, the fixing belt 20 includes a tubular base that is made of polyimide (PI) and has an outer diameter of 25 mm and a thickness in a range of from 40 μm to 120 μm. The fixing belt 20 further includes a release layer serving as an outermost surface layer to enhance durability of the fixing belt 20 and facilitate separation of the sheet P and a foreign substance from the fixing belt 20. For example, the release layer has a thickness in a range of from 5 μm to 50 μm and is made of fluororesin, such as perfluoroalkoxy alkane (PFA) and polytetrafluoroethylene (PTFE). Optionally, an elastic layer may be interposed between the base and the release layer. For example, the elastic layer has a thickness in a range of from 50 μm to 500 μm and is made of rubber or the like. The base of the fixing belt 20 may be made of heat resistant resin such as polyetheretherketone (PEEK) or metal such as nickel (Ni) and SUS stainless steel, instead of polyimide. An inner circumferential surface of the fixing belt 20 may be coated with polyimide, PTFE, or the like to produce a slide layer.

A detailed description is now given of a construction of the pressure roller 21.

The pressure roller 21 serves as an opposed rotator or an opposed member that contacts an outer circumferential surface of the fixing belt 20 to form a fixing nip N between the fixing belt 20 and the pressure roller 21. The pressure roller 21 is rotatable in a rotation direction indicated with an arrow in FIG. 2. The pressure roller 21 has an outer diameter of 25 mm, for example. The pressure roller 21 includes a cored bar 21*a*, an elastic layer 21*b*, and a release layer 21*c*. The cored bar 21*a* is solid and made of metal such as iron. The elastic layer 21*b* is disposed on a surface of the cored bar 21*a*. The release layer 21*c* coats an outer surface of the elastic layer 21*b*. The elastic layer 21*b* is made of silicone rubber and has a thickness of 3.5 mm, for example. In order to facilitate separation of the sheet P and the foreign substance from the pressure roller 21, the release layer 21*c* is preferably disposed on the outer surface of the elastic layer 21*b*. The release layer 21*c* is made of fluororesin and has a thickness of about 40 μm, for example.

A spring serving as a biasing member described below causes the pressure roller 21 and the fixing belt 20 to press against each other. Thus, the fixing nip N is formed between the fixing belt 20 and the pressure roller 21. As a driving force is transmitted to the pressure roller 21 from a driver disposed inside the apparatus body 103 of the image forming apparatus 100, the pressure roller 21 serves as a driving roller that drives and rotates the fixing belt 20. The fixing belt 20 is driven and rotated by the pressure roller 21 as the pressure roller 21 rotates. While the fixing belt 20 rotates, the fixing belt 20 slides over the heater 22. In order to facilitate sliding of the fixing belt 20 over the heater 22, a lubricant such as oil and grease may be interposed between the heater 22 and the fixing belt 20.

A detailed description is now given of a construction of the heater 22.

The heater 22 is a laminated heater and serves as a heater or a heating member. The heater 22 extends in a longitudinal direction thereof throughout an entirety of the fixing belt 20 in a longitudinal direction, that is, an axial direction, of the fixing belt 20. The heater 22 contacts the inner circumferential surface of the fixing belt 20 at the fixing nip N where the heater 22 is disposed opposite the pressure roller 21 via the fixing belt 20. The heater 22 is a plate that is substantially rectangular. The heater 22 has a long side that is parallel to the longitudinal direction of the fixing belt 20. The heater 22 includes a base 50, a first insulating layer 51, a conductor layer 52, and a second insulating layer 53. The base 50 is platy. The conductor layer 52 includes a heat generating portion 60. The first insulating layer 51 is mounted on the base 50. The conductor layer 52 is mounted on the first insulating layer 51. The second insulating layer 53 is mounted on the conductor layer 52. According to this embodiment, the base 50, the first insulating layer 51, the conductor layer 52 including the heat generating portion 60, and the second insulating layer 53 are layered and arranged in this order toward the fixing belt 20 defining the fixing nip N. Hence, heat generated by the heat generating portion 60 is conducted to the fixing belt 20 through the second insulating layer 53.

Unlike this embodiment, the heat generating portion 60 may be disposed on a heater holder side of the base 50, that faces the heater holder 23 and is opposite a fixing belt side of the base 50, that faces the fixing belt 20. In this case, heat generated by the heat generating portion 60 is conducted to the fixing belt 20 through the base 50. Hence, the base 50 is preferably made of a material having an increased thermal conductivity, such as aluminum nitride. With the construction of the heater 22 according to this embodiment, the heater 22 may further include an insulating layer disposed on a heater holder side face of the base 50, that faces the heater holder 23 and is opposite a fixing belt side face of the base 50, that faces the fixing belt 20.

The heater 22 may not contact the fixing belt 20 or may be disposed opposite the fixing belt 20 indirectly via a low friction sheet or the like. However, in order to enhance efficiency in conduction of heat from the heater 22 to the fixing belt 20, the heater 22 that directly contacts the fixing belt 20, like this embodiment, is preferably employed. Alternatively, the healer 22 may contact the outer circumferential surface of the fixing belt 20. If the heater 22 contacts the inner circumferential surface of the fixing belt 20 like this embodiment, since the heater 22 does not contact the outer circumferential surface of the fixing belt 20, the heater 22 does not damage the outer circumferential surface of the fixing belt 20, suppressing degradation in quality of fixing the toner image on the sheet R.

A detailed description is now given of a construction of the heater holder 23 and the stay 24.

The heater holder 23 and the stay 24 are disposed inside a loop formed by the fixing belt 20. The heater holder 23 serves as a holder that holds or supports the heater 22. The stay 24 serves as a reinforcement that reinforces the heater holder 23 throughout an entirety of the heater holder 23 in a longitudinal direction thereof. The stay 24 includes a channel made of metal. Both lateral ends of the stay 24 in a longitudinal direction thereof are supported by side walls (e.g., side plates) of the fixing device 9, respectively. The stay 24 contacts a stay side face of the heater holder 23, that faces the stay 24 and is opposite a heater side face of the heater holder 23, that faces the heater 22. Accordingly, the stay 24 supports the heater holder 23. Further, the stay 24 retains the heater 22 and the heater holder 23 to be immune from being bent substantially by pressure from the pressure roller 21, forming the fixing nip N between the fixing belt 20 and the pressure roller 21.

The heater holder 23 is subject to temperature increase by heat from the heater 22. Hence, the heater holder 23 is preferably made of a heat resistant material. For example, if the heater holder 23 is made of heat resistant resin having a decreased thermal conductivity, such as liquid crystal polymer (LCP) and PEEK, the heater holder 23 suppresses conduction of heat thereto from the heater 22, facilitating heating of the fixing belt 20.

When printing starts, as power is supplied to the heater 22, the heat generating portion 60 generates heat, heating the fixing belt 20. The driver drives and rotates the pressure roller 21 and the fixing belt 20 starts rotation in accordance with rotation of the pressure roller 21. In a state in which the temperature of the fixing belt 20 reaches a predetermined target temperature (e.g., a fixing temperature), as a sheet P bearing an unfixed toner image is conveyed through the fixing nip N formed between the fixing belt 20 and the pressure roller 21 as illustrated in FIG. 2, the fixing belt 20 and the pressure roller 21 fix the unfixed toner image on the sheet P under heat and pressure.

Figure 3:
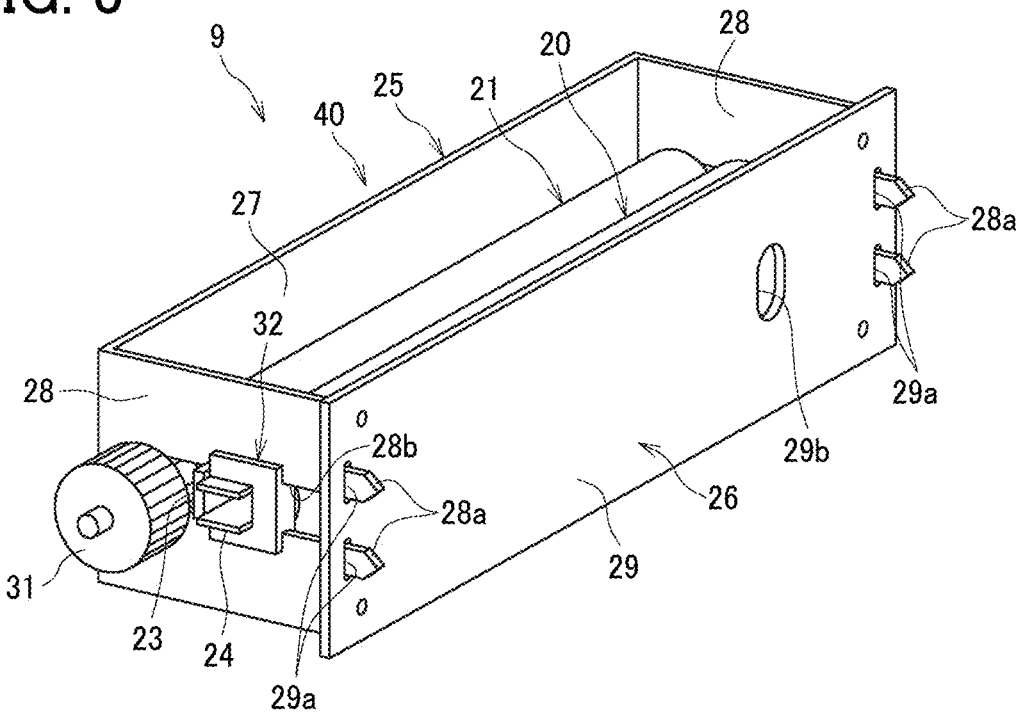
FIG. 3 is a perspective view of the fixing device depicted in FIG. 2.
Figure 4:
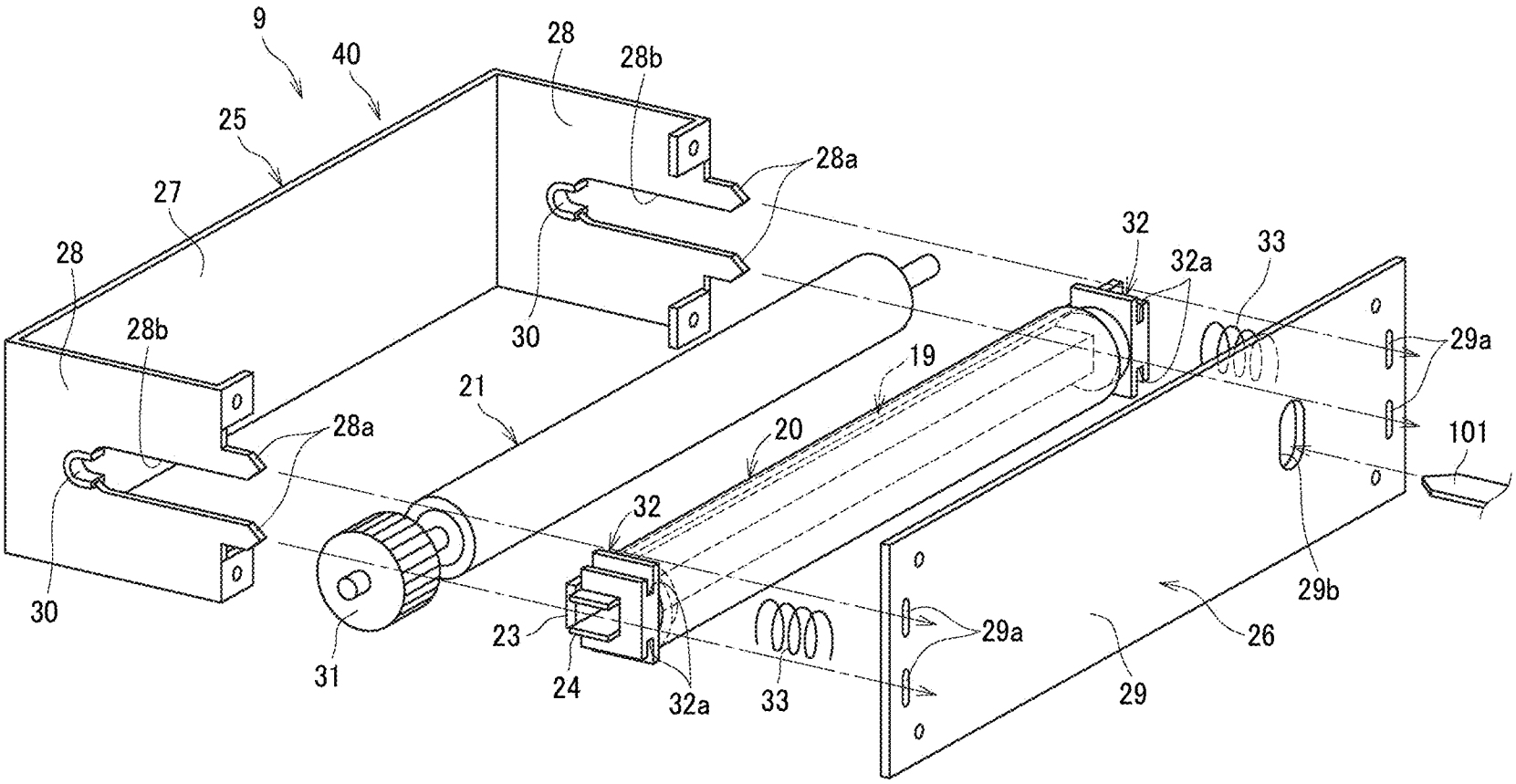
FIG. 4 is an exploded perspective view of the fixing device depicted in FIG. 3.

FIG. 3 is a perspective view of the fixing device 9. FIG. 4 is an exploded perspective view of the fixing device 9.

As illustrated in FIGS. 3 and 4, the fixing device 9 includes a device frame 40 that includes a first device frame 25 and a second device frame 26. The first device frame 25 includes a pair of side walls 28 and a front wall 27. The second device frame 26 includes a rear wall 29. The side walls 28 are disposed at one lateral end and another lateral end of the first device frame 25 in the longitudinal direction of the fixing belt 20, respectively. The side walls 28 support both lateral ends of each of the fixing belt 20, the pressure roller 21, and the heating device 19, respectively, in the longitudinal direction of the fixing belt 20. Each of the side walls 28 includes a plurality of engaging projections 28*a*. As the engaging projections 28*a* engage engaging holes 29*a* penetrating through the rear wall 29, respectively, the first device frame 25 is coupled to the second device frame 26.

Each of the side walls 28 includes an insertion recess 28*b* through which a rotation shaft of the pressure roller 21 and the like are inserted. The insertion recess 28*b* is open at an opening that faces the rear wall 29 and closed at a bottom that is opposite the opening and serves as a contact portion. A bearing 30 that supports the rotation shaft of the pressure roller 21 is disposed at an end of the insertion recess 28*b*, that serves as the contact portion. As both lateral ends of the rotation shaft of the pressure roller 21 in an axial direction thereof are attached to the bearings 30, respectively, the side walls 28 rotatably support the pressure roller 21.

A driving force transmitting gear 31 serving as a driving force transmitter is mounted on one lateral end of the rotation shaft of the pressure roller 21 in the axial direction thereof. In a state in which the side walls 28 support the pressure roller 21, the driving force transmitting gear 31 is exposed outside the side wall 28. Accordingly, when the fixing device 9 is installed in the apparatus body 103 of the image forming apparatus 100, the driving force transmitting gear 31 is coupled to a gear disposed inside the apparatus body 103 of the image forming apparatus 100 so that the driving force transmitting gear 31 transmits the driving force from the driver to the pressure roller 21. Alternatively, a driving force transmitter that transmits the driving force to the pressure roller 21 may be pulleys over which a driving force transmitting belt is stretched taut, a coupler, and the like instead of the driving force transmitting gear 31.

A pair of supports 32 is disposed at both lateral ends of the heating device 19 in a longitudinal direction thereof, respectively. The pair of supports 32 supports the fixing belt 20, the heater holder 23, the stay 24, and the like. Each of the supports 32 includes guide grooves 32*a*. As the guide grooves 32*a* move along edges of the insertion recess 28*b* of the side wall 28, respectively, and enter the insertion recess 28*b*, the support 32 is attached to the side wall 28.

A pair of springs 33 serving as a pair of biasing members is interposed between the supports 32 and the rear wall 29, respectively. As the springs 33 bias the stay 24 and the supports 32 toward the pressure roller 21, respectively, the fixing belt 20 is pressed against the pressure roller 21 to form the fixing nip N between the fixing belt 20 and the pressure roller 21.

As illustrated in FIG. 4, a hole 29*b* is disposed at one lateral end of the rear wall 29 of the second device frame 26 in a longitudinal direction thereof. The hole 29*b* serves as a positioner that positions a device body of the fixing device 9 with respect to the apparatus body 103 of the image forming apparatus 100. On the other hand, a projection 101 serving as a positioner is disposed in the apparatus body 103 of the image forming apparatus 100. As the projection 101 is inserted into the hole 29*b* of the fixing device 9, the projection 101 engages the hole 29*b*, positioning the device body of the fixing device 9 with respect to the apparatus body 103 of the image forming apparatus 100 in the longitudinal direction of the fixing belt 20. Although the hole 29*b* serving as a positioner is disposed at one lateral end of the rear wall 29 in the longitudinal direction of the second device frame 26, another positioner is not disposed at another lateral end of the rear wall 29. Accordingly, even if the device body of the fixing device 9 expands and shrinks thermally in the longitudinal direction of the fixing belt 20 due to temperature change, the second device frame 26 does not restrict thermal expansion and shrinkage of the device body of the fixing device 9 in the longitudinal direction of the fixing belt 20, thus suppressing deformation of the device body of the fixing device 9.

Figure 5:
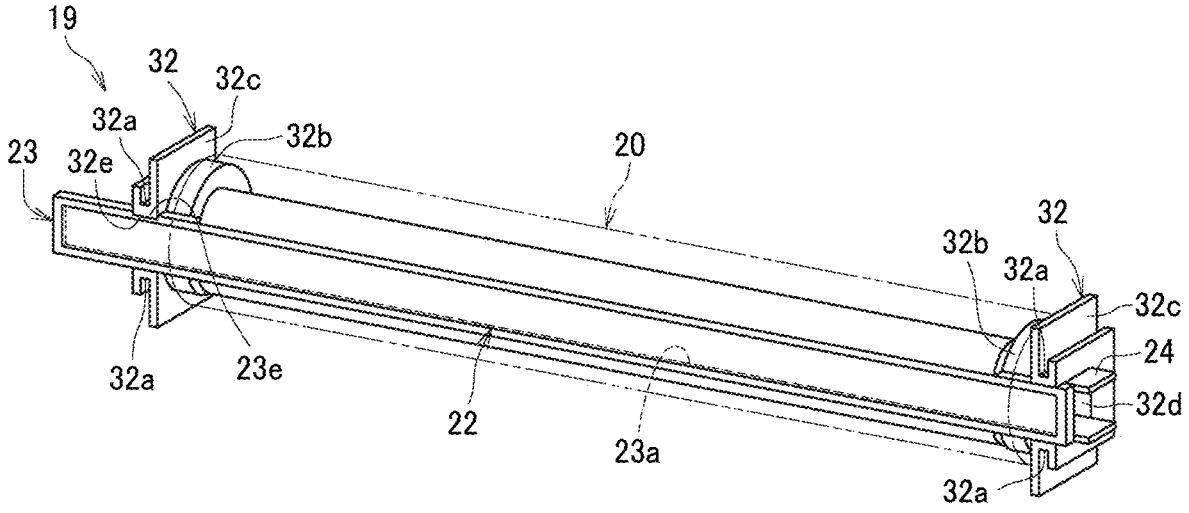
FIG. 5 is a perspective view of a heating device incorporated in the fixing device depicted in FIG. 2.
Figure 6:
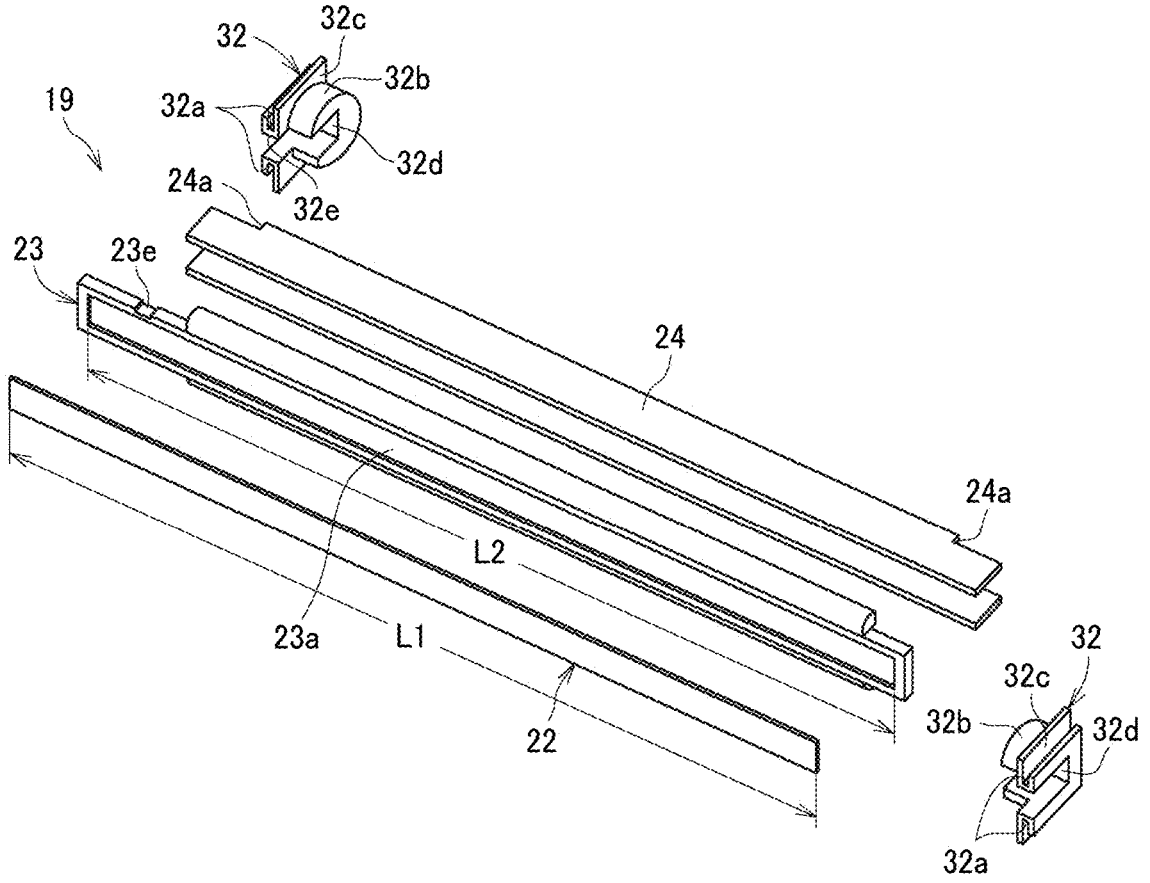
FIG. 6 is an exploded perspective view of the heating device depicted in FIG. 5.

FIG. 5 is a perspective view of the heating device 19. FIG. 6 is an exploded perspective view of the heating device 19.

As illustrated in FIGS. 5 and 6, the heater holder 23 includes an accommodating recess 23*a* disposed on a fixing belt side face (e.g., a front face in FIGS. 5 and 6) of the heater holder 23, that faces the fixing belt 20. The accommodating recess 23*a* is rectangular and accommodates the heater 22. The accommodating recess 23*a* has a shape and a size that are substantially equivalent to those of the heater 22. However, a length L2 of the accommodating recess 23*a* in a longitudinal direction thereof is somewhat greater than a length L1 of the heater 22 in the longitudinal direction thereof. Since the accommodating recess 23*a* is somewhat greater than the heater 22 in the longitudinal direction thereof, even if the heater 22 is elongated in the longitudinal direction thereof due to thermal expansion, the heater 22 does not interfere with the accommodating recess 23*a*. A connector sandwiches the heater 22 and the heater holder 23 in a state in which the accommodating recess 23*a* accommodates the heater 22, thus holding the heater 22. The connector serves as a feeding member described below that supplies power to the heater 22.

Each of the pair of supports 32 includes a belt support 32*b*, a belt restrictor 32*c*, and a supporting recess 32*d*. The belt support 32*b* is C-shaped and inserted into the loop formed by the fixing belt 20 at each lateral end of the fixing belt 20 in the longitudinal direction thereof. Accordingly, each of the belt supports 32*b* supports the fixing belt 20 by a so-called free belt system in which the fixing belt 20 is not basically applied with tension while the fixing belt 20 does not rotate. Conversely, each of the belt restrictors 32*c* is a flange that is not inserted into the loop formed by the fixing belt 20 and is disposed opposite each lateral end of the fixing belt 20 in the longitudinal direction thereof. Accordingly, even if the fixing belt 20 moves toward one lateral end of the fixing belt 20 in the longitudinal direction thereof, the one lateral end of the fixing belt 20 in the longitudinal direction thereof comes into contact with the belt restrictor 32*c* that restricts motion (e.g., skew) of the fixing belt 20 in the longitudinal direction thereof. Each of the supporting recesses 32*d* is inserted with a lateral end and a vicinity thereof of each of the heater holder 23 and the stay 24 in the longitudinal direction thereof. Thus, the pair of supports 32 supports the heater holder 23 and the stay 24.

As illustrated in FIGS. 5 and 6, the heater holder 23 includes a positioning recess 23*e*, serving as a positioner, disposed at one lateral end of the heater holder 23 in the longitudinal direction thereof. The support 32 includes an engagement 32*e* illustrated in a left part in FIGS. 5 and 6. The engagement 32*e* engages the positioning recess 23*e*, positioning the heater holder 23 with respect to the support 32 in the longitudinal direction of the fixing belt 20. Conversely, the support 32 illustrated in a right part in FIGS. 5 and 6 does not include the engagement 32*e*. Accordingly, the support 32 is not positioned with respect to the heater holder 23 in the longitudinal direction of the fixing belt 20 in the right part in FIGS. 5 and 6. As described above, the heater holder 23 is positioned with respect to the support 32 at one lateral end of the heater holder 23 in the longitudinal direction of the fixing belt 20, thus being allowed to expand and shrink thermally in the longitudinal direction of the fixing belt 20 due to temperature change.

As illustrated in FIG. 6, the stay 24 includes steps 24*a* disposed at both lateral ends of the stay 24 in the longitudinal direction thereof, respectively. As the step 24*a* comes into contact with the support 32, the step 24*a* restricts motion of the stay 24 with respect to the support 32 in the longitudinal direction of the stay 24. A gap (e.g., backlash) is provided between at least one of the steps 24*a* and the support 32. Thus, at least one of the steps 24*a* is arranged with the support 32 via the gap, allowing the stay 24 to expand and shrink thermally in the longitudinal direction of the fixing belt 20 due to temperature change.

Figure 7:
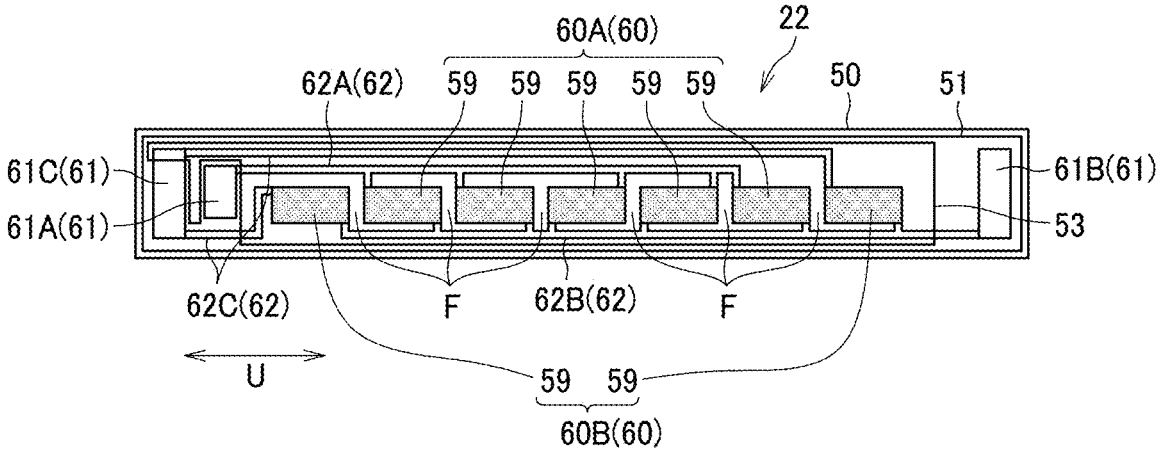
FIG. 7 is a plan view of a heater incorporated in the heating device depicted in FIG. 6.
Figure 8:
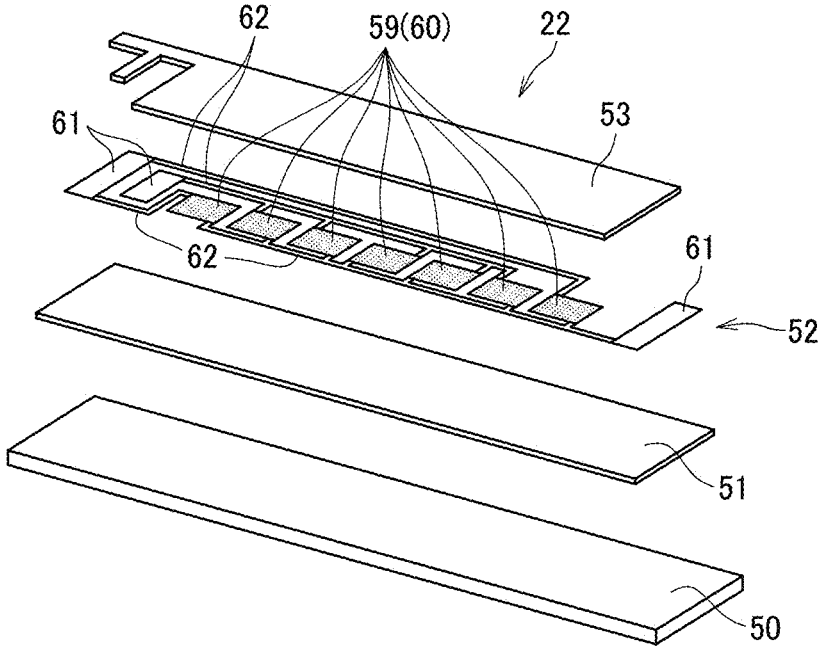
FIG. 8 is an exploded perspective view of the heater depicted in FIG. 7.

FIG. 7 is a plan view of the heater 22. FIG. 8 is an exploded perspective view of the heater 22.

As illustrated in FIG. 8, the heater 22 includes the base 50, the first insulating layer 51, the conductor layer 52, and the second insulating layer 53. The first insulating layer 51 is mounted on the base 50. The conductor layer 52 is mounted on the first insulating layer 51. The second insulating layer 53 is mounted on the conductor layer 52.

The base 50 is an elongated plate made of metal such as stainless steel (e.g., SUS stainless steel), iron, and aluminum. Instead of metal, the base 50 may be made of ceramic, glass, or the like. If the base 50 is made of an insulating material such as ceramic, the first insulating layer 51 sandwiched between the base 50 and the conductor layer 52 may be omitted. Since metal has an enhanced durability against rapid heating and is processed readily, metal is preferably used to reduce manufacturing costs. Among metals, aluminum and copper are preferable because aluminum and copper attain an increased thermal conductivity and barely suffer from uneven temperature. Stainless steel is advantageous because stainless steel allows the base 50 to be manufactured at reduced costs compared to aluminum and copper.

Each of the first insulating layer 51 and the second insulating layer 53 is made of an insulating material such as heat resistant glass. Alternatively, each of the first insulating layer 51 and the second insulating layer 53 may be made of ceramic, PI, or the like.

The conductor layer 52 includes the heat generating portion 60, a plurality of electrodes 61, and a plurality of feeders 62. The heat generating portion 60 includes a plurality of resistive heat generators 59. The feeders 62 electrically connect the electrodes 61 to the resistive heat generators 59.

The resistive heat generator 59 is made of a conductor having a resistance value greater than a resistance value of the feeder 62. For example, the resistive heat generator 59 is produced as below. Silver-palladium (AgPd), glass powder, and the like are mixed into paste. The paste coats the base 50 or the first insulating layer 51 by screen printing or the like. Thereafter, the base 50 is subject to firing. Alternatively, the resistive heat generator 59 may be made of a resistive material containing at least one of a silver alloy (AgPt) and ruthenium oxide ($RuO_2$).

The feeder 62 is made of a conductor having a resistance value smaller than a resistance value of the resistive heat generator 59. The feeder 62 and the electrode 61 are made of a material prepared with silver (Ag), silver-palladium (AgPd), or the like. The material coats the base 50 or the first insulating layer 51 by screen printing to form the feeder 62 and the electrode 61.

As illustrated in FIG. 7, the resistive heat generators 59 are aligned along a longitudinal direction U of the base 50 with a gap between adjacent ones of the resistive heat generators 59. Hence, an insulating region F (e.g., the second insulating layer 53) is interposed between the adjacent ones of the resistive heat generators 59. Each of the resistive heat generators 59 is electrically connected to two of the three electrodes 61. For example, according to this embodiment, the resistive heat generators 59, other than the resistive heat generators 59 disposed at both lateral ends of the base 50 in the longitudinal direction U thereof, respectively, are electrically connected in parallel to a first electrode 61A through a first feeder 62A serving as a first conductor. The first electrode 61A is disposed at one lateral end of the base 50 in the longitudinal direction U thereof. The resistive heat generators 59, other than the resistive heat generators 59 disposed at both lateral ends of the base 50 in the longitudinal direction U thereof, respectively, are electrically connected in parallel to a second electrode 619 through a second feeder 629 serving as a second conductor. The second electrode 61B is disposed at another lateral end of the base 50 in the longitudinal direction U thereof. Conversely, the resistive heat generators 59, disposed at both lateral ends of the base 50 in the longitudinal direction U thereof, respectively, are not electrically connected to the first electrode 61A but are electrically connected in parallel to a third electrode 61C through a third feeder 62C serving as a third conductor. The third electrode 61C is disposed at one lateral end of the base 50 in the longitudinal direction U thereof and is provided separately from the first electrode 61A. The resistive heat generators 59 disposed at both lateral ends of the base 50 in the longitudinal direction U thereof, respectively, like other resistive heat generators 59, are electrically connected in parallel to the second electrode 61B through the second feeder 62B.

According to this embodiment, since the resistive heat generators 59, the first electrode 61A, the second electrode 61B, and the third electrode 61C are connected as described above, a controller controls a first heat generating portion 60A and a second heat generating portion COB to generate heat separately from each other. The heat generating portion 60 includes the first heat generating portion 60A constructed of the resistive heat generators 59 other than the resistive heat generators 59 disposed at both lateral ends of the base 50 in the longitudinal direction U thereof, respectively, and the second heat generating portion 60B constructed of the resistive heat generators 59 disposed at both lateral ends of the base 50 in the longitudinal direction U thereof, respectively. For example, as a voltage is applied to the first electrode 61A and the second electrode 61B to generate an electric potential difference between the first electrode 61A and the second electrode 61B, an electric current flows to the resistive heat generators 59, other than the resistive heat generators 59 disposed at both lateral ends of the base 50 in the longitudinal direction U thereof, respectively. Thus, the first heat generating portion 60A generates heat. As a voltage is applied to the third electrode 61C and the second electrode 61B to generate an electric potential difference between the third electrode 61C and the second electrode 61B, an electric current flows to the resistive heat generators 59 disposed at both lateral ends of the base 50 in the longitudinal direction U thereof, respectively. Thus, the second heat generating portion 60B generates heat. If a voltage is applied to the first electrode 61A, the second electrode 61B, and the third electrode 61C, the resistive heat generators 59 of the first heat generating portion 60A and the second heat generating portion 60B generate heat. For example, when a small sheet having a width not greater than a width of 210 mm of an A4 size sheet is conveyed through the fixing device 9, the first heat generating portion 60A generates heat. When a large sheet having a width not smaller than a width of 297 mm of an A3 size sheet is conveyed through the fixing device 9, in addition to the first heat generating portion 60A, the second heat generating portion 60B also generates heat, thus achieving a plurality of heat generating regions corresponding to the widths of the small sheet and the large sheet, respectively.

Figure 9:
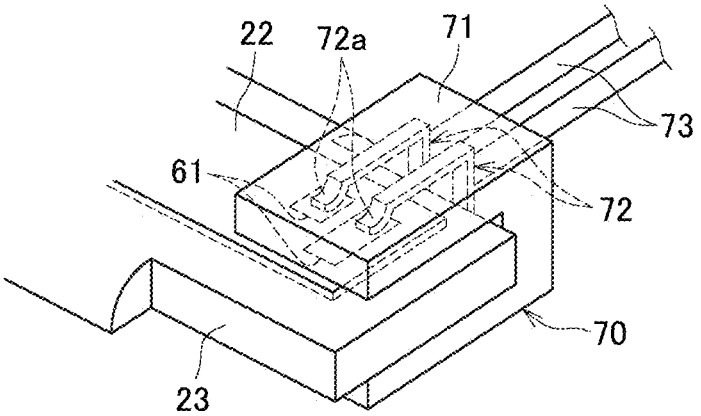
FIG. 9 is a perspective view of the heater depicted in FIG. 8 and a connector coupled thereto.

FIG. 9 is a perspective view of the heater 22 and a connector 70 coupled thereto.

As illustrated in FIG. 9, the connector 70 includes a housing 71 made of resin and a plurality of contact terminals 72. Each of the contact terminals 72 is a flat spring and is anchored to the housing 71. Each of the contact terminals 72 is coupled to a harness 73 that supplies power.

As illustrated in FIG. 9, the connector 70 is attached to the heater 22 and the heater holder 23 such that the connector 70 sandwiches the heater 22 and the heater holder 23 together at a front side and a back side of the heater holder 23. Each of the contact terminals 72 includes a contact 72*a* disposed at a tip of the contact terminal 72. In a state in which the connector 70 sandwiches the heater 22 and the heater holder 23, the contacts 72*a* resiliently contact and press against the corresponding electrodes 61, respectively. The heat generating portion 60 is electrically connected to a power supply disposed in the image forming apparatus 100 through the connector 70, allowing the power supply to supply power to the heat generating portion 60. Although FIG. 9 illustrates the connector 70 coupled to the electrodes 61 disposed at one lateral end of the heater 22 in the longitudinal direction thereof, another connector 70 is similarly coupled to the electrode 61 disposed at another lateral end of the heater 22 in the longitudinal direction thereof. As illustrated in FIG. 7, at least a part of each of the electrodes 61 is not coated with the second insulating layer 53 and is exposed so that each of the electrodes 61 is coupled to the connector 70.

A description is provided of a construction of a comparative fixing device.

The comparative fixing device includes a heater including a longitudinal substrate. The substrate mounts a resistive heat generator, an electrical contact, a conductor pattern that connects the electrical contact to the resistive heat generator, and the like.

With the heater in which the substrate mounts the resistive heat generator and the conductor pattern, when the resistive heat generator generates heat, as an electric current flows to the conductor pattern, the conductor pattern also generates heat slightly. Hence, heat generation from the conductor pattern affects a heat generation distribution of an entirety of the heater in a longitudinal direction thereof.

Accordingly, a heat generation distribution of the conductor pattern may cause an uneven temperature distribution of the heater. For example, in order to increase an amount of heat generated by the heater to increase an image forming speed of an image forming apparatus, an amount of an electric current flown to the resistive heat generator may increase. Accordingly, an amount of heat generated by the conductor pattern may also increase to a degree that affection of heat generation from the conductor pattern is not negligible. To address this circumstance, the comparative fixing device incorporating the heater is requested to set the temperature distribution of the heater in the longitudinal direction thereof.

Figure 10:
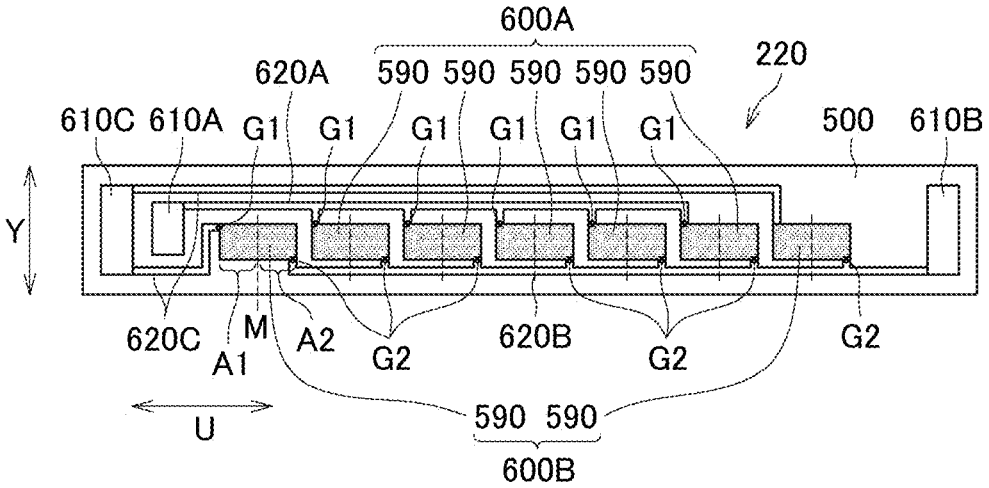
FIG. 10 is a plan view of a heater according to a comparative example.

Referring to FIG. 10, a description is provided of uneven temperature, that is, a temperature distribution deviation, which occurs in a heater 220 according to a comparative example.

Like the heater 22 according to the embodiment described above, the heater 220 according to the comparative example illustrated in FIG. 10 includes a plurality of resistive heat generators 590, three electrodes (e.g., a first electrode 610A, a second electrode 610B, and a third electrode 610C), and three feeders (e.g., a first feeder 620A, a second feeder 620B, and a third feeder 620C). A base 500 that is elongated mounts the resistive heat generators 590, the first electrode 610A, the second electrode 610B, the third electrode 610C, the first feeder 620A, the second feeder 6209, and the third feeder 620C. The first electrode 610A, the second electrode 610B, and the third electrode 610C are electrically connected to the resistive heat generators 590 through the first feeder 620A, the second feeder 620B, and the third feeder 620C. FIG. 10 omits illustration of a first insulating layer interposed between the base 500 and the resistive heat generators 590 and a second insulating layer coating the resistive heat generators 590. Connection between the resistive heat generators 590, the first electrode 610A, the second electrode 610B, the third electrode 610C, the first feeder 620A, the second feeder 620B, and the third feeder 620C is basically similar to the above-described connection between the resistive heat generators 59, the first electrode 61A, the second electrode 61B, the third electrode 61C, the first feeder 62A, the second feeder 62B, and the third feeder 62C of the heater 22 according to the embodiment described above. Accordingly, the heater 220 according to the comparative example includes a first heat generating portion 600A constructed of the resistive heat generators 590 other than the resistive heat generators 590 disposed at both lateral ends of the base 500 in the longitudinal direction U thereof and a second heat generating portion 600B constructed of the resistive heat generators 590 disposed at both lateral ends of the base 500 in the longitudinal direction U thereof. A controller controls the first heat generating portion 600A and the second heat generating portion 600B separately from each other to generate heat. Differences between the heater 220 according to the comparative example and the heater 22 according to the embodiments of the present disclosure are described below.

In the heater 220 according to the comparative example, when the resistive heal generators 590 generate heat, as an electric current flows to the first feeder 620A, the second feeder 620B, and the third feeder 620C, the first feeder 620A, the second feeder 620B, and the third feeder 620C also generate heat slightly. Accordingly, a heat generation distribution of the first feeder 620A, the second feeder 620B, and the third feeder 620C may affect a temperature distribution of the heater 220, causing an uneven temperature distribution of the heater 220. For example, in order to increase an amount of heat generated by the heater 220 to increase an image forming speed of an image forming apparatus incorporating the heater 220, an amount of an electric current flown to the resistive heat generators 590 may increase. Accordingly, an amount of heat generated by the first feeder 620A, the second feeder 620B, and the third feeder 620C may also increase to a degree that affection of heat generation from the first feeder 620A, the second feeder 620B, and the third feeder 620C is not negligible.

Figure 11:
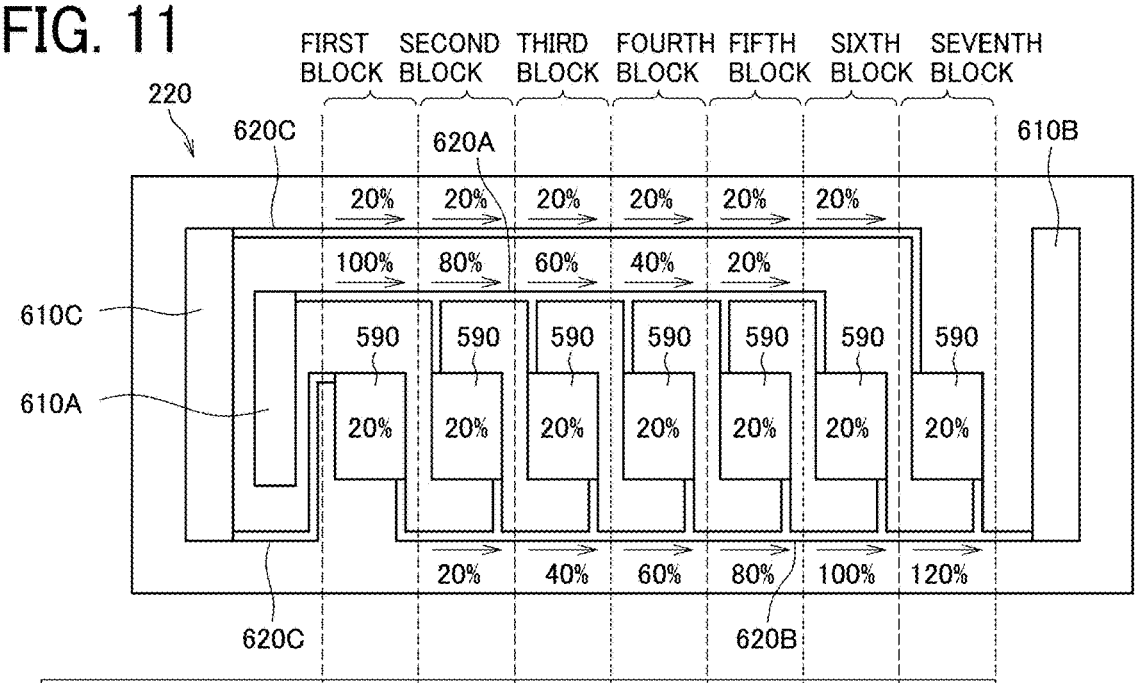
FIG. 11 is a diagram of the heater according to the comparative example depicted in FIG. 10, illustrating a heat generation amount of a first feeder, a second feeder, and a third feeder in each block when resistive heat generators generate heat collectively.
Figure 11:
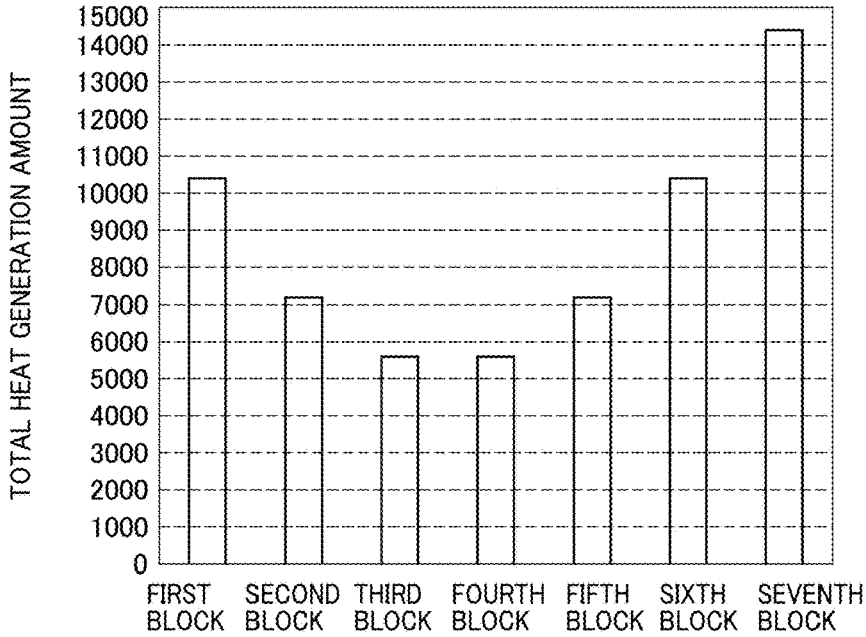

Referring to FIG. 11, a description is provided of heat generation from the first feeder 620A, the second feeder 620B, and the third feeder 620C when the heater 220 according to the comparative example generates heat.

FIG. 11 illustrates a heat generation amount of heat generated by each of the first feeder 620A, the second feeder 620B, and the third feeder 620C and a total heat generation amount thereof in each of a first block, a second block, a third block, a fourth block, a fifth block, a sixth block, and a seventh block defined by the resistive heat generators 590, respectively, when an electric current of 20% is flown to each of the resistive heat generators 590. As illustrated in FIG. 10, a short direction Y perpendicular to the longitudinal direction U of the base 500 extends along a mounting face of the base 500, that mounts the resistive heat generators 590. Each of the first feeder 620A, the second feeder 620B, and the third feeder 620C extends in a short length in the short direction Y of the base 500, generating heat in a decreased amount in the short length. Thus, the decreased amount in the short length is neglected. Hence, a heat generation amount of heat generated in a long length of each of the first feeder 620A, the second feeder 620B, and the third feeder 620C in the longitudinal direction U of the base 500 is calculated. A heat generation amount W is calculated by a following formula (1). Hence, the heat generation amount indicated in a table in FIG. 11 is conveniently calculated by squaring an electric current I flown in each of the first feeder 620A, the second feeder 620B, and the third feeder 620C. Accordingly, a calculated value of the heat generation amount is a value calculated simply and is different from an actual heat generation amount.

Formula (1):

$$W=R\times I^2 \quad (1)$$

In the formula (1), R represents a resistance.

A description is provided of a calculation method for calculating the heat generation amount by taking the first block and the second block in FIG. 11 as an example. For example, in the first block in FIG. 11, an electric current of 100% flows in the first feeder 620A and an electric current of 20% flows in the third feeder 620C. Hence, a total heat generation amount of the first feeder 620A, the second feeder 620B, and the third feeder 620C in the first block is a total value of 10400 which is calculated by adding a square value of 400 of the electric current flown in the third feeder 620C to a square value of 10000 of the electric current flown in the first feeder 620A. In the second block in FIG. 11, an electric current of 80% flows in the first feeder 620A. An electric current of 20% flows in the second feeder 620B. An electric current of 20% flows in the third feeder 620C. Hence, a total heat generation amount of the first feeder 620A, the second feeder 620B, and the third feeder 620C in the second block is a total value of 7200 which is calculated by summing of a square value of 6400 of the electric current flown in the first feeder 620A, a square value of 400 of the electric current flown in the second feeder 620B, and a square value of 400 of the electric current flown in the third feeder 620C. The heat generation amount is calculated similarly also in other blocks.

A graph in FIG. 11 illustrates the total heat generation amount in each block on a vertical axis. As illustrated in the graph, the total heat generation amount of the first feeder 620A, the second feeder 620B, and the third feeder 620C is greater in blocks situated at both lateral ends of the heater 220 in a longitudinal direction thereof than in blocks situated at a center of the heater 220 in the longitudinal direction thereof, causing an uneven heat generation distribution of the first feeder 620A, the second feeder 620B, and the third feeder 620C. Accordingly, the uneven heat generation distribution of the first feeder 620A, the second feeder 620B, and the third feeder 620C may cause an uneven heat generation distribution of the heater 220. Consequently, a toner image fixed on a sheet may suffer from uneven gloss and degradation in quality.

Uneven temperature of the heater 220 caused by heat generation of the first feeder 620A, the second feeder 620B, and the third feeder 620C is not limited to a case in which each of the resistive heat generators 590, that is, the seven resistive heat generators 590, generates heat as illustrated in FIG. 11 and may also occur in a case in which a part of the resistive heat generators 590, that is, one to six of the resistive heat generators 590, generates heat. For example, as the heater 220 is downsized or the image forming apparatus incorporating the heater 220 forms a toner image at high speed, an unintentional shunt may generate in the first feeder 620A, the second feeder 620B, and the third feeder 620C. In this case, uneven temperature may be noticeable. The unintentional shunt may generate easily if a width of the first feeder 620A, the second feeder 620B, and the third feeder 620C decreases in the short direction Y of the heater 220 to downsize the heater 220 in the short direction Y thereof and therefore the resistance value of the first feeder 620A, the second feeder 620B, and the third feeder 620C increases. The unintentional shunt may also generate easily if the resistance value of the resistive heat generators 590 decreases to increase the heat generation amount of the resistive heat generators 590 so as to increase the image forming speed of the image forming apparatus.

For example, if the resistance value of the first feeder 620A, the second feeder 620B, and the third feeder 620C and the resistance value of the resistive heat generators 590 come close to each other relatively, when the resistance value of the first feeder 620A, the second feeder 620B, and the third feeder 620C increases, when the resistance value of the resistive heat generators 590 decreases, or when both occur, a path where an electric current has not been flown may also be flown with the electric current. That is, the unintentional shunt may generate.

Figure 12:
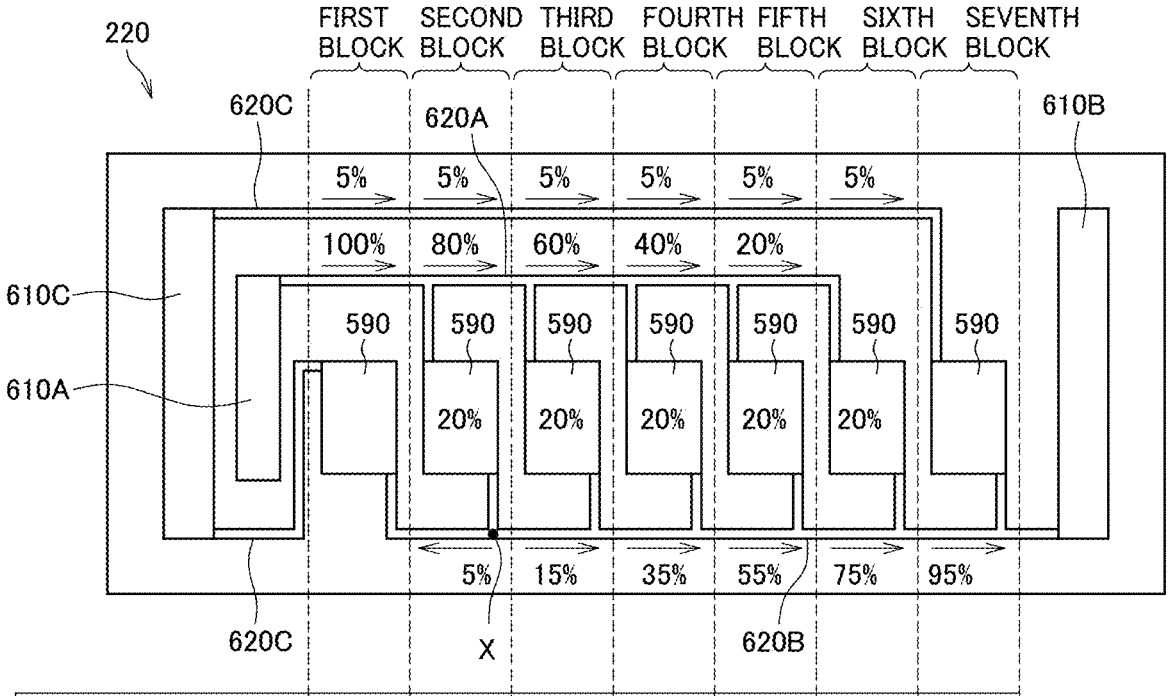
FIG. 12 is a diagram of the heater according to the comparative example depicted in FIG. 10, illustrating the heat generation amount of the first feeder, the second feeder, and the third feeder in each block when a part of the resistive heat generators generates heat and an unintentional shunt generates.
Figure 12:
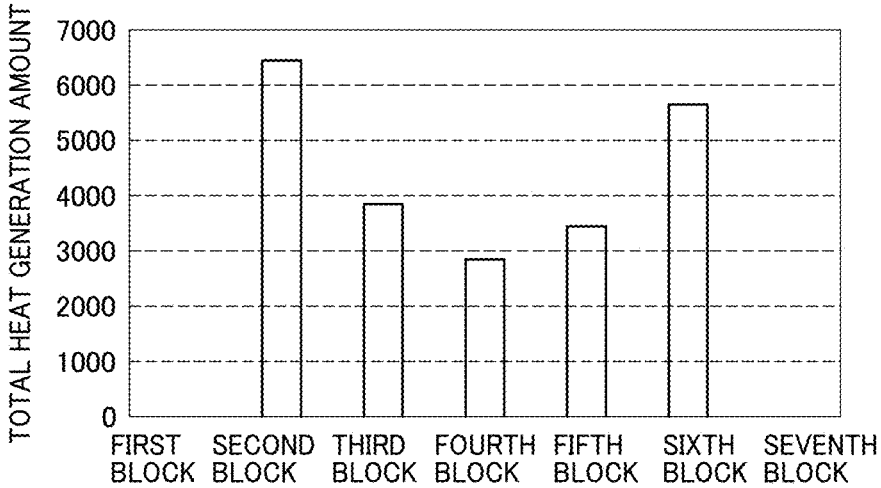

For example, FIG. 12 illustrates an example in which the unintentional shunt generates in the heater 220 according to the comparative example in which the resistance value of the first feeder 620A, the second feeder 620B, and the third feeder 620C and the resistance value of the resistive heat generators 590 come close to each other relatively. In this example, as illustrated in FIG. 12, an electric current of 20% flows to each of the resistive heat generators 590 of the first heat generating portion 600A depicted in FIG. 10. However, a part (5%) of the electric current that has passed through the second, resistive heat generator 590 from the left in FIG. 12, at a branch X of the second feeder 620B situated beyond the second, resistive heat generator 590, is shunted leftward in FIG. 12 toward a lateral end of the heater 220, that is opposite another lateral end of the heater 220 where the second electrode 610B is situated, thus generating a shunted electric current. A part of the shunted electric current passes through the leftmost, resistive heat generator 590 in FIG. 12 and reaches the third electrode 610C. A part of the shunted electric current passes through the third feeder 620C and reaches the rightmost, resistive heat generator 590 in FIG. 12. Thereafter, the shunted electric current enters the second feeder 620B.

A table and a graph in FIG. 12 illustrate the heat generation amount and the total heat generation amount obtained by each of the first feeder 620A, the second feeder 620B, and the third feeder 620C in each block when the unintentional shunt generates. In an example illustrated in FIG. 12, if an electric current of 20% flows in each of the resistive heat generators 590 of the first heat generating portion 600A depicted in FIG. 10 evenly, when a part of the electric current is shunted by 5% at the branch X, the heat generation amount of each of the first feeder 620A, the second feeder 620B, and the third feeder 620C is calculated for each of the second block, the third block, the fourth block, the fifth block, and the sixth block where heat generates. The example illustrated in FIG. 12 employs the calculation method for calculating the heat generation amount employed by the example illustrated in FIG. 11.

As illustrated in the table and the graph in FIG. 12, also in the example illustrated in FIG. 12, the total heat generation amount of the first feeder 620A, the second feeder 620B, and the third feeder 620C is greater in the blocks situated at both lateral ends of the heater 220 in the longitudinal direction thereof than in the blocks situated at the center of the heater 220 in the longitudinal direction thereof, causing an uneven heat generation distribution of the first feeder 620A, the second feeder 620B, and the third feeder 620C. Accordingly, unevenness of the total heat generation amount of the first feeder 620A, the second feeder 620B, and the third feeder 620C may cause an uneven temperature distribution of the heater 220. Consequently, a toner image fixed on a sheet may suffer from uneven gloss and degradation in quality.

To address this circumstance, according to the embodiments of the present disclosure, in order to suppress the above-described uneven temperature of the heater 220 in the longitudinal direction thereof, solutions described below are employed.

Figure 13:
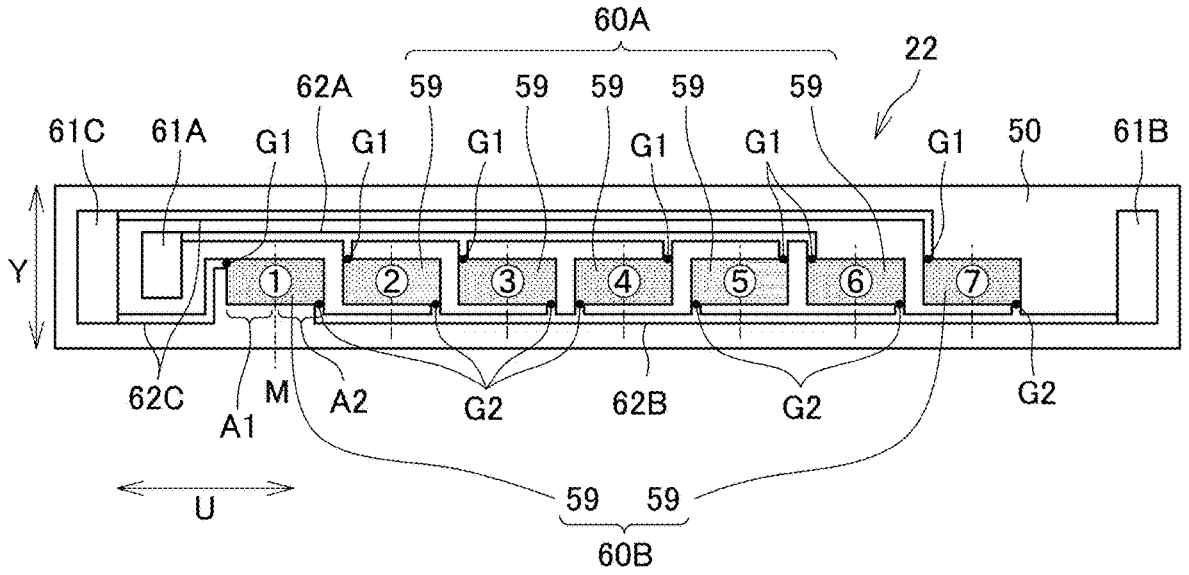
FIG. 13 is a plan view of the heater according to a first embodiment of the present disclosure depicted in FIG. 7.

FIG. 13 is a plan view of the heater 22 according to a first embodiment of the present disclosure, which has the construction described above.

The heater 22 illustrated in FIG. 13 is different from the heater 220 according to the comparative example illustrated in FIG. 10 in connecting positions of the first feeder 62A, the second feeder 62B, and the third feeder 62C with respect to a part of the resistive heat generators 59. As illustrated in FIGS. 10 and 13, a plurality of connectors, that connects the first feeder 62A or 6204, the second feeder 62B or 620B, and the third feeder 62C or 620C to the resistive heat generators 59 or 590, includes primary connectors G1 and secondary connectors G2. Each of the primary connectors G1, serving as a primary connector, connects a primary feeder disposed at one end side of the base 50 or 500 in the short direction Y thereof to the resistive heat generator 59 or 590. Each of the secondary connectors G2, serving as a secondary connector, connects a secondary feeder disposed at another end side of the base 50 or 500 in the short direction Y thereof to the resistive heat generator 59 or 590. The secondary feeder is disposed opposite the primary feeder via the resistive heat generator 59 or 590 in the short direction Y of the base 50 or 500. For example, the primary connectors G1 serve as the primary connectors that connect the first feeder 62A or 620A and the third feeder 62C or 620C to the resistive heat generators 59 or 590, respectively. The secondary connectors G2 serve as the secondary connectors that connect the second feeder 62B or 620B to the resistive heat generators 59 or 590, respectively. As illustrated in FIGS. 10 and 13, the third feeders 620C and 62C connected to the leftmost, resistive heat generators 590 and 59, respectively, unlike other feeders (e.g., the first feeders 620A and 62A and the second feeders 6209 and 62B), are extended and bent from one end (e.g., an upper end in FIGS. 10 and 13) to another end (e.g., a lower end in FIGS. 10 and 13) of the bases 500 and 50 in the short direction Y of the bases 500 and 50. However, the primary connector G1 coupled to the third feeder 62C or 620C and a vicinity of the primary connector G1 are disposed at one end (e.g., the upper end in FIGS. 10 and 13) of the base 50 or 500 in the short direction Y thereof, thus serving as a primary connector, like the primary connectors G1 coupled to other feeders, that is, the first feeder 62A or 620A and the third feeder 62C or 620C.

Alternatively, the primary connector and the secondary connector may be defined based on an electric current flowing direction of an electric current flown to the resistive heat generators 59 and 590. For example, the primary connector G1 disposed at an upstream side (e.g., one end) in the electric current flowing direction may serve as the primary connector. The secondary connector G2 disposed at a downstream side (e.g., another end) in the electric current flowing direction may serve as the secondary connector. The electric current flowing direction denotes a direction in which a normal electric current flows and does not connote a direction in which the unintentional shunt described above flows. If an electric current flown to the heaters 22 and 220 is an alternating current, the electric current flowing direction changes periodically. In this case, the electric current flowing direction denotes a direction (e.g., one direction) of an electric current, that is specified at an arbitrary time. That is, regardless of whether an electric current flown to the heaters 22 and 220 is a direct current or an alternating current, the primary connector (e.g., the primary connector G1) and the secondary connector (e.g., the secondary connector G2) have definitions to conveniently distinguish a connector disposed at one end from a connector disposed at another end in the direction of the electric current, that is specified at the arbitrary time. Thus, according to the embodiments of the present disclosure, the direction of the electric current is not limited to one direction.

As illustrated in FIGS. 10 and 13, a hypothetical center line M of each of the resistive heat generators 59 and 590 in the longitudinal direction U of the bases 50 and 500 divides each of the resistive heat generators 59 and 590 into a first section A1 and a second section A2. Accordingly, sections coupled to the primary connector G1 and the secondary connector G2, respectively, of a part of the resistive heat generators 59 and 590 are different between the heater 22 according to the first embodiment of the present disclosure and the heater 220 according to the comparative example as described below.

For example, in the heater 220 according to the comparative example depicted in FIG. 10, the primary connector G1 is coupled to the first section A1, that is, a left section in FIG. 10, of each of the resistive heat generators 590. The secondary connector G2 is coupled to the second section A2, that is, a right section in FIG. 10, of each of the resistive heat generators 590.

Conversely, in the heater 22 according to the first embodiment of the present disclosure depicted in FIG. 13, the sections coupled to the primary connector G1 and the secondary connector G2, respectively, of the resistive heat generator 59 are different between a part of the resistive heat generators 59 and other resistive heat generators 59. For example, the sections coupled to the primary connector G1 and the secondary connector G2, respectively, of the resistive heat generator 59 are different between the fourth, resistive heat generator 59 and the fifth, resistive heat generator 59 from the left in FIG. 13, and other resistive heat generators 59. That is, the sections coupled to the primary connector G1 and the secondary connector G2, respectively, of the fourth, resistive heat generator 59 and the fifth, resistive heat generator 59 from the left in FIG. 13 are symmetric to those of other resistive heat generators 59. For example, the primary connector G1 is coupled to the second section A2 of each of the fourth, resistive heat generator 59 and the fifth, resistive heat generator 59. The secondary connector G2 is coupled to the first section A1 of each of the fourth, resistive heat generator 59 and the fifth, resistive heat generator 59. Conversely, the primary connector G1 is coupled to the first section A1 of each of other resistive heat generators 59. The secondary connector G2 is coupled to the second section A2 of each of other resistive heat generators 59.

As described above, according to the first embodiment of the present disclosure, the sections coupled to the primary connector G1 and the secondary connector G2, respectively, of the resistive heat generator 59 are different between a part of the resistive heat generators 59 and other resistive heat generators 59, thus adjusting the heat generation distribution of the first feeder 62A, the second feeder 62B, and the third feeder 62C in each block.

Figure 14:
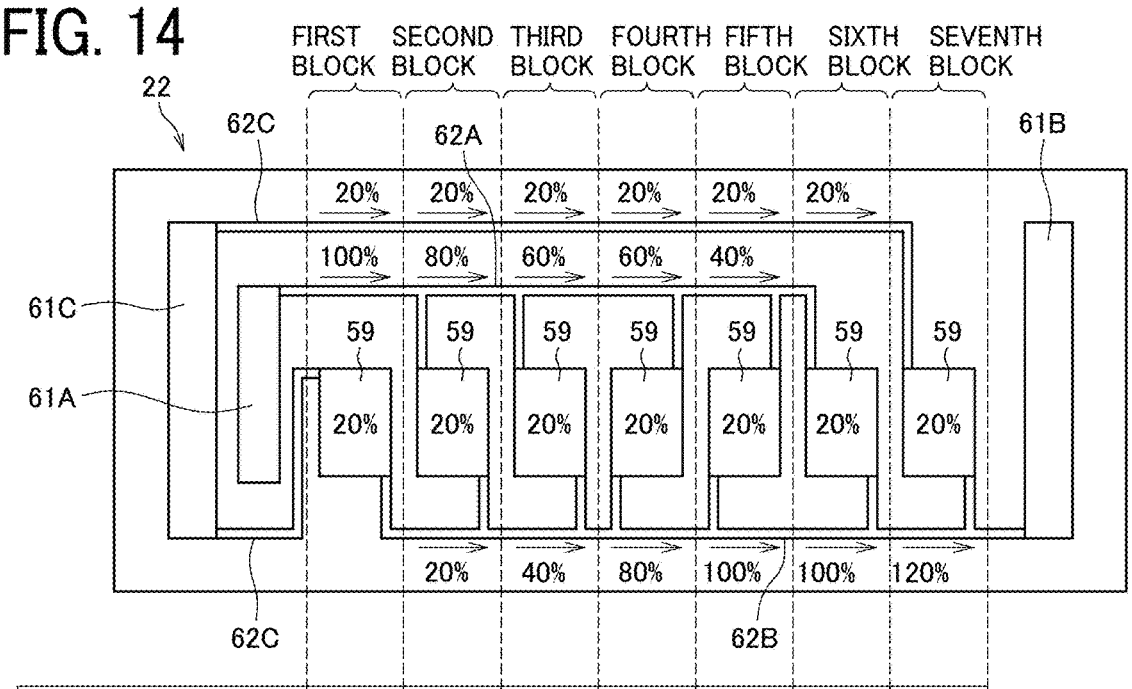
FIG. 14 is a diagram of the heater according to the first embodiment depicted in FIG. 13, illustrating the heat generation amount of the first feeder, the second feeder, and the third feeder in each block when the resistive heat generators generate heat collectively.
Figure 14:
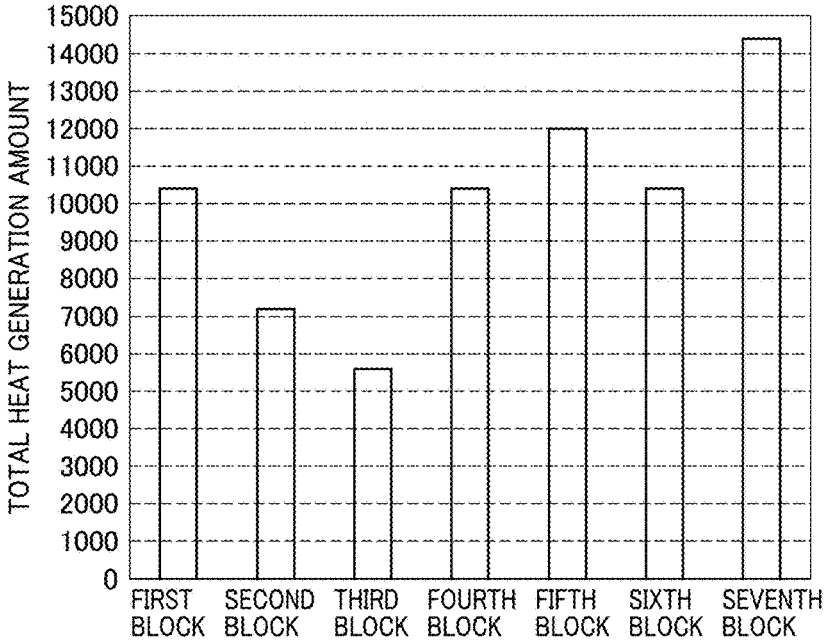
Figure 15:
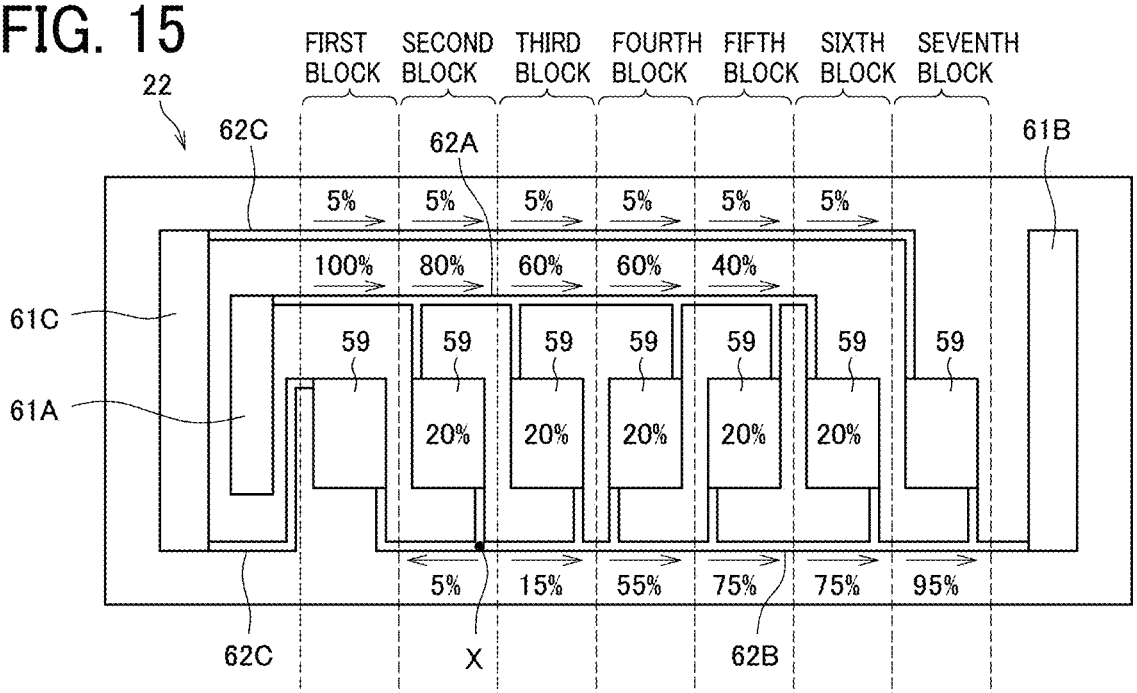
FIG. 15 is a diagram of the heater according to the first embodiment depicted in FIG. 13, illustrating the heat generation amount of the first feeder, the second feeder, and the third feeder in each block when a part of the resistive heat generators generates heat and the unintentional shunt generates.
Figure 15:
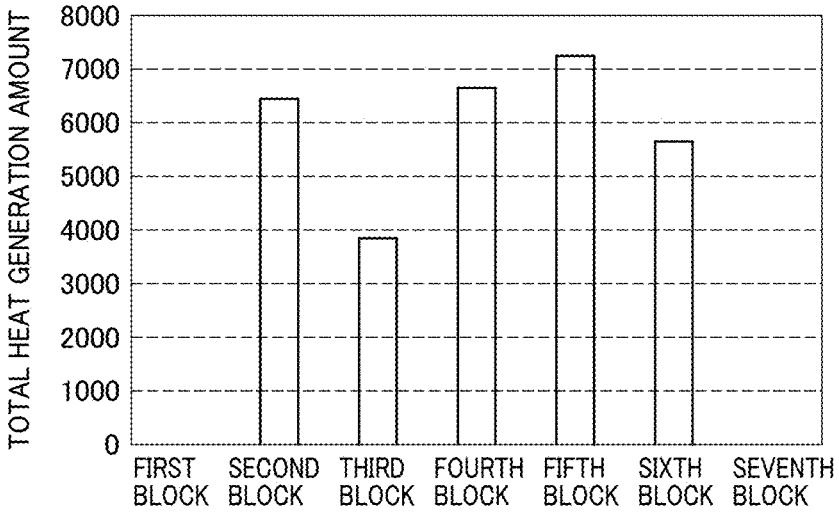

FIGS. 14 and 15 illustrate the heat generation amount of the first feeder 62A, the second feeder 62B, and the third feeder 62C of the heater 22 according to the first embodiment of the present disclosure. FIG. 14 illustrates the heat generation amount of the first feeder 62A, the second feeder 62B, and the third feeder 62C in each block when each of the resistive heat generators 59 generates heat. FIG. 15 illustrates the heat generation amount of the first feeder 62A, the second feeder 62B, and the third feeder 62C in each block when the first heat generating portion 60A depicted in FIG. 13 generates heat and the unintentional shunt generates. Conditions of the electric current flown in each of the first feeder 62A, the second feeder 62B, and the third feeder 62C and a calculation method for calculating the heat generation amount are equivalent to those employed by the example described above.

Figure 16:
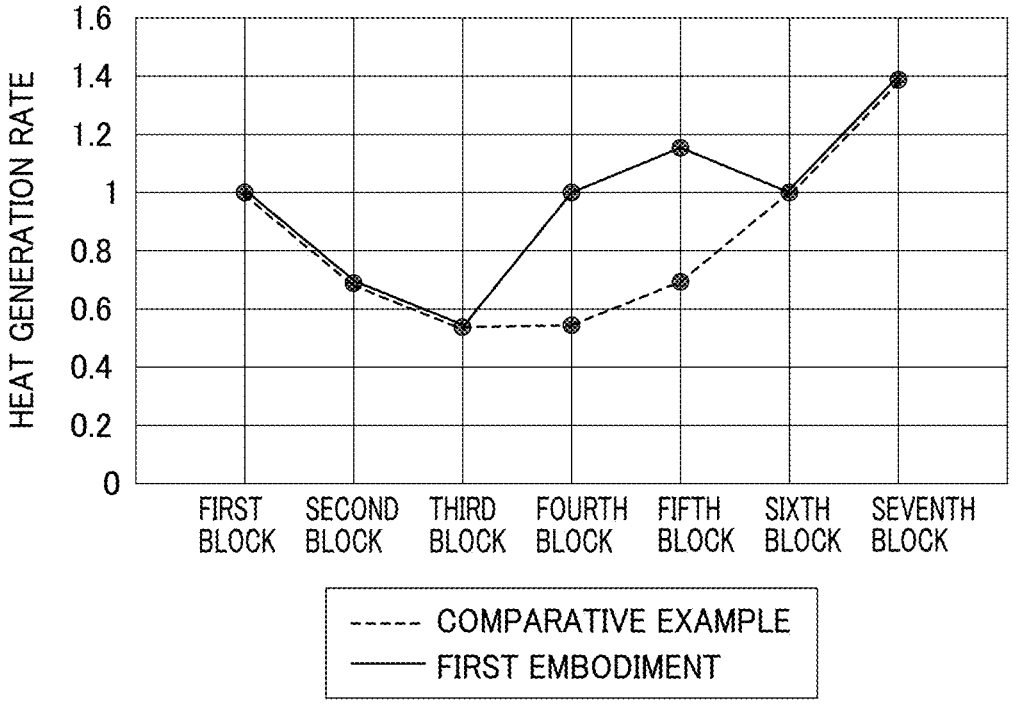
FIG. 16 is a graph illustrating comparison in a heat generation distribution between the heater according to the comparative example depicted in FIG. 10 and the heater according to the first embodiment depicted in FIG. 13 when the resistive heat generators generate heat collectively.
Figure 17:
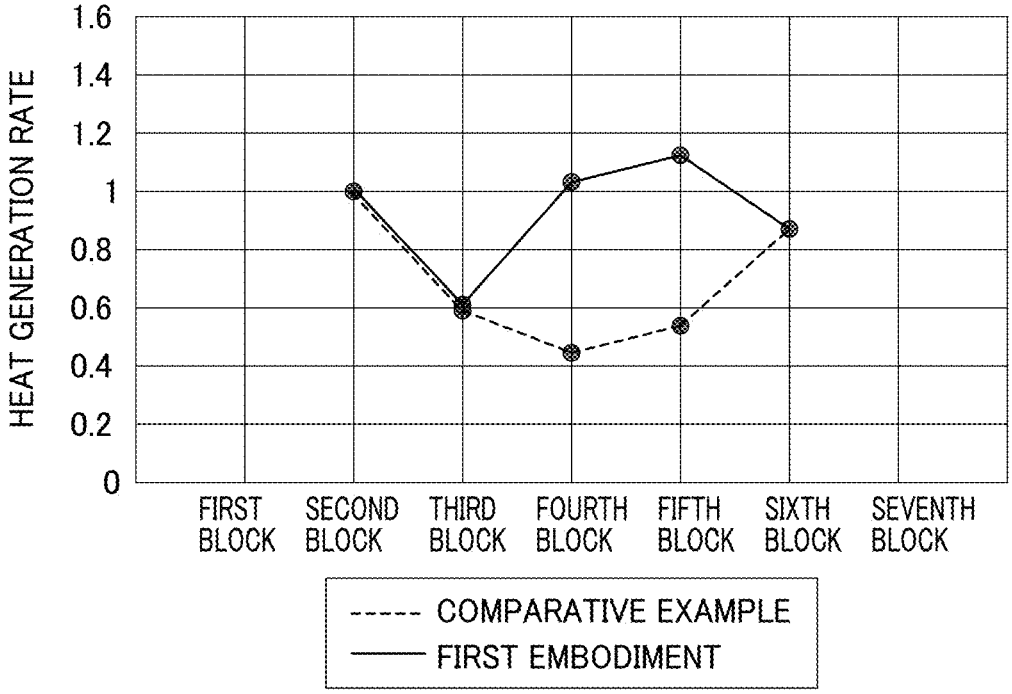
FIG. 17 is a graph illustrating comparison in the heat generation distribution between the heater according to the comparative example depicted in FIG. 10 and the heater according to the first embodiment depicted in FIG. 13 when a part of the resistive heat generators generates heat and the unintentional shunt generates.

FIGS. 16 and 17 illustrate graphs, respectively, that compare a heat generation distribution of the heater 22 according to the first embodiment of the present disclosure with a heat generation distribution of the heater 220 according to the comparative example. FIG. 16 illustrates the heat generation distribution when the resistive heat generators 59 and 590 generate heat collectively. FIG. 17 illustrates the heat generation distribution when the first heat generating portions 60A and 600A depicted in FIGS. 13 and 10, respectively, generate heat and the unintentional shunt generates. In FIGS. 16 and 17, a dotted line represents the heat generation distribution of the first feeder 620A, the second feeder 620B, and the third feeder 620C of the heater 220 according to the comparative example. A solid line represents the heat generation distribution of the first feeder 62A, the second feeder 62B, and the third feeder 62C of the heater 22 according to the first embodiment of the present disclosure. In FIGS. 16 and 17, the total heat generation amount of the first feeder 620A, the second feeder 620B, and the third feeder 620C in the first block of the heater 220 according to the comparative example defines "1" as a reference. Based on the reference, the total heat generation amounts in other blocks, respectively, are indicated.

As illustrated in FIGS. 16 and 17, the heat generation amount of the heater 22 according to the first embodiment of the present disclosure increases substantially compared to the heat generation amount of the heater 220 according to the comparative example, for example, in the fourth block and the fifth block that are situated in a center of the heater 22 in the longitudinal direction thereof. As a result, compared to the heater 220 according to the comparative example, the heater 22 according to the first embodiment of the present disclosure decreases a difference between a highest, total heat generation amount in one block and a lowest, total heat generation amount in another block, thus suppressing uneven temperature.

As described above, in the heater 22 according to the first embodiment of the present disclosure, the sections coupled to the primary connector G1 and the secondary connector G2, respectively, of the resistive heat generator 59 are different between a part of the resistive heat generators 59 and other resistive heat generators 59, thus suppressing unevenness in the heat generation distribution of the first feeder 62A, the second feeder 62B, and the third feeder 62C. Accordingly, uneven temperature of the heater 22 or the fixing belt 20 in the longitudinal direction thereof is suppressed, preventing failures in image formation such as uneven gloss of a toner image on a sheet and retaining image quality.

A description is provided of embodiments that are different from the first embodiment described above of the present disclosure.

Hereinafter, the embodiments are described mainly of configurations that are different from those of the first embodiment described above. A description of other configurations that are common to the first embodiment described above is omitted.

Figure 18:
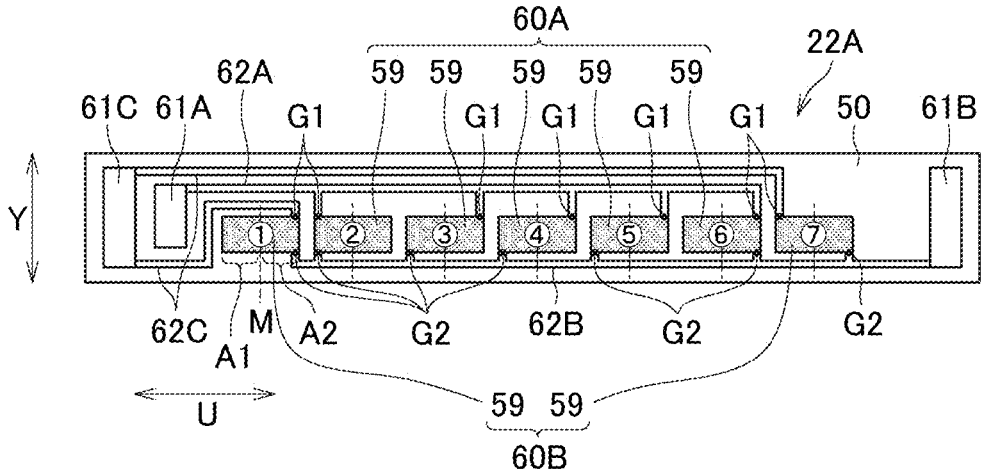
FIG. 18 is a plan view of a heater according to a second embodiment of the present disclosure, that is installable in the fixing device depicted in FIG. 2.

FIG. 18 is a plan view of a heater 22A according to a second embodiment of the present disclosure.

In the heater 22 according to the first embodiment depicted in FIG. 13 described above, in each of the resistive heat generators 59, the primary connector G1 and the secondary connector G2 are coupled to different sections (e.g., the first section A1 and the second section A2) of the resistive heat generator 59, respectively. Conversely, in the heater 22A according to the second embodiment depicted in FIG. 18, in a part of the resistive heat generators 59, the primary connector G1 and the secondary connector G2 are coupled to an identical section of the resistive heat generator 59. For example, as illustrated in FIG. 18 as one example, in the first, resistive heat generator 59 and the sixth, resistive heat generator 59 from the left in FIG. 18, the primary connector G1 and the secondary connector G2 are coupled to the second section A2, that is, a right section in FIG. 18, of each of the first, resistive heat generator 59 and the sixth, resistive heat generator 59. In the second, resistive heat generator 59 from the left in FIG. 18, the primary connector G1 and the secondary connector G2 are coupled to the first section A1, that is, a left section in FIG. 18, of the second, resistive heat generator 59. In the resistive heat generators 59 other than the first, resistive heat generator 59, the second, resistive heat generator 59, and the sixth, resistive heat generator 59, the primary connector G1 and the secondary connector G2 are coupled to different sections, that are opposite to each other, of the resistive heat generator 59, respectively.

Figure 19:
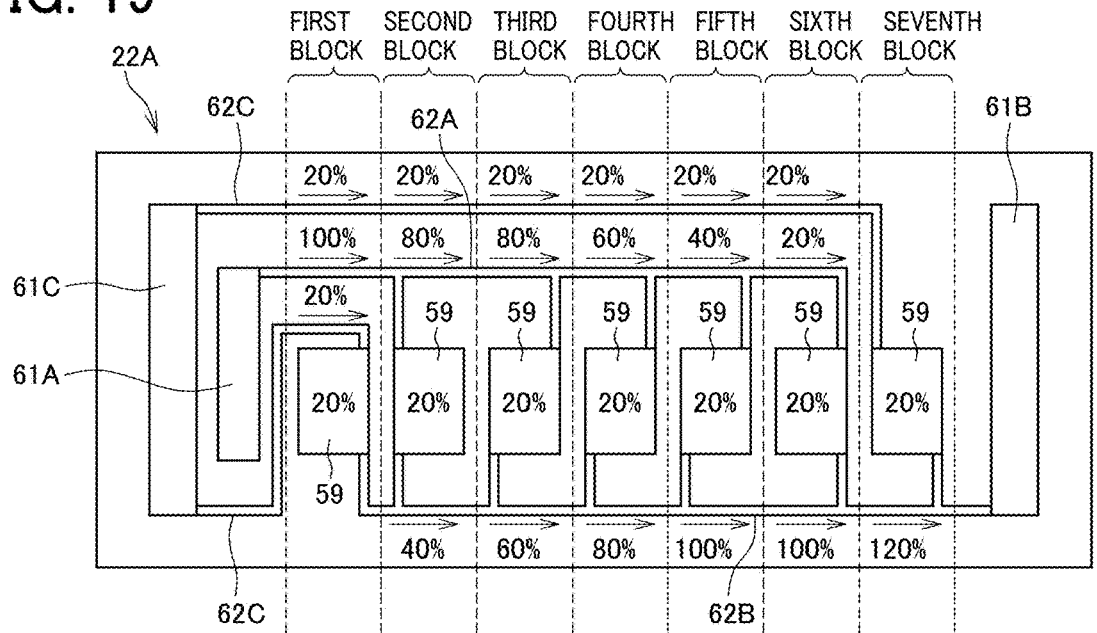
FIG. 19 is a diagram of the heater according to the second embodiment depicted in FIG. 18, illustrating the heat generation amount of the first feeder, the second feeder, and the third feeder in each block when the resistive heat generators generate heat collectively.
Figure 19:
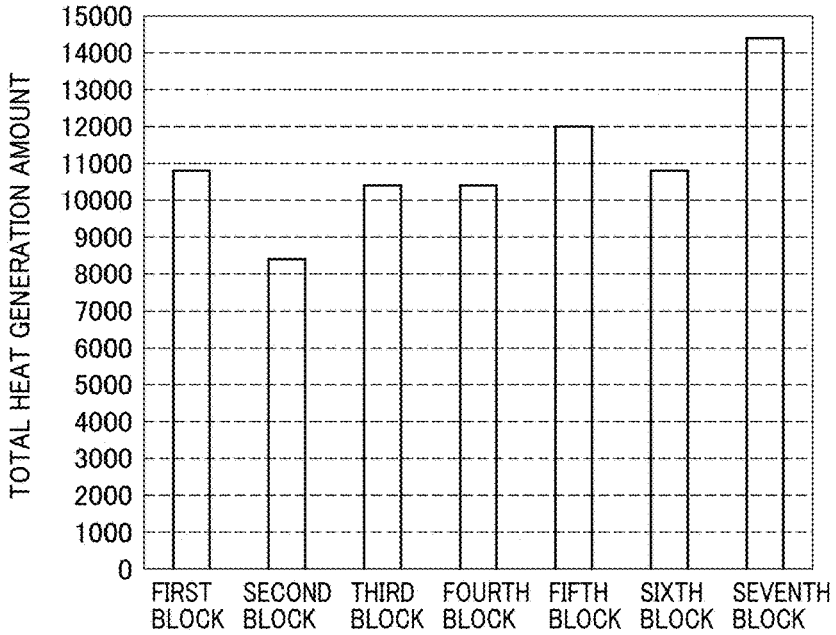
Figure 20:
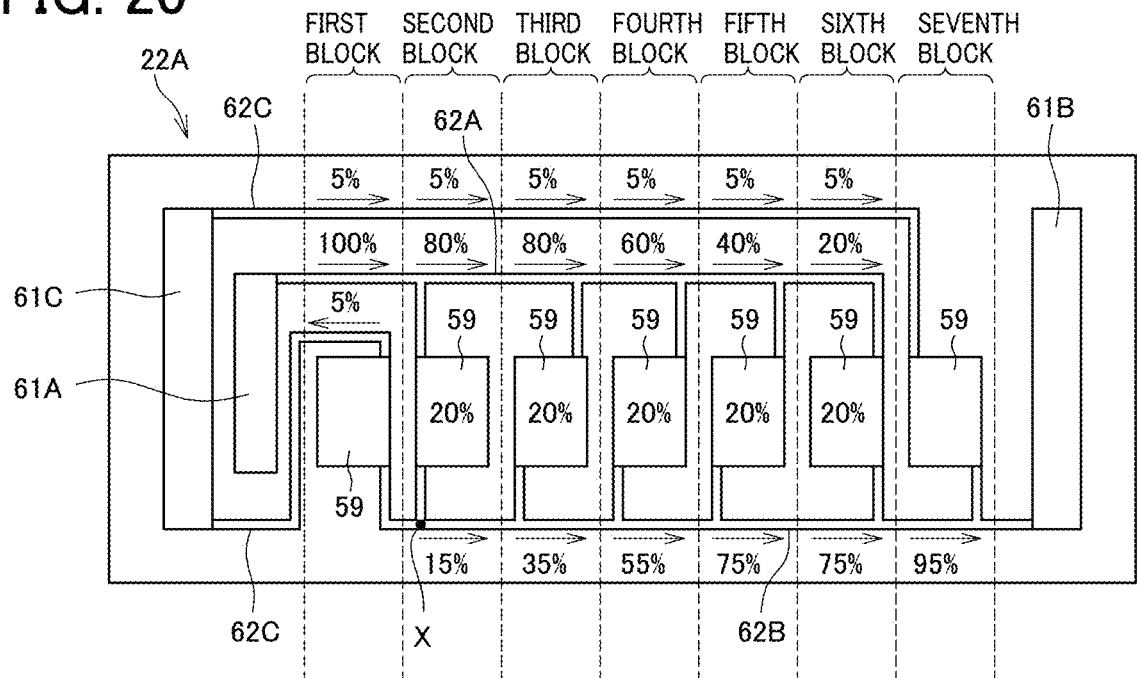
FIG. 20 is a diagram of the heater according to the second embodiment depicted in FIG. 18, illustrating the heat generation amount of the first feeder, the second feeder, and the third feeder in each block when a part of the resistive heat generators generates heat and the unintentional shunt generates.
Figure 20:
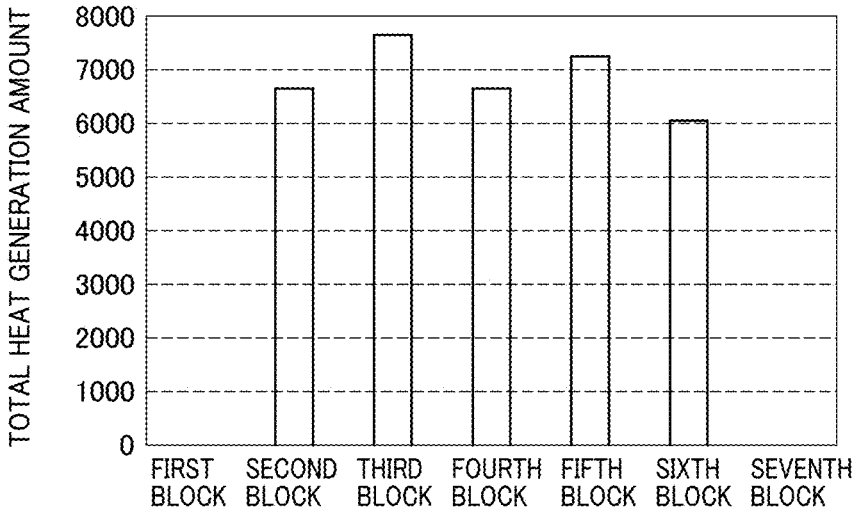

FIGS. 19 and 20 illustrate the heat generation distribution of the first feeder 62A, the second feeder 62B, and the third feeder 62C of the heater 22A according to the second embodiment of the present disclosure. FIG. 19 illustrates the heat generation amount of the first feeder 62A, the second feeder 62B, and the third feeder 62C in each block when the resistive heat generators 59 generate heat collectively. FIG. 20 illustrates the heat generation amount of the first feeder 62A, the second feeder 62B, and the third feeder 62C in each block when the first heat generating portion 60A depicted in FIG. 18 generates heat and the unintentional shunt generates. Conditions of the electric current flown in each of the first feeder 624, the second feeder 62B, and the third feeder 62C and a calculation method for calculating the heat generation amount are equivalent to those employed by the example described above.

Figure 21:
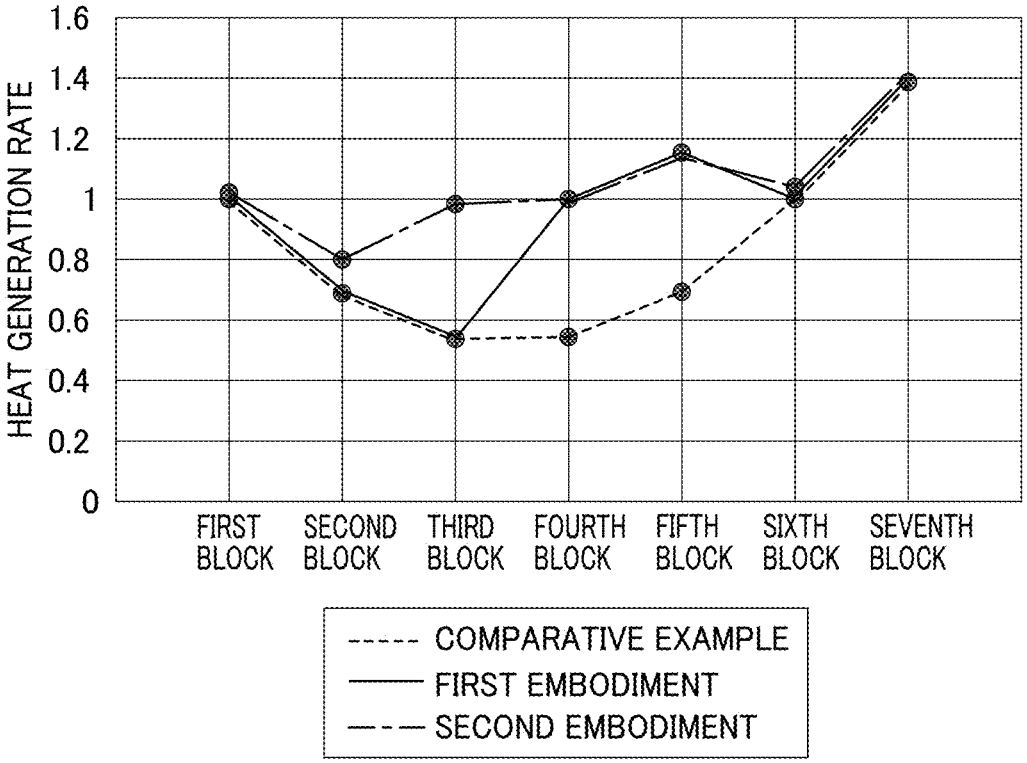
FIG. 21 is a graph illustrating comparison in the heat generation distribution between the heater according to the comparative example depicted in FIG. 10, the heater according to the first embodiment depicted in FIG. 13, and the heater according to the second embodiment depicted in FIG. 18 when the resistive heat generators generate heat collectively.
Figure 22:
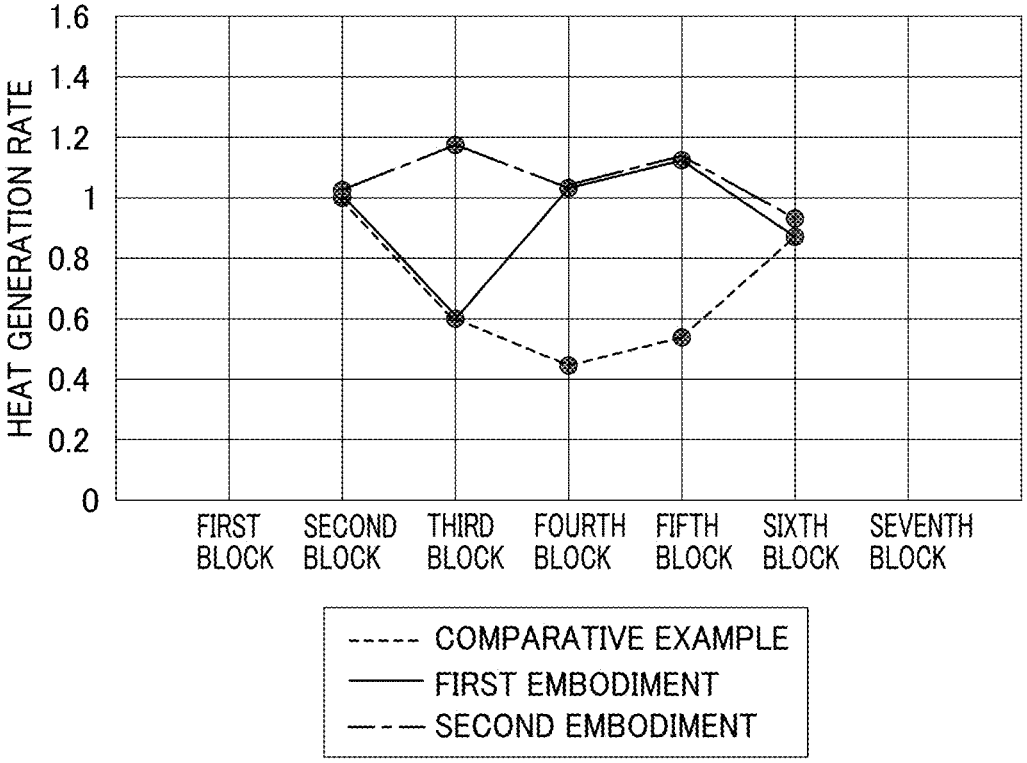
FIG. 22 is a graph illustrating comparison in the heat generation distribution between the heater according to the comparative example depicted in FIG. 10, the heater according to the first embodiment depicted in FIG. 13, and the heater according to the second embodiment depicted in FIG. 18 when a part of the resistive heat generators generates heat and the unintentional shunt generates.

FIGS. 21 and 22 illustrate the heat generation distribution of the first feeder 62A, the second feeder 62B, and the third feeder 62C of the heater 22A according to the second embodiment of the present disclosure in addition to the heat generation distribution of those of the heater 22 according to the first embodiment and the heat generation distribution of the first feeder 620A, the second feeder 620B, and the third feeder 620C of the heater 220 according to the comparative example for comparison. FIG. 21 illustrates the heat generation distribution when the resistive heat generators 59 and 590 generate heat collectively. FIG. 22 illustrates the heat generation distribution when the first heat generating portions 60A and 600A depicted in FIGS. 13, 18, and 10, respectively, generate heat and the unintentional shunt generates. In FIGS. 21 and 22, a dotted line represents the heat generation distribution of the first feeder 620A, the second feeder 620B, and the third feeder 620C of the heater 220 according to the comparative example. A solid line represents the heat generation distribution of the first feeder 62A, the second feeder 629, and the third feeder 62C of the heater 22 according to the first embodiment of the present disclosure. An alternate long and short dash line represents the heat generation distribution of the first feeder 62A, the second feeder 62B, and the third feeder 62C of the heater 22A according to the second embodiment of the present disclosure.

As illustrated in FIGS. 21 and 22, the heat generation amount of the heater 22A according to the second embodiment of the present disclosure, that is indicated with the alternate long and short dash line, increases substantially compared to the heat generation amount of the heater 22 according to the first embodiment, that is indicated with the solid line, further in the third block. Thus, the heater 22A according to the second embodiment of the present disclosure suppresses unevenness in a temperature distribution of the first feeder 62A, the second feeder 62B, and the third feeder 62C further, improving image quality.

Figure 23:
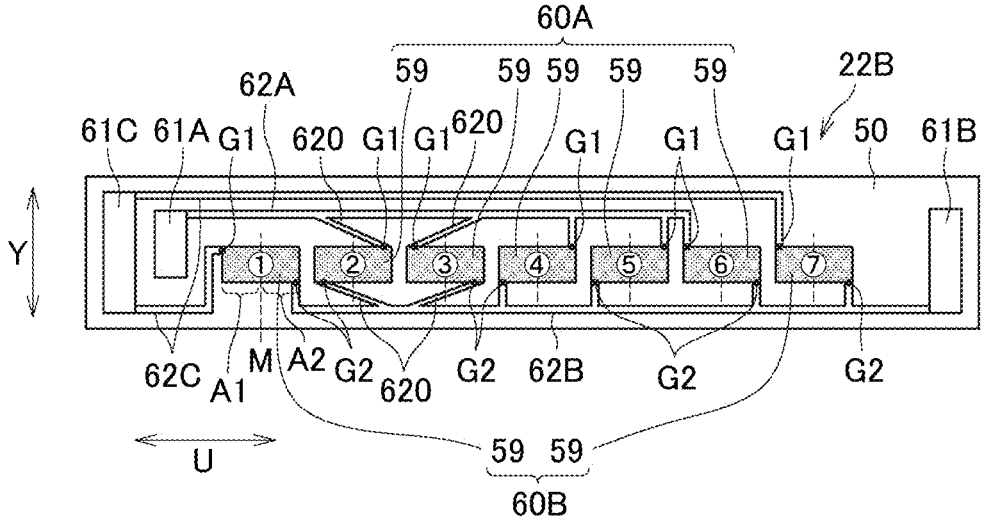
FIG. 23 is a plan view of a heater according to a third embodiment of the present disclosure, that is installable in the fixing device depicted in FIG. 2.

Subsequently, FIG. 23 illustrates a construction of a heater 22B according to a third embodiment of the present disclosure.

As illustrated in FIG. 23, the heater 22B according to the third embodiment includes slopes 620 through Which the first feeder 62A and the second feeder 62B are connected to a part of the resistive heat generators 59, respectively, that is, the second, resistive heat generator 59 and the third, resistive heat generator 59 from the left in FIG. 23. The slopes 620 are a part of the first feeder 62A and the second feeder 62B, respectively, and inclined with respect to the longitudinal direction U of the base 50. Thus, the slope 620 of each of the first feeder 62A and the second feeder 623 is connected to the resistive heat generator 59. Concerning the resistive heat generators 59 other than the second, resistive heat generator 59 and the third, resistive heat generator 59 from the left in FIG. 23, each of the first feeder 62A, the second feeder 62B, and the third feeder 62C includes a parallel portion that is connected to the resistive heat generator 59 and is parallel to the short direction Y or the longitudinal direction U of the base 50.

Figure 24:
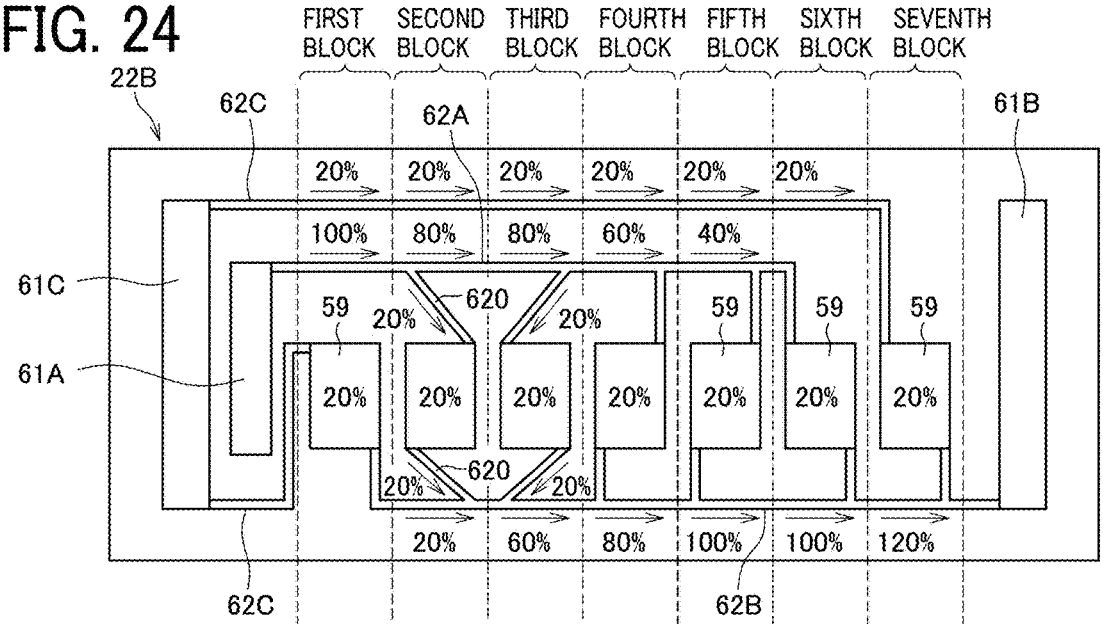
FIG. 24 is a diagram of the heater according to the third embodiment depicted in FIG. 23, illustrating the heat generation amount of the first feeder, the second feeder, and the third feeder in each block when the resistive heat generators generate heat collectively.
Figure 24:
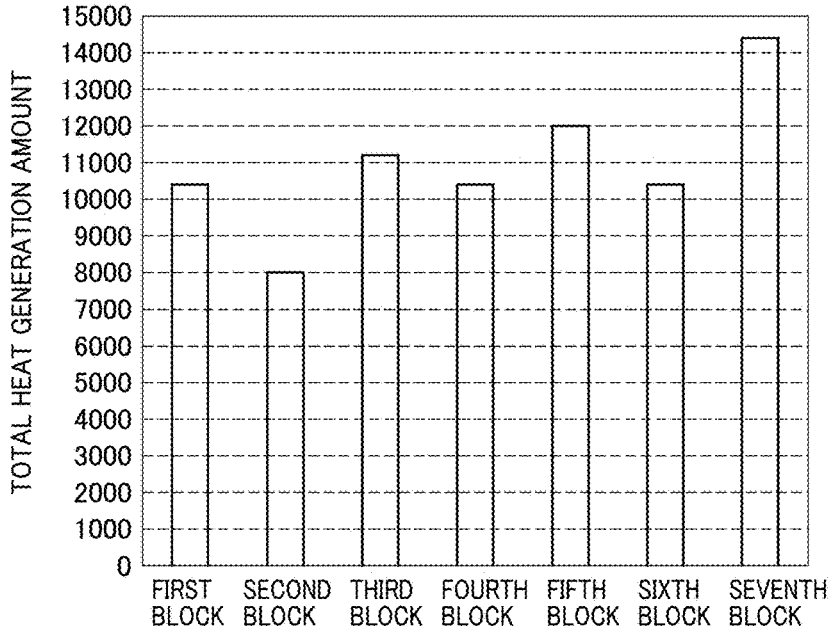
Figure 25:
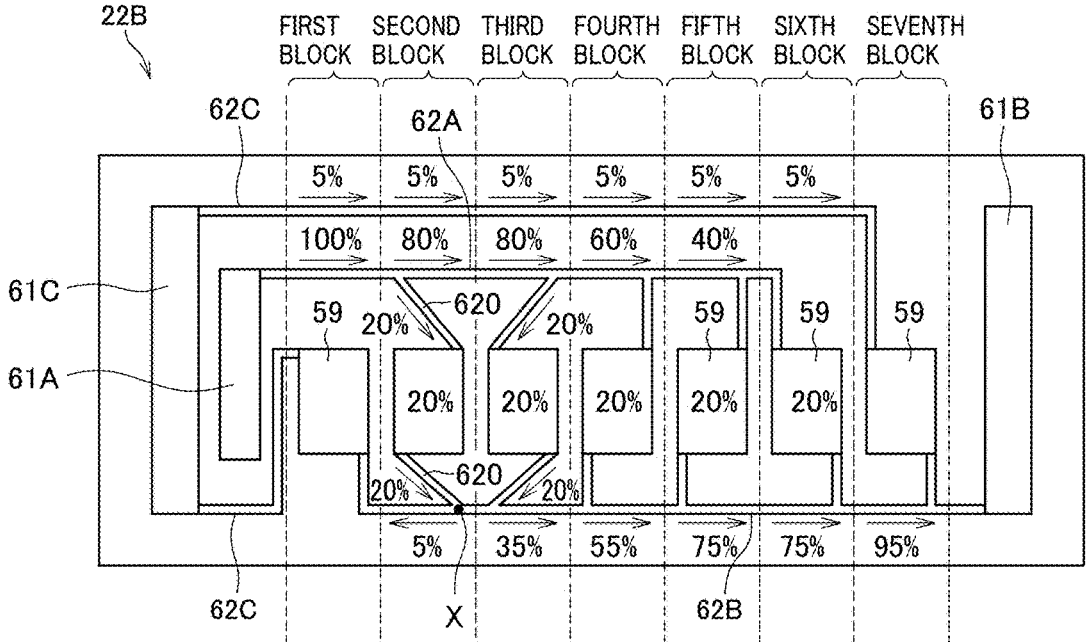
FIG. 25 is a diagram of the heater according to the third embodiment depicted in FIG. 23, illustrating the heat generation amount of the first feeder, the second feeder, and the third feeder in each block when a part of the resistive heat generators generates heat and the unintentional shunt generates.
Figure 25:
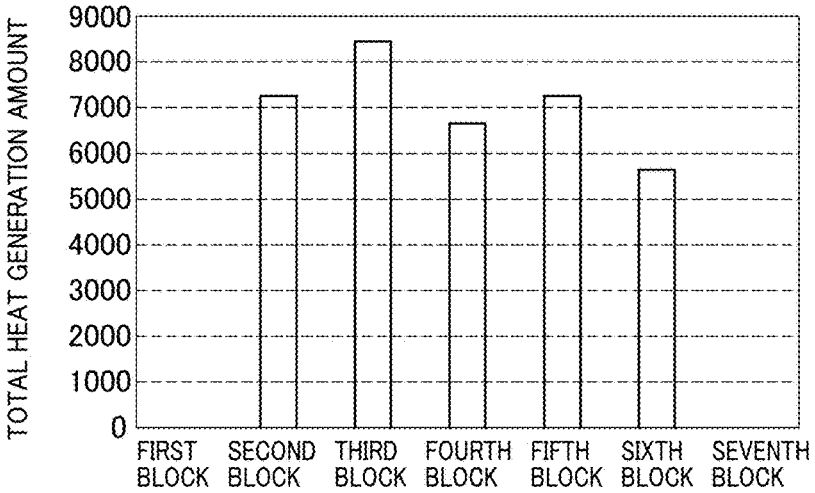

FIGS. 24 and 25 illustrate the heat generation distribution of the first feeder 62A, the second feeder 62B, and the third feeder 62C of the heater 223 according to the third embodiment of the present disclosure. FIG. 24 illustrates the heat generation distribution of the first feeder 62A, the second feeder 62B, and the third feeder 62C when the resistive heat generators 59 generate heat collectively. FIG. 25 illustrates the heat generation distribution of the first feeder 62A, the second feeder 62B, and the third feeder 62C when the first heat generating portion 60A depicted in FIG. 23 generates heat and the unintentional shunt generates. As a total heat generation amount in each block, a heat generation amount of each of the first feeder 62A, the second feeder 623, and the third feeder 62C of the heater 223 according to the third embodiment is added with a heat generation amount of each of the slopes 620. For example, since the slopes 620 extend in a certain span in the longitudinal direction U of the base 50, the slopes 620 affect the heat generation distribution in the longitudinal direction U of the base 50. Conditions of the electric current flown in each of the first feeder 62A, the second feeder 62B, and the third feeder 62C and a calculation method for calculating the heat generation amount are equivalent to those employed by the example described above.

Figure 26:
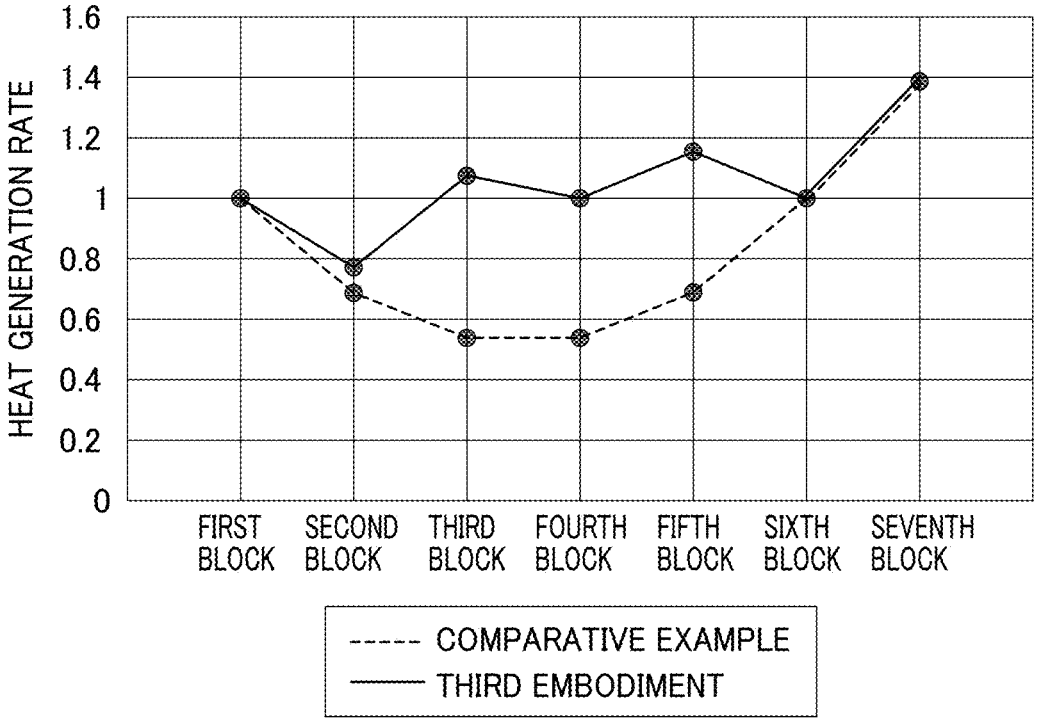
FIG. 26 is a graph illustrating comparison in the heat generation distribution between the heater according to the comparative example depicted in FIG. 10 and the heater according to the third embodiment depicted in FIG. 23 when the resistive heat generators generate heat collectively.
Figure 27:
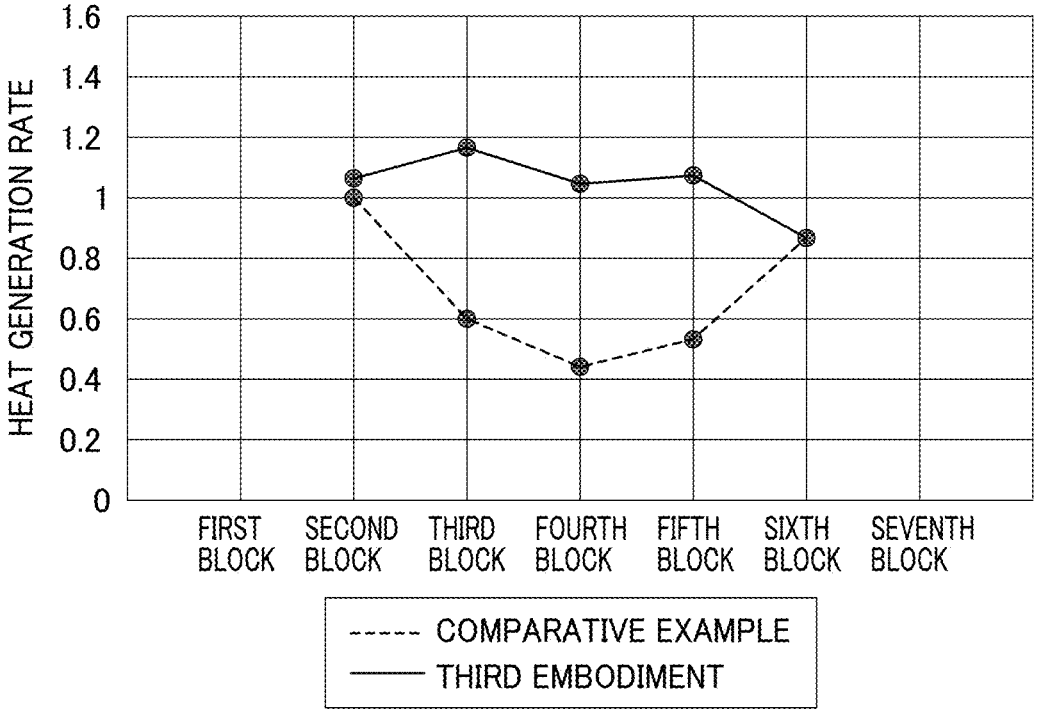
FIG. 27 is a graph illustrating comparison in the heat generation distribution between the heater according to the comparative example depicted in FIG. 10 and the heater according to the third embodiment depicted in FIG. 23 when a part of the resistive heat generators generates heat and the unintentional shunt generates.

FIGS. 26 and 27 illustrate graphs, respectively, that compare the heat generation distribution of the heater 220 according to the comparative example with a heat generation distribution of the heater 22B according to the third embodiment of the present disclosure. FIG. 26 illustrates the heat generation distribution when the resistive heat generators 59 and 590 generate heat collectively. FIG. 27 illustrates the heat generation distribution when the first heat generating portions 60A and 600A depicted in FIGS. 23 and 10, respectively, generate heat and the unintentional shunt generates. In FIGS. 26 and 27, a dotted line represents the heat generation distribution of the first feeder 620A, the second feeder 620B, and the third feeder 620C of the heater 220 according to the comparative example. A solid line represents the heat generation distribution of the first feeder 62A, the second feeder 62B, and the third feeder 62C of the heater 22B according to the third embodiment of the present disclosure.

As illustrated in FIGS. 2.6 and 27, the heat generation amount of the heater 22B according to the third embodiment of the present disclosure increases compared to the heat generation amount of the heater 220 according to the comparative example, for example, in blocks that are situated in a center of the heater 22B in a longitudinal direction thereof. Thus, the heater 22B suppresses unevenness in the heat generation distribution of the first feeder 62A, the second feeder 62B, and the third feeder 62C. Additionally, the heater 22B according to the third embodiment of the present disclosure includes the slopes 620. Hence, the heat generation amount of each of the slopes 620 is added to the heat generation amount of a block where the slope 620 is situated. Thus, the heater 22B adjusts the heat generation distribution more precisely.

Figure 28:
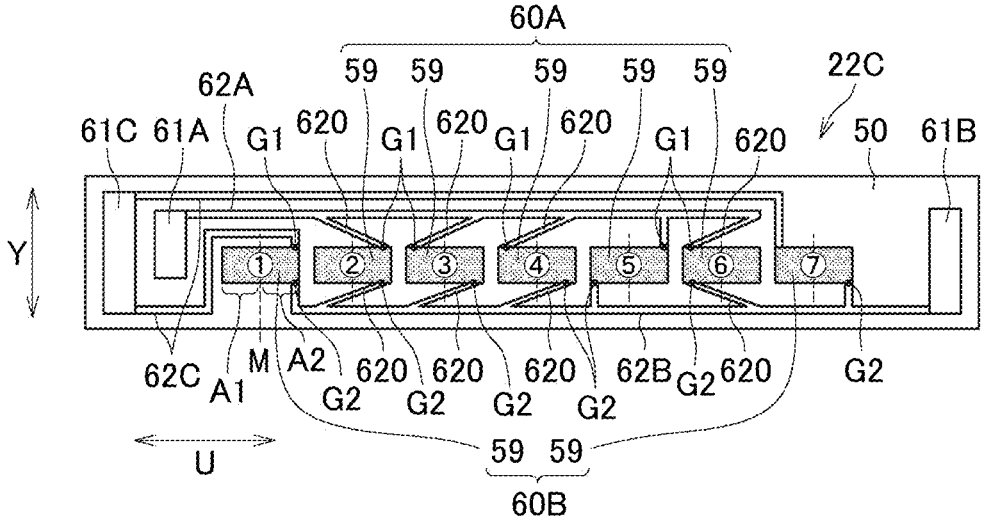
FIG. 28 is a plan view of a heater according to a fourth embodiment of the present disclosure, that is installable in the fixing device depicted in FIG. 2.

FIG. 28 illustrates a construction of a heater 22C according to a fourth embodiment of the present disclosure.

In the heater 22B according to the third embodiment depicted in FIG. 23 described above, in each of the resistive heat generators 59, the primary connector G1 and the secondary connector G2 are coupled to different sections (e.g., the first section A1 and the second section A2) of the resistive heat generator 59, respectively. Conversely, in the heater 22C according to the fourth embodiment depicted in FIG. 28, in a part of the resistive heat generators 59, the primary connector G1 and the secondary connector G2 are coupled to an identical section of the resistive heat generator 59. For example, as illustrated in FIG. 28 as one example, in the first, resistive heat generator 59 and the second, resistive heat generator 59 from the left in FIG. 28, the primary connector G1 and the secondary connector G2 are coupled to the second section A2, that is, a right section in FIG. 28, of each of the first, resistive heat generator 59 and the second, resistive heat generator 59. In the sixth, resistive heat generator 59 from the left in FIG. 28, the primary connector G1 and the secondary connector G2 are coupled to the first section A1, that is, a left section in FIG. 28, of the sixth, resistive heat generator 59.

Additionally, in the heater 22C according to the fourth embodiment, each of the first feeder 62A and the second feeder 62B includes the slopes 620 that are connected to the second, third, fourth, and sixth, resistive heat generators 59 from the left in FIG. 28. For example, in the second, resistive heat generator 59 and the sixth, resistive heat generator 59 from the left in FIG. 28, the primary connector G1 and the secondary connector G2 that contact the slopes 620 are coupled to an identical section, that is, the second section A2 of the second, resistive heat generator 59 and the first section A1 of the sixth, resistive heat generator 59. Thus, the connecting positions (e.g., the primary connector G1 and the secondary connector G2) through which the slopes 620 are connected to the resistive heat generator 59 are coupled to an identical section of the resistive heat generator 59.

Figure 29:
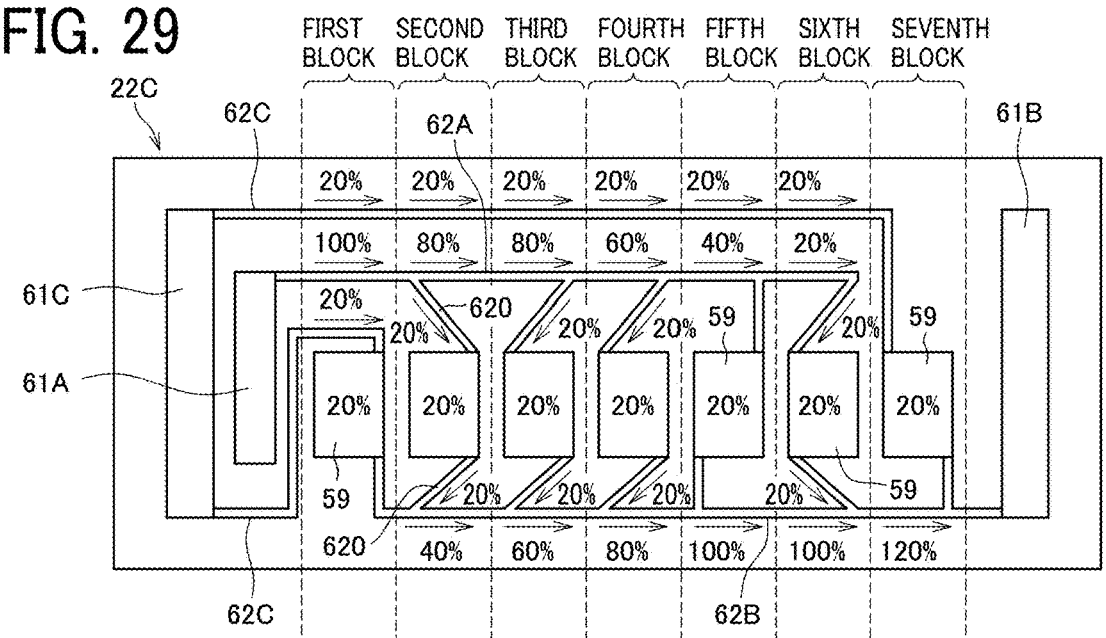
FIG. 29 is a diagram of the heater according to the fourth embodiment depicted in FIG. 28, illustrating the heat generation amount of the first feeder, the second feeder, and the third feeder in each block when the resistive heat generators generate heat collectively.
Figure 29:
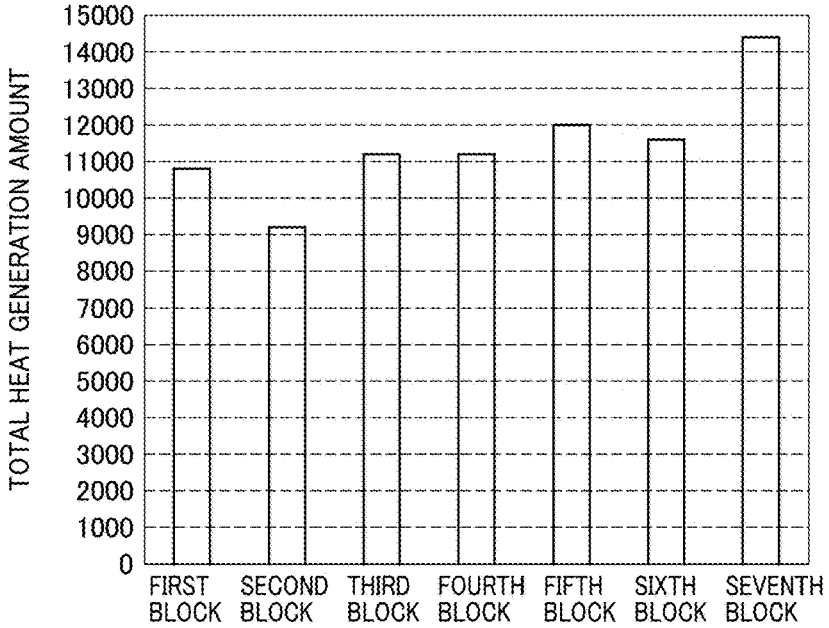
Figure 30:
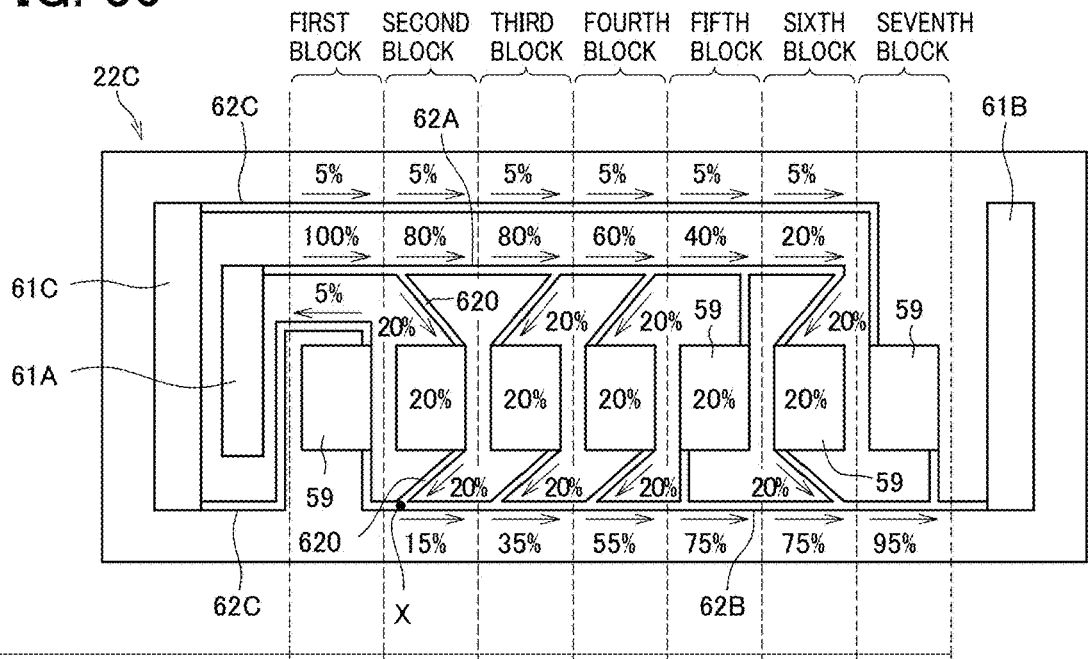
FIG. 30 is a diagram of the heater according to the fourth embodiment depicted in FIG. 28, illustrating the heat generation amount of the first feeder, the second feeder, and the third feeder in each block when a part of the resistive heat generators generates heat and the unintentional shunt generates.
Figure 30:
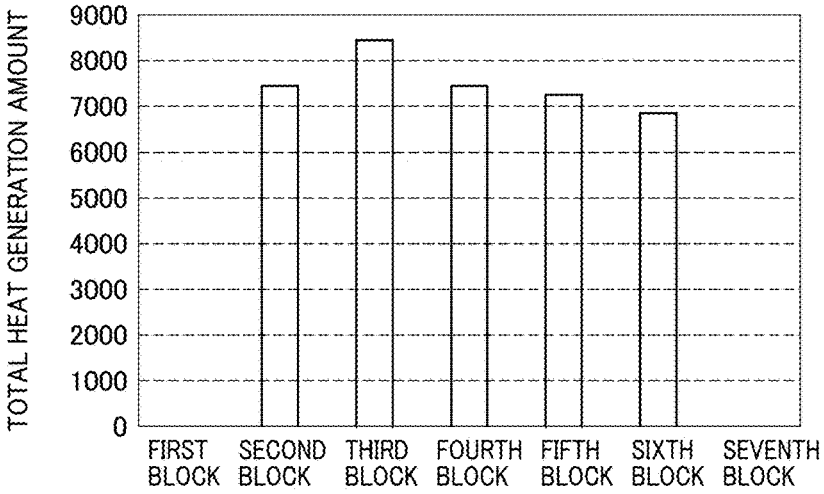

FIGS. 29 and 30 illustrate the heat generation distribution of the first feeder 62A, the second feeder 62B, and the third feeder 62C of the heater 22C according to the fourth embodiment of the present disclosure. FIG. 29 illustrates the heat generation distribution of the first feeder 62A, the second feeder 62B, and the third feeder 62C when the resistive heat generators 59 generate heat collectively. FIG. 30 illustrates the heat generation distribution of the first feeder 62A, the second feeder 62B, and the third feeder 62C when the first heat generating portion 60A depicted in FIG. 28 generates heat and the unintentional shunt generates. Like the heater 22B according to the third embodiment described above, as a total heat generation amount in each block, a heat generation amount of each of the first feeder 62A, the second feeder 62B, and the third feeder 62C of the heater 22C according to the fourth embodiment is also added with a heat generation amount of each of the slopes 620. Conditions of the electric current flown in each of the first feeder 62A, the second feeder 62B, and the third feeder 62C and a calculation method for calculating the heat generation amount are equivalent to those employed by the example described above.

Figure 31:
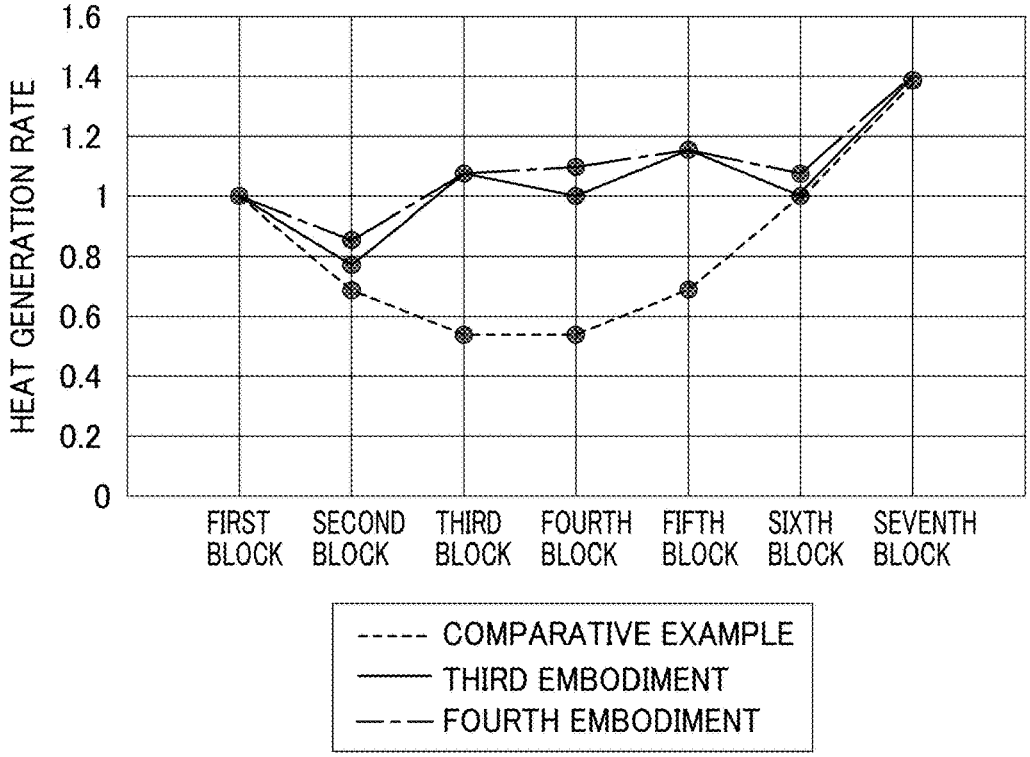
FIG. 31 is a graph illustrating comparison in the heat generation distribution between the heater according to the comparative example depicted in FIG. 10, the heater according to the third embodiment depicted in FIG. 23, and the heater according to the fourth embodiment depicted in FIG. 28 when the resistive heat generators generate heat collectively.
Figure 32:
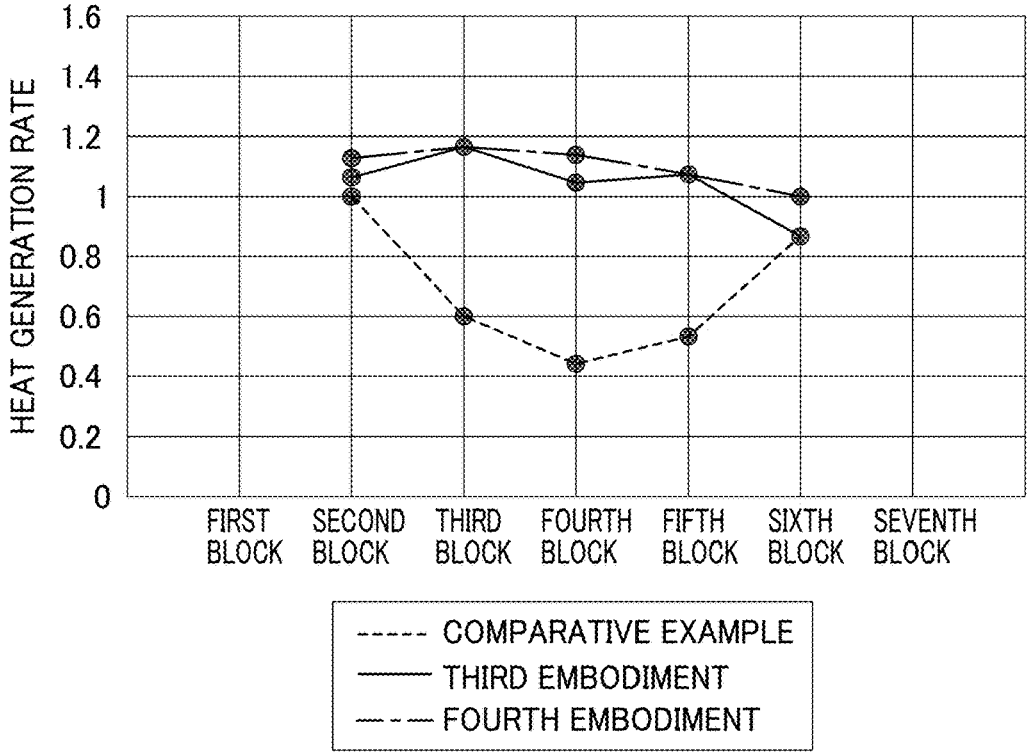
FIG. 32 is a graph illustrating comparison in the heat generation distribution between the heater according to the comparative example depicted in FIG. 10, the heater according to the third embodiment depicted in FIG. 23, and the heater according to the fourth embodiment depicted in FIG. 28 when a part of the resistive heat generators generates heat and the unintentional shunt generates.

FIGS. 31 and 32 illustrate the heat generation distribution of the first feeder 62A, the second feeder 62B, and the third feeder 62C of the heater 22C according to the fourth embodiment of the present disclosure in addition to the heat generation distribution of those of the heater 22B according to the third embodiment and the heat generation distribution of the first feeder 620A, the second feeder 620B, and the third feeder 620C of the heater 220 according to the comparative example for comparison. FIG. 31 illustrates the heat generation distribution when the resistive heat generators 59 and 590 generate heat collectively. FIG. 32 illustrates the heat generation distribution when the first heart generating portions 60A and 600A depicted in FIGS. 28 and 10, respectively, generate heat and the unintentional shunt generates. In FIGS. 31 and 32, a dotted line represents the heat generation distribution of the first feeder 620A, the second feeder 620B, and the third feeder 620C of the heater 220 according to the comparative example. A solid line represents the heat generation distribution of the first feeder 62A, the second feeder 62B, and the third feeder 62C of the heater 22B according to the third embodiment of the present disclosure. An alternate long and short dash line represents the heat generation distribution of the first feeder 62A, the second feeder 62B, and the third feeder 62C of the heater 22C according to the fourth embodiment of the present disclosure.

As illustrated in FIGS. 31 and 32, the heater 22C according to the fourth embodiment, as indicated with the alternate long and short dash line, suppresses unevenness in the temperature distribution of the first feeder 62A, the second feeder 62B, and the third feeder 62C further compared to the heater 22B according to the third embodiment, as indicated with the solid line. For example, the heater 22C according to the fourth embodiment decreases a difference between a highest, total heat generation amount in one block and a lowest, total heat generation amount in another block further. The above describes the embodiments of the present disclosure that are applied to the heaters 22, 22A, 22B, and 22C each of which incorporates three electrodes, that is, the first electrode 61A, the second electrode 61B, and the third electrode 61C, and the resistive heat generators 59. A part of the resistive heat generators 59 is controlled to generate heat separately from other resistive heat generators 59. Alternatively, the embodiments of the present disclosure are also applicable to a heater that incorporates two electrodes and resistive heat generators that are controlled collectively to generate heat, instead of the heaters 22, 22A, 22B, and 22C.

A description is provided of a construction of a heater that incorporates two electrodes and is applied with the technology of the present disclosure in comparison with a comparative example.

Figure 33:
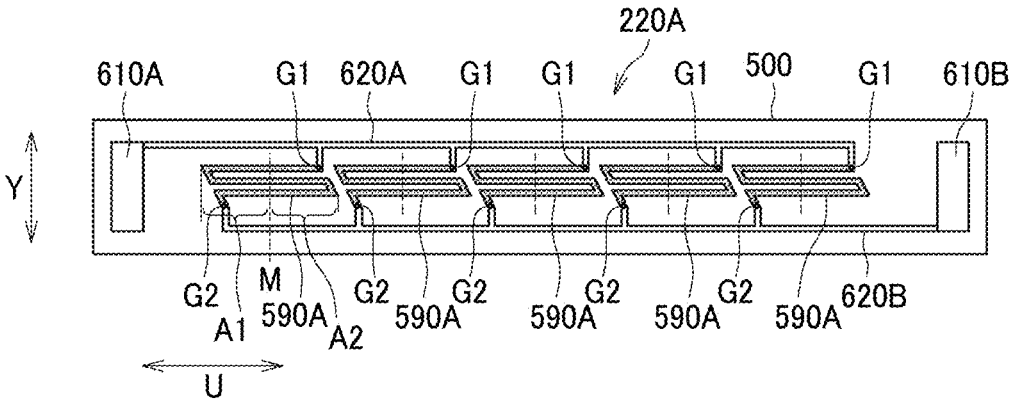
FIG. 33 is a plan view of a heater according to another comparative example.

FIG. 33 illustrates a heater 220A according to a comparative example. The heater 220A includes the base 500 that mounts two electrodes, that is, the first electrode 610A and the second electrode 610B, a plurality of resistive heat generators 590A, and two feeders, that is, the first feeder 620A and the second feeder 620B, that connect the first electrode 610A and the second electrode 610B to the resistive heat generators 590A. The plurality of resistive heat generators 590A is connected in parallel to the first electrode 610A disposed at one lateral end of the base 500 in the longitudinal direction U thereof through the first feeder 620A. The plurality of resistive heat generators 590A is connected in parallel to the second electrode 610B disposed at another lateral end of the base 500 in the longitudinal direction U thereof through the second feeder 620B. As the first electrode 610A and the second electrode 610B are applied with a voltage, an electric current is flown to the resistive heat generators 590A collectively so that the resistive heat generators 590A generate heat.

The plurality of connectors, that connects the first feeder 620A and the second feeder 620B to the resistive heat generators 590A, includes the primary connectors G1 and the secondary connectors G2. Each of the primary connectors G1, serving as a primary connector, connects the first feeder 620A, disposed at one end side of the base 500 in the short direction Y thereof, to the resistive heat generator 590A. Each of the secondary connectors G2, serving as a secondary connector, connects the second feeder 620B, disposed at another end side of the base 500 in the short direction Y thereof, to the resistive heat generator 590A, The hypothetical center line M of each of the resistive heat generators 590A in the longitudinal direction U of the base 500 divides each of the resistive heat generators 590A into the first section A1 and the second section A2. In the heater 2204 according to the comparative example, each of the primary connectors G1 is coupled to an identical section of the resistive heat generator 590A. Each of the secondary connectors G2 is coupled to another identical section of the resistive heat generator 590A. For example, in an example illustrated in FIG. 33, each of the primary connectors G1 is coupled to the second section A2 of the resistive heat generator 590A. Each of the secondary connectors G2 is coupled to the first section A1 of the resistive heat generator 590A.

Figure 34:
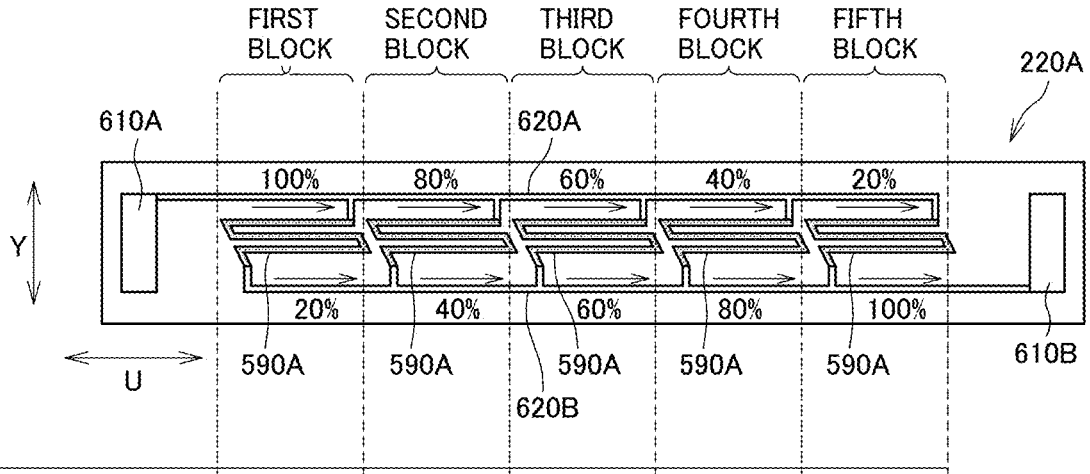
FIG. 34 is a diagram of the heater according to the comparative example depicted in FIG. 33, illustrating the heat generation amount of the first feeder and the second feeder in each block.
Figure 34:
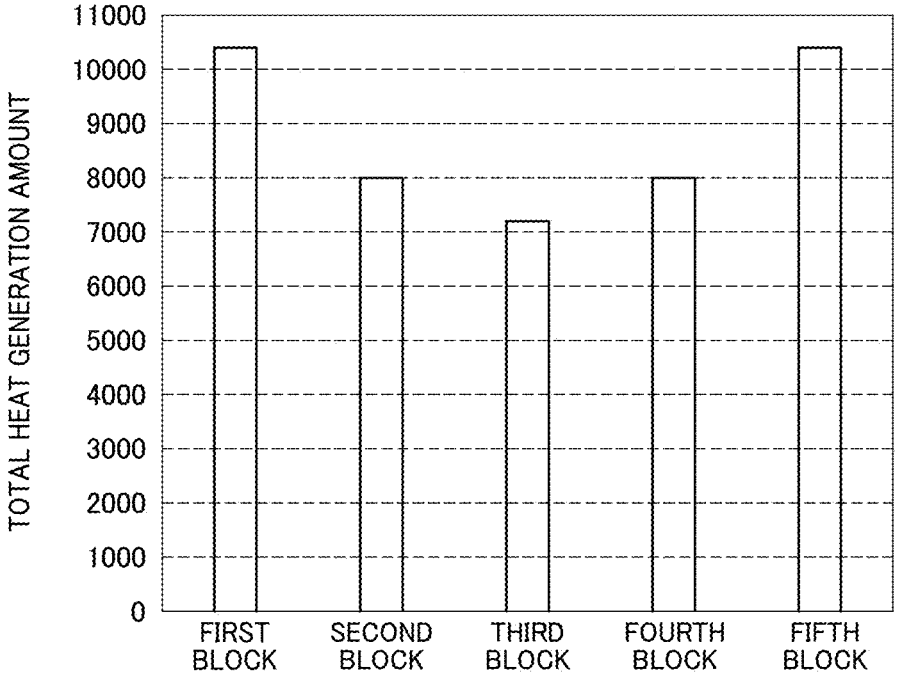

FIG. 34 illustrates the heat generation distribution of the first feeder 620A and the second feeder 620B of the heater 220A according to the comparative example. As illustrated in FIG. 34, in the heater 220A according to the comparative example, the total heat generation amount of the first feeder 620A and the second feeder 620B is greater in blocks situated at both lateral ends of the heater 220A in a longitudinal direction thereof than in blocks situated at a center of the heater 220A in the longitudinal direction thereof, causing the total heat generation amount of the first feeder 620A and the second feeder 620B to be uneven.

Figure 35:
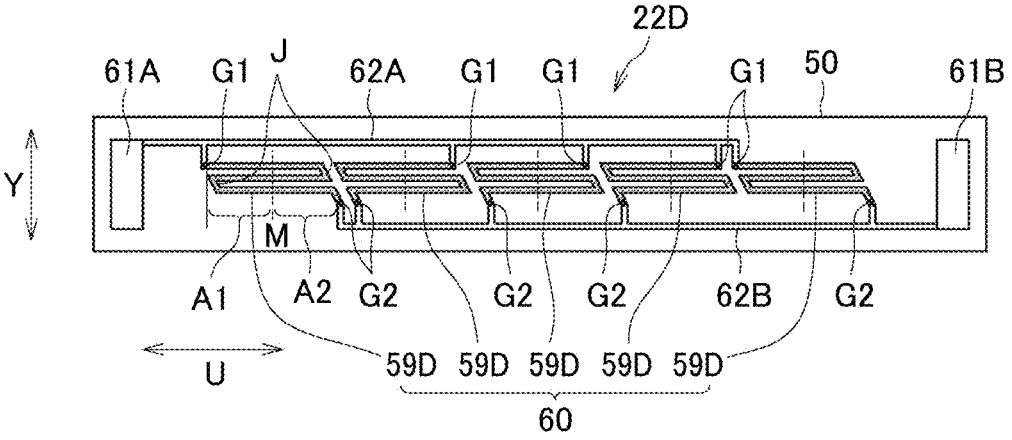
FIG. 35 is a plan view of a heater according to a fifth embodiment of the present disclosure, that is installable in the fixing device depicted in FIG. 2.

Subsequently, FIG. 35 illustrates a construction of a heater 22D according to a fifth embodiment of the present disclosure.

In the heater 22D according to the fifth embodiment of the present disclosure depicted in FIG. 35, unlike the heater 220A according to the comparative example depicted in FIG. 33, sections of a resistive heat generator 59D, that are coupled to the primary connector G1, that connects the first feeder 62A to the resistive heat generator 59D, and the secondary connector G2, that connects the second feeder 62B to the resistive heat generator 59D, respectively, are different between a part of the resistive heat generators 59D and other resistive heat generators 59D. For example, in an example illustrated in FIG. 35, the sections of the resistive heat generators 59D disposed at both lateral ends of the base 50 in the longitudinal direction U thereof, that are coupled to the primary connector G1 and the secondary connector G2, respectively, are symmetric with those of other resistive heat generators 59D. Specifically, concerning each of the resistive heat generators 59D disposed at both lateral ends of the base 50 in the longitudinal direction U thereof, the primary connector G1 is coupled to the first section A1 of the resistive heat generator 59D and the secondary connector G2 is coupled to the second section A2 of the resistive heat generator 59D. Conversely, concerning each of the resistive heat generators 59D other than the resistive heat generators 59D disposed at both lateral ends of the base 50 in the longitudinal direction U thereof, the primary connector G1 is coupled to the second section A2 of the resistive heat generator 59D and the secondary connector G2 is coupled to the first section A1 of the resistive heat generator 59D. Other construction of the heater 22D is equivalent to that of the heater 220A according to the comparative example depicted in FIG. 33.

Figure 36:
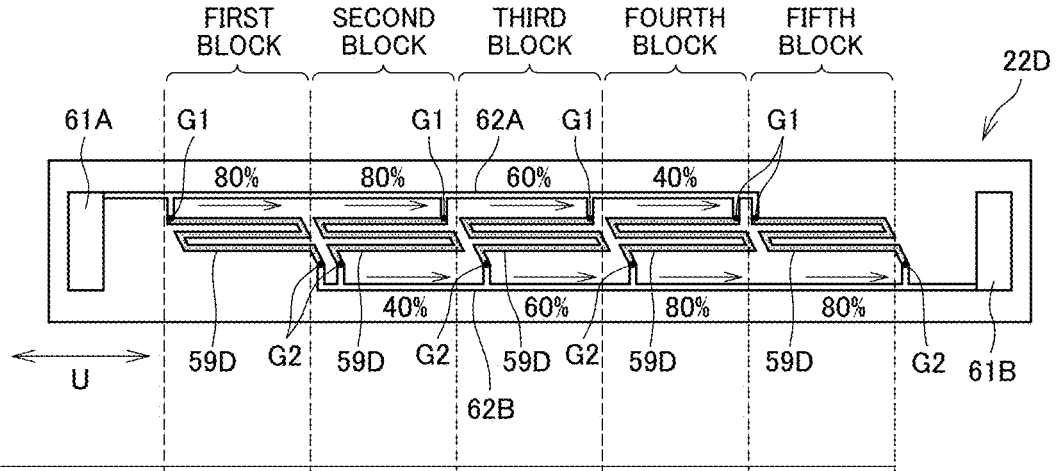
FIG. 36 is a diagram of the heater according to the fifth embodiment depicted in FIG. 35, illustrating the heat generation amount of the first feeder and the second feeder in each block.
Figure 36:
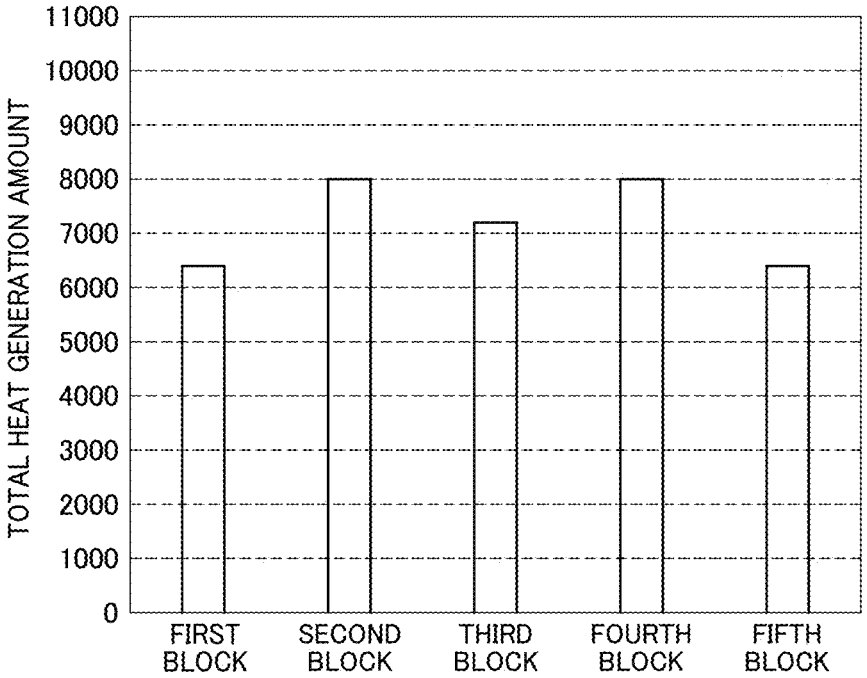
Figure 37:
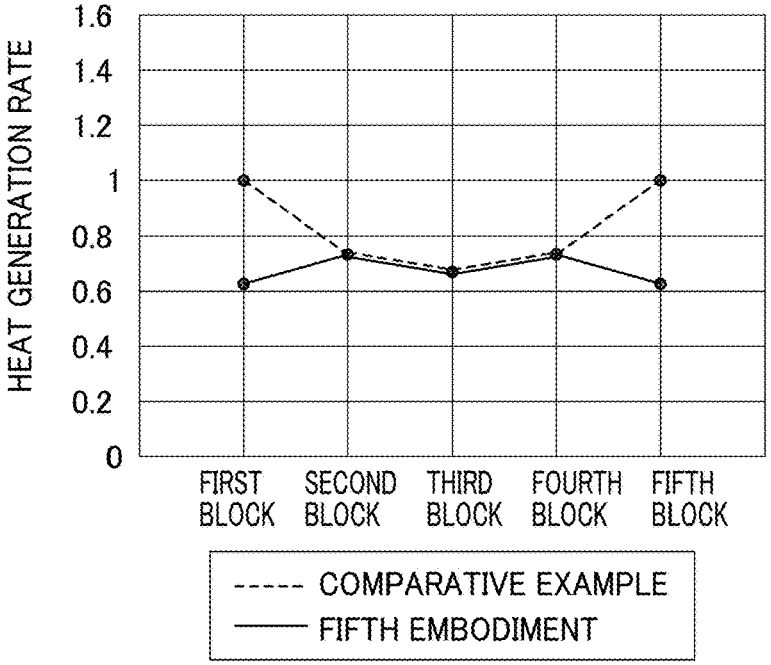
FIG. 37 is a graph illustrating comparison in the heat generation distribution between the heater according to the comparative example depicted in FIG. 33 and the heater according to the fifth embodiment depicted in FIG. 35.

FIG. 36 illustrates the heat generation distribution of the first feeder 62A and the second feeder 62B of the heater 22D according to the fifth embodiment of the present disclosure. FIG. 37 is a graph comparing the heat generation distribution of the first feeder 620A and the second feeder 620B of the heater 220A according to the comparative example depicted in FIG. 33 with the heat generation distribution of the first feeder 62A and the second feeder 62B of the heater 22D according to the fifth embodiment of the present disclosure depicted in FIG. 35. In FIG. 37, a dotted line represents the heat generation distribution of the first feeder 620A and the second feeder 620B of the heater 220A according to the comparative example. A solid line represents the heat generation distribution of the first feeder 62A and the second feeder 623 of the heater 22D according to the fifth embodiment of the present disclosure. In FIG. 37, the total heat generation amount of the first feeder 620A and the second feeder 620B in the first block of the heater 220A according to the comparative example defines "1" as a reference.

As illustrated in FIG. 37, the heat generation amount of the heater 22D according to the fifth embodiment of the present disclosure, as indicated with the solid line, decreases substantially compared to the heat generation amount of the heater 220A according to the comparative example, as indicated with the dotted line, in blocks that are situated at both lateral ends of the heater 22D in a longitudinal direction thereof. Thus, the heater 22D suppresses unevenness in the temperature distribution of the first feeder 62A and the second feeder 62B. For example, as illustrated in FIG. 34, the heater 220A according to the comparative example generates a difference of 3200 in the total heat generation amount between a highest, total heat generation amount in one block and a lowest, total heat generation amount in another block. Conversely, as illustrated in FIG. 36, the heater 22D according to the fifth embodiment of the present disclosure generates a difference of 1600 in the total heat generation amount. Thus, even if the technology of the present disclosure is applied to the heater 22D that incorporates the two electrodes, that is, the first electrode 61A and the second electrode 6B, and controls the resistive heat generators 59D collectively to generate heat, the heater 22D suppresses unevenness in the heart generation distribution of the first feeder 62A and the second feeder 62B and uneven temperature of the heater 22D or the fixing belt 20 in the longitudinal direction thereof.

FIG. 35 illustrates an example in which the primary connector G1 and the secondary connector G2 are coupled to different sections of each of the resistive heat generators 59D, respectively. Alternatively, like the heater 22A according to the second embodiment depicted in FIG. 18 described above, the primary connector G1 and the secondary connector G2 may be coupled to an identical section e.g., the first section A1 or the second section A2) of a part of the resistive heat generators 59D. Yet alternatively, like the heater 22B according to the third embodiment depicted in FIG. 23 and the heater 22C according to the fourth embodiment depicted in FIG. 28 described above, at least one of the first feeder 62A and the second feeder 62B may include the slope 620.

As described above, in the heaters 22, 22A, 22B, 22C, and 22D according to the first to fifth embodiments of the present disclosure, respectively, the sections of each of the resistive heat generators 59 or 59D, that are coupled to the primary connector G1 and the secondary connector G2, respectively, are different between a part of the resistive heat generators 59 or 59D and other resistive heat generators 59 or 59D. Thus, the heaters 22, 22A, 223, 22C, and 22D adjust the total heat generation amount of the first feeder 62A, the second feeder 62B, and the third feeder 62C in each block defined for each resistive heat generator 59 or 59D, thus suppressing unevenness in the heat generation distribution in a longitudinal direction of the heaters 22, 224, 22B, 22C, and 22D.

The heaters 22, 224, 223, 22C, and 22D suppress unevenness in the temperature distribution by changing the connecting positions where the first feeder 62A, the second feeder 62B, and the third feeder 62C are connected to the resistive heat generators 59 or 59D, thus avoiding substantial change in design. For example, the material or the thickness of a part of the first feeder 62A, the second feeder 62B, and the third feeder 62C may be different from that of other ones of the first feeder 62A, the second feeder 62B, and the third feeder 62C to change the resistance value of the first feeder 62A, the second feeder 62B, and the third feeder 62C, thus adjusting the heat generation amount of the first feeder 62B, the second feeder 62B, and the third feeder 62C. However, varying the material or the thickness of the first feeder 62A, the second feeder 62B, and the third feeder 62C may adversely affect processing or manufacturing costs of the heaters 22, 22A, 223, 22C, and 22D or image quality. To address this circumstance, the heaters 22, 22 A, 223, 22C, and 22D according to the first to fifth embodiments of the present disclosure do not change the resistance value of the first feeder 62A, the second feeder 62B, and the third feeder 62C by differentiating the material or the thickness of at least one of the first feeder 62A, the second feeder 623, and the third feeder 62C from that of other ones of the first feeder 62A, the second feeder 623, and the third feeder 62C. That is, the first feeder 62A, the second feeder 62B, and the third feeder 62C overall have an identical resistance value. Accordingly, the first feeder 62A, the second feeder 62B, and the third feeder 62C are processed readily by screen printing or the like, reducing manufacturing costs and preventing the difference in the thickness of the first feeder 62A, the second feeder 62B, and the third feeder 62C from adversely affecting image quality.

With the construction of each of the heaters 22, 22A, 22B, 22C, and 22D according to the first to fifth embodiments of the present disclosure, even if an amount of an electric current flown to the resistive heat generators 59 and 59D increases to increase an image forming speed of the image forming apparatus 100, each of the heaters 22, 22A, 22B, 22C, and 22D suppresses unevenness in the heat generation distribution of the first feeder 62A, the second feeder 62B, and the third feeder 62C, attaining increase in the image forming speed of the image forming apparatus 100. For example, even if the heat generation amount of the first feeder 62A, the second feeder 62B, and the third feeder 62C increases and unevenness in the heat generation distribution is noticeable substantially, each of the heaters 22, 22A, 22B, 22C, and 22D suppresses unevenness in the heat generation distribution, thus suppressing failures such as uneven gloss of a toner image formed on a sheet and retaining image quality, if the first feeder 62A, the second feeder 62B, and the third feeder 62C are narrowed to downsize the heaters 22, 22A, 22B, 22C, and 22D in a short direction thereof, as the resistance value of the first feeder 62A, the second feeder 62B, and the third feeder 62C increases, the heat generation amount thereof may increase and the unintentional shunt described above may generate. To address this circumstance, the heaters 22A, 22B, 22C, and 22D according to the first to fifth embodiments of the present disclosure employ the constructions described above, respectively, suppressing unevenness in the heat generation distribution of the first feeder 62A, the second feeder 62B, and the third feeder 62C and thereby downsizing the heaters 22, 22A, 22B, 22C, and 22D in the short direction thereof.

Figure 38:
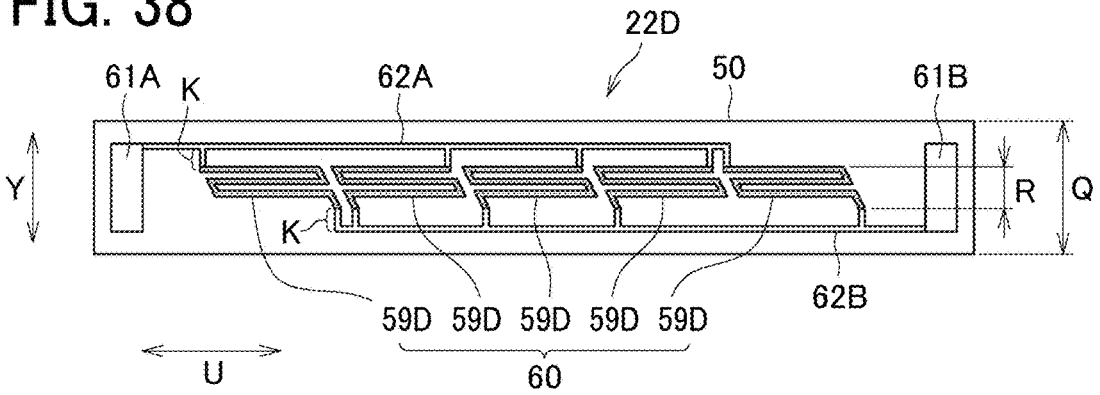
FIG. 38 is a plan view of the heater depicted in FIG. 35, illustrating a length of the heater and a length of a resistive heat generator in a short direction of the heater.

Accordingly, the technology of the present disclosure is more advantageous if the technology of the present disclosure is applied to a heater having a decreased length in a short direction thereof particularly for downsizing. For example, in the heater 22D according to the fifth embodiment of the present disclosure illustrated in FIG. 38, the heater 22D (e.g., the base 50) has a length Q in the short direction thereof. The resistive heat generator 59D has a length R in a short direction of the resistive heat generator 59D. If the technology of the present disclosure is applied to the heater 22D in which a rate R/Q of the length R of the resistive heat generator 59D in the short direction thereof with respect to the length Q of the heater 22D in the short direction thereof is 25% or greater, the heater 22D achieves an improved advantage. If the rate R/Q is 40% or greater, the heater 22D applied with the technology of the present disclosure achieves a further improved advantage. The length Q denotes a length of the base 50 in the short direction Y thereof. The length R denotes a length of an entirety of a single resistive heat generator (e.g., the resistive heat generator 59D) in the short direction thereof. FIG. 38 illustrates an example in which the base 50 of the heater 22D is rectangular. Hence, the length Q of the heater 22D in the short direction thereof is identical at any position in the longitudinal direction thereof. However, the base 50 may have an uneven edge that varies the length Q in the short direction Y thereof. In this case, the length Q of the heater 22D in the short direction thereof denotes a shortest length of the heater 22D in the short direction thereof within a longitudinal span in the longitudinal direction of the heater 22D, where the resistive heat generators 59D are disposed.

At least one or both of the primary connector G1 and the secondary connector G2 may be coupled to the resistive heat generator 59 or 59D at a section thereof that is different between a part of the resistive heat generators 59 or 59D and other resistive heat generators 59 or 59D. At least one of the primary connector G1 and the secondary connector G2 is coupled to a section of the resistive heat generator 59 or 59D, that is different between a part of the resistive heat generators 59 or 59D and other resistive heat generators 59 or 59D. Thus, the heaters 22, 22A, 22B, 22C, and 22D adjust the total heat generation amount of the first feeder 62A, the second feeder 62B, and the third feeder 62C in each block defined for each resistive heat generator 59 or 59D, thus suppressing unevenness in the heat generation distribution in the longitudinal direction of the heaters 22, 22A, 22B, 22C, and 22D.

Selection of at least one of the resistive heat generators 59 or 59D where the primary connector G1 or the secondary connector G2 is coupled to a section of the resistive heat generator 59 or 59D, that is different from a section of other resistive heat generator 59 or 59D, that is coupled to the primary connector G1 or the secondary connector G2, is performed properly based on a layout of the heaters 22, 22A, 22B, 22C, and 22D, the heat generation distribution of the first feeder 62A, the second feeder 62B, and the third feeder 62C, and the like.

As illustrated in FIGS. 16 and 17, for example, in the heater 220 according to the comparative example described above, the heat generation amount of the first feeder 620A, the second feeder 620B, and the third feeder 620C is greater in the blocks situated at both lateral ends of the heater 220 in the longitudinal direction thereof than in the blocks situated at the center of the heater 220 in the longitudinal direction thereof. To address this circumstance, the first feeder 62A, the second feeder 62B, and the third feeder 62C are preferably connected such that the first feeder 62A, the second feeder 62B, and the third feeder 62C decrease the heat generation amount in blocks situated at both lateral ends of the heater 22 in the longitudinal direction thereof and increase the heat generation amount in blocks situated at the center of the heater 22 in the longitudinal direction thereof. Hence, at least one of the resistive heat generators 59 disposed at a position, that is, the center, other than both lateral ends of the heater 22 in the longitudinal direction thereof, is coupled to at least one of the primary connector G1 and the secondary connector G2 in a section of the resistive heat generator 59, that is different from a section of each of the resistive heat generators 59 disposed at both lateral ends of the heater 22 in the longitudinal direction thereof. If the sections of the resistive heat generator 59, that are coupled to the primary connector G1 and the secondary connector G2, respectively, are identical between the resistive heat generators 59 disposed at the center of the heater 22 and the resistive heat generators 59 disposed at both lateral ends of the heater 22 in the longitudinal direction thereof, the heat generation amount may decrease further in a block that has a decreased heat generation amount. To address this circumstance, like the heater 22 illustrated in FIG. 13, for example, the section of the resistive heat generator 59, that is coupled to at least one of the primary connector G1 and the secondary connector G2, is preferably different between the resistive heat generators 59 disposed at both lateral ends of the heater 22 in the longitudinal direction thereof, that is, the first, resistive heat generator 59 and the seventh, resistive heat generator 59 from the left in FIG. 13, and the resistive heat generator 59 disposed at the center of the heater 22 in the longitudinal direction thereof, that is, the fourth, resistive heat generator 59 from the left in FIG. 13.

If the sections of the resistive heat generator 59, that are coupled to the primary connector G1 and the secondary connector G2, respectively, are different from the sections of the adjacent, resistive heat generator 59, that are coupled to the primary connector G1 and the secondary connector G2, respectively, repeatedly with the resistive heat generators 59 arranged in the longitudinal direction of the heater 22, the heat generation amount may decrease on the contrary in a block that is intended to attain an increased heart generation amount. To address this circumstance, like the heater 22 illustrated in FIG. 13, at least a pair of resistive heat generators 59 adjacent to each other (e.g., the first, resistive heat generator 59 and the second, resistive heat generator 59 from the left in FIG. 13) preferably has a configuration in which the sections of the first, resistive heat generator 59, that are coupled to the primary connector G1 and the secondary connector G2, respectively, are identical to the sections of the second, resistive heat generator 59, that are coupled to the primary connector G1 and the secondary connector G2, respectively. For example, the primary connector G1 is coupled to the first section A1 of each of the first, resistive heat generator 59 and the second, resistive heat generator 59. The secondary connector G2 is coupled to the second section A2 of each of the first, resistive heat generator 59 and the second, resistive heat generator 59.

Figure 39:
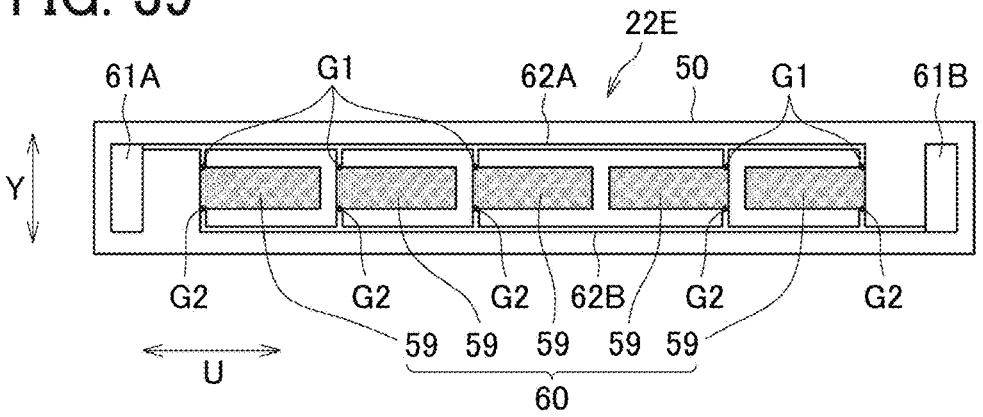
FIG. 39 is a plan view of a heater according to a first modification example, that is installable in the fixing device depicted in FIG. 2.

Like the heaters 22 and 22D illustrated in FIGS. 13 and 35, respectively, the primary connector G1 and the secondary connector G2 are coupled to different sections of each of the resistive heat generators 59 or 59D, respectively. In this case, the resistive heat generators 59 and 59D degrade similarly, suppressing unevenness in heat generation over time and facilitating estimation of failures caused by degradation of the resistive heat generators 59 and 59D. FIG. 39 illustrates a heater 22E in which the primary connector G1 and the secondary connector G2 are coupled to an identical section of each of the resistive heat generators 59. For example, both the primary connector G1 and the secondary connector G2 are coupled to the first section A1 or the second section A2 of each of the resistive heat generators 59. The heater 22E also achieves advantages similar to the advantages described above with reference to FIG. 13 or 35.

Each of the primary connector G1 and the secondary connector G2 that connect the first feeder 62A, the second feeder 62B, and the third feeder 62C to the resistive heat generator 59 is preferably situated at a position closer to a lateral end of the resistive heat generator 59 rather than the hypothetical center line M in the longitudinal direction U of the base 50. If each of the first feeder 62A, the second feeder 62B, and the third feeder 62C is connected to the resistive heat generator 59 on the lateral end of the resistive heat generator 59 in the longitudinal direction U of the base 50, the resistive heat generator 59 is immune from uneven temperature that might generate within the resistive heat generator 59, unlike a configuration in which each of the first feeder 62A, the second feeder 62B, and the third feeder 62C is connected to the resistive heat generator 59 on the hypothetical center line M.

As illustrated in FIG. 13, the resistive heat generator 59 is a block. As illustrated in FIG. 35, the resistive heat generator 59D is bent and extended reciprocally in the longitudinal direction U of the base 50 to produce bent portions J.

Figure 40:
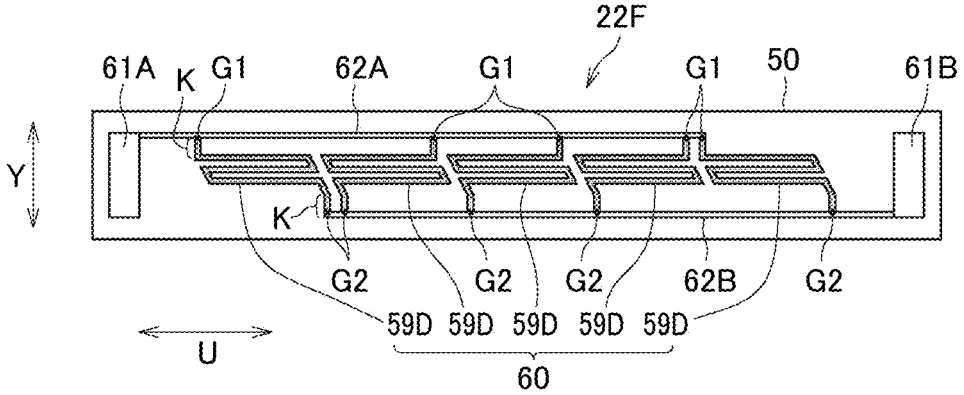
FIG. 40 is a plan view of a heater according to a second modification example, that is installable in the fixing device depicted in FIG. 2.

According to the embodiments described above, as illustrated in FIG. 38, for example, extensions K extend in the short direction Y of the base 50 and connect the first feeder 62A and the second feeder 62B to the resistive heat generator 59D, respectively. The extensions K may connect the third feeder 62C to the resistive heat generator 59 depicted in FIG. 13. The extension K is a part of each of the first feeder 62A, the second feeder 62B, and the third feeder 62C. FIG. 40 illustrates a heater 22F that includes the extensions K. Alternatively, as illustrated in FIG. 40, the extension K extending in the short direction Y of the base 50 may be a part of the resistive heat generator 59D.

Figure 41:
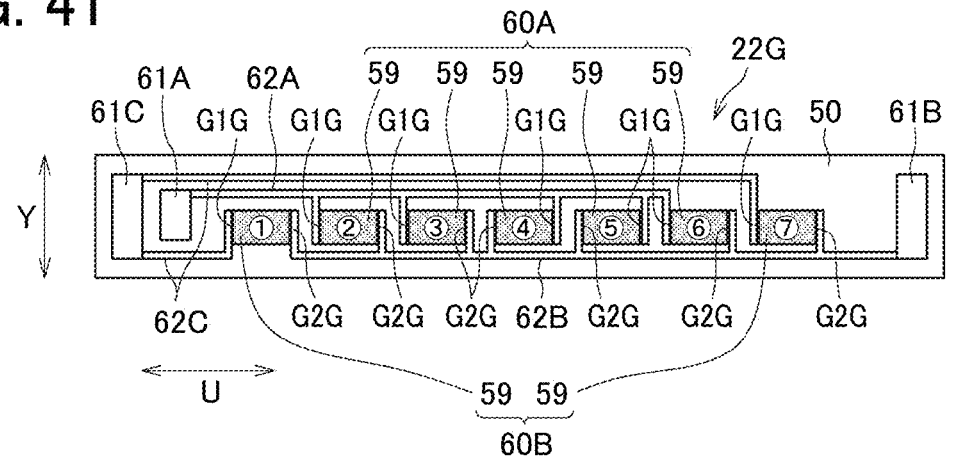
FIG. 41 is a plan view of a heater according to a third modification example, that is installable in the fixing device depicted in FIG. 2.

As illustrated in FIG. 13, the primary connector G1 and the secondary connector G2 that connect the first feeder 62A, the second feeder 62B, and the third feeder 62C to the resistive heat generator 59 are disposed at corners of each of the resistive heat generators 59 that have a block shape. Alternatively, FIG. 41 illustrates a heater 22G including primary connectors G1G and secondary connectors G2G that connect the first feeder 62A, the second feeder 62B, and the third feeder 62C to the resistive heat generators 59. Each of the primary connectors G1G and the secondary connectors G2G extends in the short direction Y of the base 50 throughout an entirety of an edge of the resistive heat generator 59. For example, the primary connector G1G extends along a left edge in FIG. 41 of the resistive heat generator 59. The secondary connector G2G extends along a right edge in FIG. 41 of the resistive heat generator 59.

Figure 42:
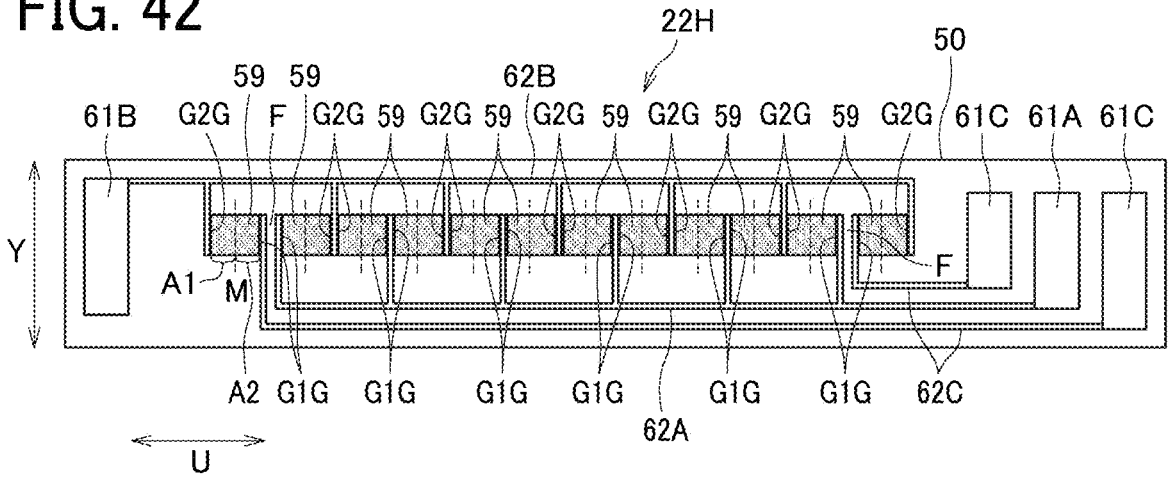
FIG. 42 is a plan view of a heater according to a fourth modification example, that is installable in the fixing device depicted in FIG. 2.
Figure 43:
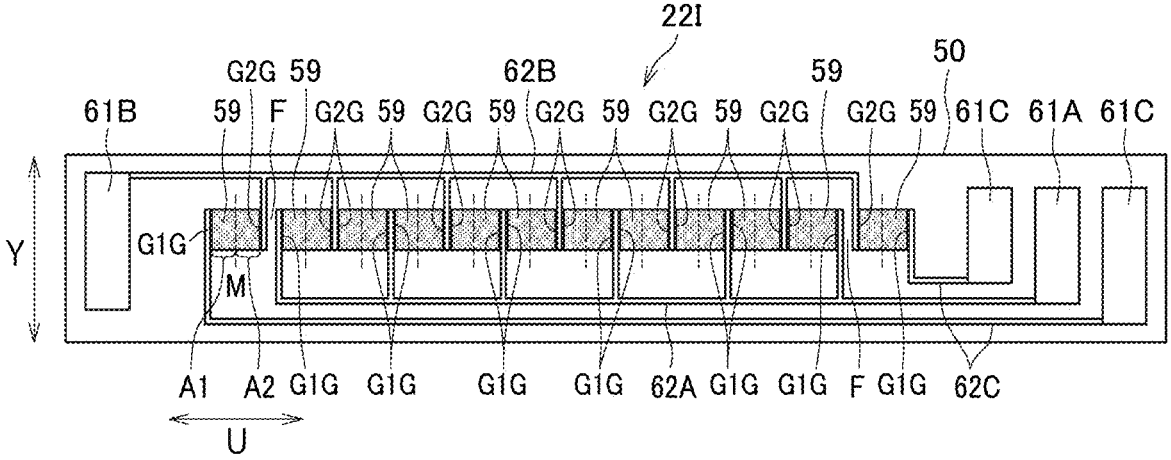
FIG. 43 is a plan view of a heater according to a fifth modification example, that is installable in the fixing device depicted in FIG. 2.
Figure 44:
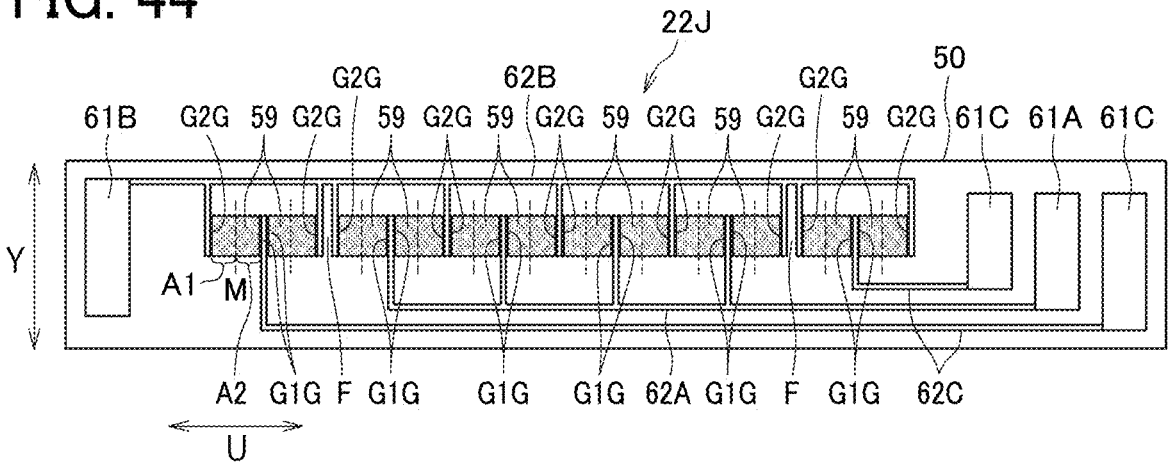
FIG. 44 is a plan view of a heater according to a sixth modification example, that is installable in the fixing device depicted in FIG. 2.

The technology of the present disclosure is also applicable to heaters 22H, 22I, and 22J illustrated in FIGS. 42, 43, and 44, respectively. In the heaters 22H, 22I, and 22J depicted in FIGS. 42, 43, and 44, respectively, the plurality of resistive heat generators 59 adjacent to each other, except a part of the resistive heat generators 59, is contiguous to each other via the first feeder 62A, the second feeder 62B, or the third feeder 62C. Conversely, a part of the resistive heat generators 59 is spaced apart from each other with the insulating gap F interposed therebetween. As illustrated in FIGS. 42 to 44, the insulating gap F is interposed between the resistive heat generator 59 disposed at each lateral end of the base 50 in the longitudinal direction U thereof and the adjacent, resistive heat generator 59 disposed inboard from the resistive heat generator 59 disposed at each lateral end of the base 50. The resistive heat generators 59 (e.g., a group or a pair of resistive heat generators 59) separated by the insulating gap F are connected to an identical electrode (e.g., the second electrode 61B) through an identical feeder (e.g., the second feeder 62B) and are connected to different electrodes (e.g., the first electrode 61A and the third electrode 61C) through different feeders (e.g., the first feeder 62A and the third feeder 62C), respectively. Hence, one resistive heat generator 59 of the group or the pair of resistive heat generators 59 generates heat separately from another resistive heart generator 59 of the group or the pair of resistive heat generators 59, that is adjacent to the one resistive heat generator 59 of the group or the pair of resistive heat generators 59 via the insulating gap F. As illustrated in FIGS. 42 to 44, the third electrodes 61C and the third feeders 62C connected to the third electrodes 61C are provided separately for the resistive heat generator 59 disposed at one lateral end of the base 50 and for the resistive heat generator 59 disposed at another lateral end of the base 50 in the longitudinal direction U thereof, respectively. Alternatively, the third electrodes 61C may be combined into a single electrode and the third feeders 62C may be combined into a single feeder.

In the heaters 22H, 22I, and 22J depicted in FIGS. 42 to 44, respectively, when a voltage is applied to the first electrode 61A and the second electrode 61B to generate an electric potential difference between the first electrode 61A and the second electrode 61B, the resistive heat generators 59 disposed in a center of the base 50 in the longitudinal direction U thereof generate heat. When a voltage is applied to the third electrodes 61C and the second electrode 61B to generate an electric potential difference between the third electrodes 61C and the second electrode 61B, the resistive heat generators 59 disposed at both lateral ends of the base 50 in the longitudinal direction U thereof generate heat. When a voltage is applied to the first electrode 61A, the second electrode 61B, and the third electrodes 61C, the resistive heat generators 59 generate heat collectively.

In the heaters 22H, 22I, and 22J also, the connecting positions (e.g., the primary connector G1G and the secondary connector G2G) that connect the first feeder 62A, the second feeder 62B, and the third feeders 62C to the resistive heat generator 59 are different between a part of the resistive heat generators 59 and other resistive heat generators 59, thus adjusting the heat generation amount for each of the resistive heat generators 59 as described in the above embodiments. For example, in the heaters 22H, 22I, and 22J depicted in FIGS. 42, 43, and 44, respectively, the primary connectors G1G, each of which serves as a primary connector, connect the first feeder 62A and the third feeders 62C disposed at one end side of the base 50 in the short direction Y thereof to the resistive heat generators 59. The secondary connectors G2G, each of which serves as a secondary connector, connect the second feeder 62B disposed at another end side of the base 50 in the short direction Y thereof to the resistive heat generators 59. The hypothetical center line M of each of the resistive heat generators 59 in the longitudinal direction U of the base 50 divides each of the resistive heat generators 59 into the first section A1 and the second section A2. The sections of the resistive heat generator 59, that are coupled to the primary connector G1G and the secondary connector G2G, respectively, are different between a part of the resistive heat generators 59 and other resistive heat generators 59.

For example, in the first, resistive heat generator 59 from the left in FIG. 42, the primary connector GIG is coupled to the second section A2 of the resistive heat generator 59. The secondary connector G2G is coupled to the first section A1 of the resistive heat generator 59. Conversely, in the second, resistive heat generator 59 from the left in FIG. 42, the primary connector GIG is coupled to the first section A1 of the resistive heat generator 59. The secondary connector G2G is coupled to the second section A2 of the resistive heat generator 59. Thus, the section of the resistive heat generator 59, that is coupled to at least one of the primary connector G1G and the secondary connector G2G, is different between a part of the resistive heat generators 59 and other resistive heat generators 59, adjusting the heat generation amount for each of the resistive heat generators 59 and thereby suppressing unevenness in the heat generation distribution of the heaters 22H, 22I, and 22J in a longitudinal direction thereof.

Figure 45:
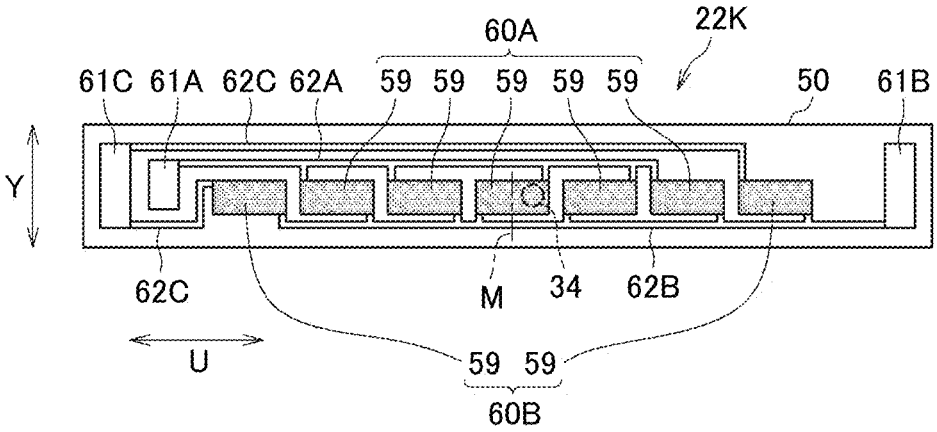
FIG. 45 is a plan view of a heater that is installable in the fixing device depicted in FIG. 2, illustrating a temperature detector incorporated therein.

FIG. 45 illustrates a heater 22K incorporating a temperature detector 34 (e.g., a temperature sensor). The temperature detector 34 is a thermistor used for temperature control, a thermostat used as a safety device that prevents overheating, or the like. The temperature detector 34 may be disposed opposite one of the resistive heat generators 59. In this case, the temperature detector 34 is preferably disposed opposite a section of the resistive heat generator 59, that is defined by the hypothetical center line M in the longitudinal direction 13 of the base 50 and is susceptible to temperature increase, that is, a right section in FIG. 45 of the resistive heat generator 59. The temperature detector 34 disposed opposite a position on the resistive heat generator 59, that is susceptible to temperature increase, detects overheating of the heater 22K readily in advance, improving safety of the heater 22K. Additionally, the temperature detector 34 suppresses hot offset, that is, adhesion of melted toner to the fixing belt 20 from a sheet due to high temperature.

According to the embodiments of the present disclosure, in order to suppress uneven temperature of a heater in a longitudinal direction thereof further, the heater may employ a resistive heat generator having a positive temperature coefficient (PTC) property. The PTC property defines a property in which the resistance value increases as the temperature increases, for example, a heater output decreases under a given voltage. Since a heat generator has the PTC property, the heater starts quickly with an increased output when the heater has a low temperature and suppresses overheating of the heater with a decreased output when the heater has a high temperature. For example, if a temperature coefficient of resistance (TCR) of the PTC property is in a range of from about 300 ppm/° C. to about 4,000 ppm/° C., the heater is manufactured at reduced costs while retaining a resistance value needed for the heater. The TCR is preferably in a range of from about 500 ppm/° C. to about 2,000 ppm° C.

The TCR is calculated with a formula (2) below. In the formula (2), T0 represents a reference temperature. T1 represents an arbitrary temperature. R0 represents a resistance value at the reference temperature T0. R1 represents a resistance value at the arbitrary temperature T1. For example, in the heater 22 described above with reference to FIG. 13, if the resistance values between the first electrode 61A and the second electrode 61B are 10Ω as the resistance value R0 at 25 degrees Celsius as the reference temperature T0 and 12Ω as the resistance value R1 at 125 degrees Celsius as the arbitrary temperature T1, respectively, the TCR is 2,000 ppm/° C. according to the formula (2).

Formula (2):

$$TCR=(R1-R0)/R0/(T1-T0)\times 10^6 \quad (2)$$

Figure 46:
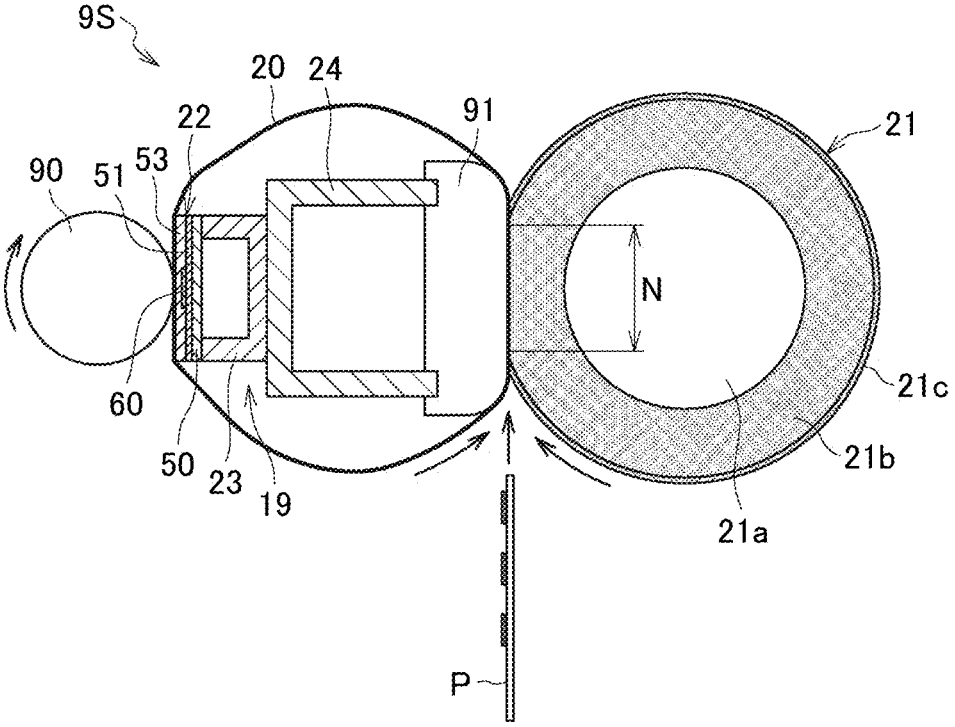
FIG. 46 is a schematic cross-sectional view of a fixing device installable in the image forming apparatus depicted in FIG. 1 as a first variation of the fixing device depicted in FIG.
Figure 47:
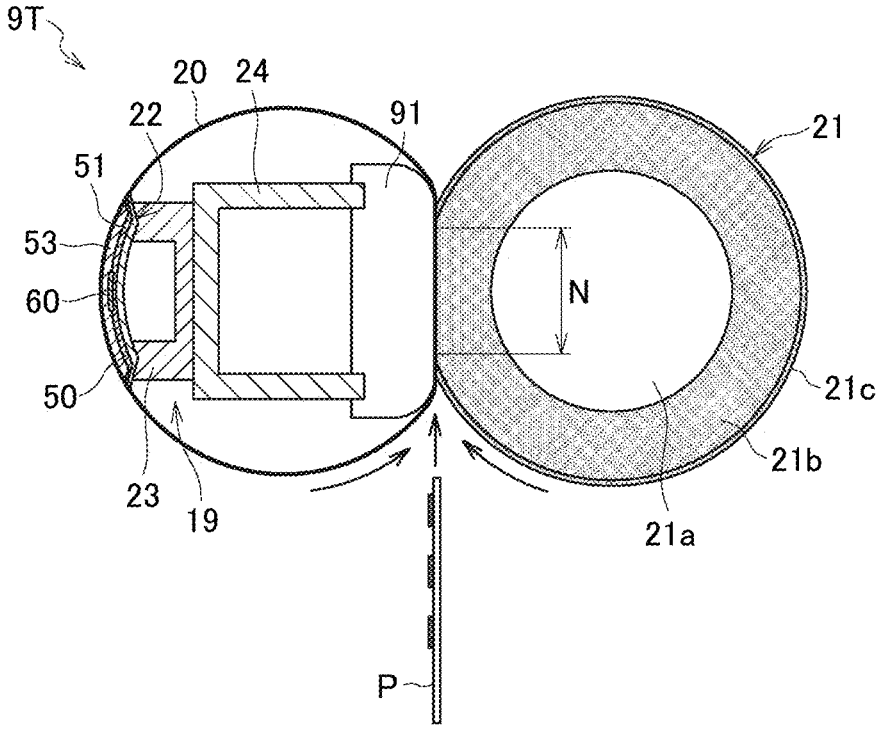
FIG. 47 is a schematic cross-sectional view of a fixing device installable in the image forming apparatus depicted in FIG. 1 as a second variation of the fixing device depicted in FIG. 2.
Figure 48:
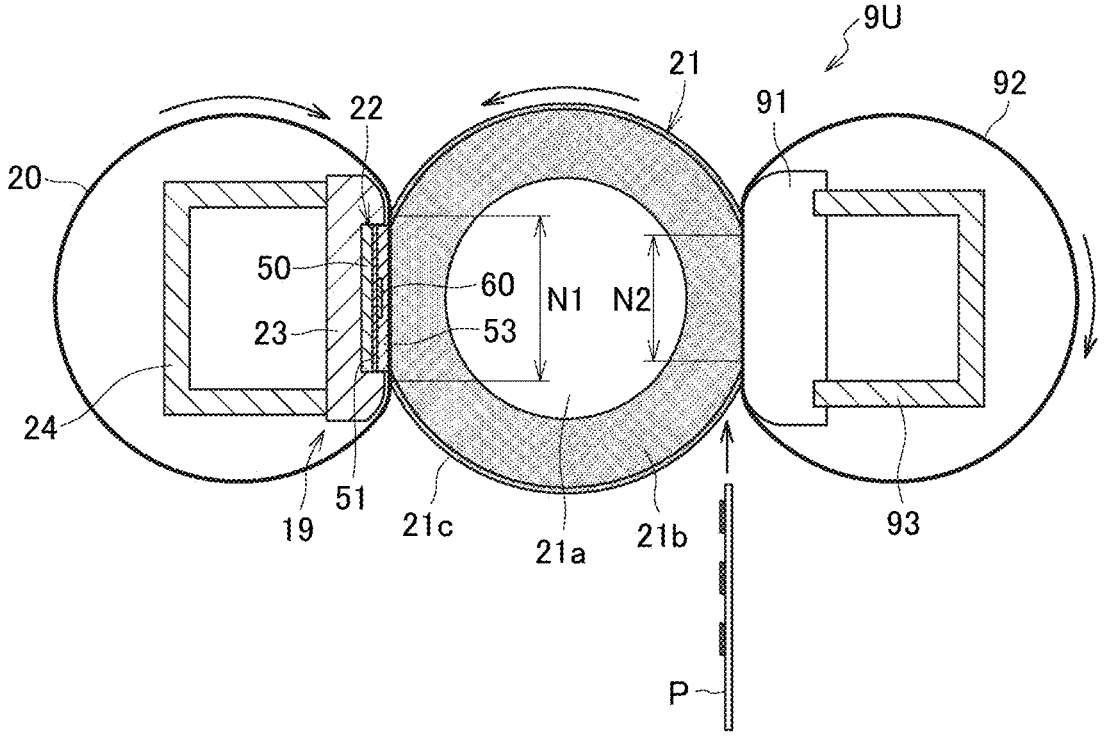
FIG. 48 is a schematic cross-sectional view of a fixing device installable in the image forming apparatus depicted in FIG. 1 as a third variation of the fixing device depicted in FIG. 2.

The embodiments of the present disclosure are also applicable to fixing devices 9S, 9T, and 9U illustrated in FIGS. 46, 47, and 48, respectively, other than the fixing device 9 described above. The following briefly describes a construction of each of the fixing devices 9S, 9T, and 9U illustrated in FIGS. 46, 47, and 48, respectively.

A description is provided of the construction of the fixing device 9S depicted in FIG. 46.

As illustrated in FIG. 46, the fixing device 9S includes a pressing roller 90 disposed opposite the pressure roller 21 via the fixing belt 20. The pressing roller 90 and the heater 22 sandwich the fixing belt 20 so that the heater 22 heats the fixing belt 20. On the other hand, a nip former 91 (e.g., a nip formation pad) is in contact with the inner circumferential surface of the fixing belt 20 and disposed opposite the pressure roller 21 via the fixing belt 20.

The stay 24 supports the nip former 91. The nip former 91 and the pressure roller 21 sandwich the fixing belt 20 and define the fixing nip N.

A description is provided of the construction of the fixing device 9T depicted in FIG. 47.

As illustrated in FIG. 47, the fixing device 9T does not include the pressing roller 90 described above with reference to FIG. 46. In the fixing device 9T, in order to attain a contact length for which the heater 22 contacts the fixing belt 20 in a circumferential direction thereof, the heater 22 is curved into an arc in cross section that corresponds to a curvature of the fixing belt 20. Other construction of the fixing device 9T is equivalent to that of the fixing device 9S depicted in FIG. 46.

A description is provided of the construction of the fixing device 9U depicted in FIG. 48.

As illustrated in FIG. 48, the fixing device 9U includes a pressure belt 92 in addition to the fixing belt 20. Additionally, in the fixing device 9U, the pressure belt 92 and the pressure roller 21 form a fixing nip N2 serving as a secondary nip separately from a heating nip N1 serving as a primary nip formed between the fixing belt 20 and the pressure roller 21. For example, the nip former 91 and a stay 93 are disposed opposite the fixing belt 20 via the pressure roller 21. The pressure belt 92 is rotatable and accommodates the nip former 91 and the stay 93. As a sheet P bearing a toner image is conveyed through the fixing nip N2 formed between the pressure belt 92 and the pressure roller 21, the pressure belt 92 and the pressure roller 21 fix the toner image on the sheet P under heat and pressure. Other construction of the fixing device 9U is equivalent to that of the fixing device 9 depicted in FIG. 2.

The embodiments of the present disclosure are also applicable to apparatuses and devices other than the image forming apparatus 100 that forms a toner image on a recording medium by electrophotography and incorporates the fixing device 9, 9S, 9T, or 9U described above. For example, the embodiments of the present disclosure are also applicable to an image forming apparatus employing an inkjet method, that incorporates a dryer that dries ink applied onto a sheet. Further, the embodiments of the present disclosure are also applicable to a thermocompression bonding device incorporating a thermocompression bonding portion that bonds bonding surfaces, that are superimposed, by thermocompression. For example, the thermocompression bonding device includes a laminator that bonds film as a coating member onto a surface of a sheet by thermocompression and a heat sealer that bonds sealing portions of a packaging material by thermocompression. The embodiments of the present disclosure are applied to the image forming apparatus employing the inkjet method and the thermocompression bonding device, thus suppressing an uneven temperature distribution of a heater.

A description is provided of advantages of a heater (e.g., the heaters 22, 22A, 22B, 22C, 22D, 22E, 22F, 22G, 22H, 22I, 22J, and 22K).

As illustrated in FIGS. 7 and 13, the heater includes a base (e.g., the base 50), a plurality of electrodes (e.g., the first electrode 61A, the second electrode 61B, and the third electrode 61C), a plurality of heat generators (e.g., the resistive heat generators 59), a plurality of conductors (e.g., the first feeder 62A, the second feeder 62B, and the third feeder 62C), and a plurality of connectors (e.g., the primary connector G1 and the secondary connector G2).

The base is platy and extended in a longitudinal direction (e.g., the longitudinal direction U). The plurality of electrodes includes a first electrode (e.g., the first electrode 61A) and a second electrode (e.g., the second electrode 61B) that are mounted on the base. The plurality of heat generators includes a first heat generator (e.g., the resistive heat generator 59 or 59D) and a second heat generator (e.g., the resistive heat generator 59 or 59D) that are mounted on the base and arranged in the longitudinal direction of the base. The plurality of conductors includes a first conductor (e.g., the first feeder 62A) and a second conductor (e.g., the second feeder 62B) that are mounted on the base.

The first conductor connects the first electrode to the first heat generator and the second heat generator. The second conductor connects the second electrode to the first heat generator and the second heat generator. The first heat generator is adjacent to the second heat generator with an insulating region (e.g., the insulating gap F) therebetween.

The plurality of connectors includes a first primary connector and a second primary connector (e.g., the primary connectors G1 or G1G). The first primary connector and the second primary connector connect the first conductor to the first heat generator and the second heat generator, respectively. The first conductor is disposed at one end side of the base in a short direction (e.g., the short direction Y) thereof. The plurality of connectors further includes a first secondary connector and a second secondary connector (e.g., the secondary connectors G2 or G2G). The first secondary connector and the second secondary connector connect the second conductor to the first heat generator and the second heat generator, respectively. The second conductor is disposed at another end side of the base in the short direction thereof and disposed opposite the first conductor via the first heat generator and the second heat generator.

Each of the first heat generator and the second heat generator has a hypothetical center line e.g., the hypothetical center line M) in the longitudinal direction of the base. The hypothetical center line divides each of the first heat generator and the second heat generator into a first section (e.g., the first section A1) and a second section (e.g., the second section A2).

A section (e.g., the first section A1 or the second section A2) of each of a plurality of heat generators (e.g., the resistive heat generators 59 or 59D), that is coupled to at least one of a primary connector (e.g., the primary connector G1 or G1G) and a secondary connector (e.g., the secondary connector G2 or G2G), is different between a part of the heat generators and other heat generators.

For example, the first primary connector connects the first conductor to the first section of the first heat generator. The second primary connector connects the first conductor to the second section of the second heat generator. The first secondary connector connects the second conductor to the first heat generator (e.g., the second section of the first heat generator). The second secondary connector connects the second conductor to the second heat generator (e.g., the first section of the second heat generator).

Accordingly, the heater adjusts a temperature distribution in a longitudinal direction thereof.

According to the embodiments described above, the fixing belt 20 serves as a fixing rotator. Alternatively, a fixing film, a fixing sleeve, or the like may be used as a fixing rotator. Further, the pressure roller 21 serves as an opposed rotator. Alternatively, a pressure belt or the like may be used as an opposed rotator.

According to the embodiments described above, the image forming apparatus 100 is a printer. Alternatively, the image forming apparatus 100 may be a copier, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various otherways, for example, in an order different from the one described above.

What is claimed is:

1. A heater comprising:

a base being platy and extending in a longitudinal direction of the base;

a first electrode mounted on the base;

a second electrode mounted on the base;

a first heat generator mounted on the base;

a second heat generator arranged with the first heat generator in the longitudinal direction of the base, each of the first heat generator and the second heat generator having a hypothetical center line in the longitudinal direction of the base, the hypothetical center line dividing each of the first heat generator and the second heat generator into a first section and a second section;

a first conductor mounted on the base and configured to connect the first electrode to the first heat generator and the second heat generator;

a second conductor mounted on the base and configured to connect the second electrode to the first heat generator and the second heat generator;

a first primary connector configured to connect the first conductor to the first section of the first heat generator;

a second primary connector configured to connect the first conductor to the second section of the second heat generator;

a first secondary connector configured to connect the second conductor to the first heat generator; and a second secondary connector configured to connect the second conductor to the second heat generator.

2. The heater according to claim 1, wherein the first conductor is disposed at one end side of the base in a short direction of the base, and wherein the second conductor is disposed at another end side of the base in the short direction of the base and disposed opposite the first conductor via the first heat generator and the second heat generator.

3. The heater according to claim 1, wherein the first heat generator is adjacent to the second heat generator with an insulating region between the first heat generator and the second heat generator.

4. The heater according to claim 1, further comprising:

a third electrode;

a third heat generator having the hypothetical center line in the longitudinal direction of the base, the hypothetical center line dividing the third heat generator into the first section and the second section;

a third conductor configured to connect the third electrode to the third heat generator;

a third primary connector configured to connect the third conductor to the third heat generator; and a third secondary connector configured to connect the second conductor to the third heat generator.

5. The heater according to claim 1, wherein the first heat generator is disposed at a lateral end side of the base in the longitudinal direction of the base, and wherein the second heat generator is disposed at a position outside the lateral end side of the base in the longitudinal direction of the base.

6. The heater according to claim 1, wherein the first secondary connector is configured to connect the second conductor to the second section of the first heat generator, and wherein the second secondary connector is configured to connect the second conductor to the first section of the second heat generator.

7. The heater according to claim 6, further comprising:

a fourth heat generator disposed adjacent to the first heat generator, the fourth heat generator having the hypothetical center line in the longitudinal direction of the base, the hypothetical center line dividing the fourth heat generator into the first section and the second section;

a fourth primary connector configured to connect the first conductor to the first section of the fourth heat generator; and a fourth secondary connector configured to connect the second conductor to the second section of the fourth heat generator.

8. The heater according to claim 1, wherein the first conductor includes a slope inclined with respect to the longitudinal direction of the base and connected to the first heat generator.

9. The heater according to claim 1, wherein each of the first primary connector and the first secondary connector is disposed at one lateral end side of the first heat generator in the longitudinal direction of the base.

10. The heater according to claim 1, wherein the first primary connector is disposed at one lateral end side of the first heat generator in the longitudinal direction of the base, and wherein the first secondary connector is disposed at another lateral end side of the first heat generator in the longitudinal direction of the base.

11. The heater according to claim 1, wherein the first primary connector is disposed at a corner of the first heat generator and the first secondary connector is disposed at another corner of the first heat generator.

12. The heater according to claim 1, wherein the first heat generator includes a bent portion bent and extended reciprocally in the longitudinal direction of the base.

13. The heater according to claim 1, wherein an electric potential difference is configured to generate between the first electrode and the second electrode.

14. The heater according to claim 1, wherein the first conductor includes an extension extended in a short direction of the base and connected to the first heat generator.

15. The heater according to claim 1, wherein the first heat generator includes an extension extended in a short direction of the base and connected to the first conductor.

16. The heater according to claim 1, wherein each of the first primary connector, the second primary connector, the first secondary connector, and the second secondary connector is extended in a short direction of the base.

17. The heater according to claim 1, wherein the first secondary connector is configured to connect the second conductor to the first section of the first heat generator, and wherein the second secondary connector is configured to connect the second conductor to the first section of the second heat generator.

18. The heater according to claim 1, wherein the first secondary connector is configured to connect the second conductor to the first section of the first heat generator, and wherein the second secondary connector is configured to connect the second conductor to the second section of the second heat generator.

19. A heating device comprising:

a holder; and a heater held by the holder, the heater including:

a base being platy and extending in a longitudinal direction of the base;

a first electrode mounted on the base;

a second electrode mounted on the base;

a first heat generator mounted on the base;

a second heat generator arranged with the first heat generator in the longitudinal direction of the base, each of the first heat generator and the second heat generator having a hypothetical center line in the longitudinal direction of the base, the hypothetical center line dividing each of the first heat generator and the second heat generator into a first section and a second section;

a first conductor mounted on the base and configured to connect the first electrode to the first heat generator and the second heat generator;

a second conductor mounted on the base and configured to connect the second electrode to the first heat generator and the second heat generator;

a first primary connector configured to connect the first conductor to the first section of the first heat generator;

a second primary connector configured to connect the first conductor to the second section of the second heat generator;

a first secondary connector configured to connect the second conductor to the first heat generator; and a second secondary connector configured to connect the second conductor to the second heat generator.

20. An image forming apparatus comprising:

an image forming device configured to form an image on a recording medium; and a heater configured to heat the image on the recording medium, the heater including:

a base being platy and extending in a longitudinal direction of the base;

a first electrode mounted on the base;

a second electrode mounted on the base;

a first heat generator mounted on the base;

a second heat generator arranged with the first heat generator in the longitudinal direction of the base, each of the first heat generator and the second heat generator having a hypothetical center line in the longitudinal direction of the base, the hypothetical center line dividing each of the first heat generator and the second heat generator into a first section and a second section;

a first conductor mounted on the base and configured to connect the first electrode to the first heat generator and the second heat generator;

a second conductor mounted on the base and configured to connect the second electrode to the first heat generator and the second heat generator;

a first primary connector configured to connect the first conductor to the first section of the first heat generator;

a second primary connector configured to connect the first conductor to the second section of the second heat generator;

a first secondary connector configured to connect the second conductor to the first heat generator; and a second secondary connector configured to connect the second conductor to the second heat generator.

* * * * *